US012668898B2

(12) United States Patent
Abouraddy et al.

(10) Patent No.: US 12,668,898 B2
(45) Date of Patent: Jun. 30, 2026

(54) COLOR-CHANGING FABRIC AND APPLICATIONS

(71) Applicant: UNIVERSITY OF CENTRAL FLORIDA RESEARCH FOUNDATION, INC., Orlando, FL (US)

(72) Inventors: Ayman Abouraddy, Orlando, FL (US); Joshua Kaufman, Orlando, FL (US); Morgan Monroe, Orlando, FL (US); Felix Tan, Orlando, FL (US)

(73) Assignee: UNIVERSITY OF CENTRAL FLORIDA RESEARCH FOUNDATION, INC., Orlando, FL (US)

( * ) Notice: Subject to any disclaimer, the term of this patent is extended or adjusted under 35 U.S.C. 154(b) by 0 days.

(21) Appl. No.: 18/624,556

(22) Filed: Apr. 2, 2024

(65) Prior Publication Data

US 2024/0263362 A1 Aug. 8, 2024

Related U.S. Application Data

(63) Continuation of application No. 17/901,183, filed on Sep. 1, 2022, now Pat. No. 11,976,389, which is a (Continued)

(51) Int. Cl.
*D03D 1/00* (2006.01)

(52) U.S. Cl.
CPC ..... *D03D 1/0088* (2013.01); *D10B 2331/04* (2013.01)

(58) Field of Classification Search
None
See application file for complete search history.

(56) References Cited

U.S. PATENT DOCUMENTS 2,936,482 A 5/1960 Kilian
2,989,798 A 6/1961 Bannerman
(Continued)

FOREIGN PATENT DOCUMENTS

CN 1898421 A 1/2007
CN 202959765 U 6/2013
(Continued)

OTHER PUBLICATIONS

Cherenack Kunigunde et al: "Smart textiles: Challenges and opportunities", Journal of Applied Physics, American Institute of Physics, 2 Huntington Quadrangle, Melville, NY 11747, vol. 112, No. 9, Nov. 1, 2012 (Nov. 1, 2012), pp. 91301-91301.
(Continued)

*Primary Examiner* — Shawn Mckinnon
(74) *Attorney, Agent, or Firm* — Foley & Lardner LLP

(57) ABSTRACT

A method for manufacturing a color-changing product using an electrical connectorization system including an ultrasonic welder includes providing a fabric to the electrical connectorization system where the fabric includes a plurality of color-changing fibers, providing a connection bus to the electrical connectorization system, and operating the electrical connectorization system to move the fabric and the connection bus into engagement with the ultrasonic welder to generate one or more welds between the connection bus and at least a subset of the plurality of color-changing fibers as the fabric and the connection bus pass the ultrasonic welder.

20 Claims, 43 Drawing Sheets

Related U.S. Application Data continuation of application No. 16/880,805, filed on May 21, 2020, now Pat. No. 11,479,886.

(56) References Cited

U.S. PATENT DOCUMENTS

| | | | |
|---|---|---|---|
| 3,217,734 | A | 11/1965 | Fitzgerald |
| 4,059,949 | A | 11/1977 | Lee |
| 4,085,182 | A | 4/1978 | Kato |
| 4,330,704 | A | 5/1982 | Jensen |
| 4,681,791 | A | 7/1987 | Shibahashi et al. |
| 4,851,282 | A | 7/1989 | Shimizu et al. |
| 5,110,998 | A | 5/1992 | Muschiatti |
| 5,153,066 | A | 10/1992 | Tanaka et al. |
| 5,277,976 | A | 1/1994 | Hogle et al. |
| 5,281,208 | A | 1/1994 | Thompson et al. |
| 5,405,682 | A | 4/1995 | Shawyer et al. |
| 5,753,381 | A | 5/1998 | Feldman et al. |
| 5,827,611 | A | 10/1998 | Forbes |
| 5,906,004 | A | 5/1999 | Lebby et al. |
| 6,069,435 | A | 5/2000 | Amey, Jr. et al. |
| 6,096,666 | A | 8/2000 | Jachimowicz et al. |
| 6,200,669 | B1 | 3/2001 | Marmon et al. |
| 6,607,157 | B1 | 8/2003 | Duescher |
| 6,710,242 | B1 | 3/2004 | Iguro et al. |
| 7,164,820 | B2 | 1/2007 | Eves et al. |
| 9,182,561 | B2 | 11/2015 | Bauco |
| 10,037,672 | B1 | 7/2018 | Abraham et al. |
| 11,365,493 | B2 | 6/2022 | Zhou et al. |
| 2001/0045677 | A1 | 11/2001 | Kang |
| 2002/0046795 | A1 | 4/2002 | Billieres |
| 2002/0090510 | A1 | 7/2002 | Ono et al. |
| 2002/0114598 | A1 | 8/2002 | Bodaghi |
| 2003/0194578 | A1 | 10/2003 | Tam et al. |
| 2003/0224155 | A1 | 12/2003 | Orth et al. |
| 2006/0000766 | A1 | 1/2006 | Ji |
| 2006/0081639 | A1 | 4/2006 | Lazaroff et al. |
| 2007/0195546 | A1 | 8/2007 | Den Toonder et al. |
| 2007/0273951 | A1 | 11/2007 | Ribi |
| 2008/0092599 | A1 | 4/2008 | Hazan et al. |
| 2008/0170982 | A1 | 7/2008 | Zhang et al. |
| 2008/0233379 | A1 | 9/2008 | O'Connor |
| 2009/0065969 | A1 | 3/2009 | Perera et al. |
| 2009/0085444 | A1 | 4/2009 | Alvarez Icaza Rivera et al. |
| 2009/0105796 | A1 | 4/2009 | Atanasoska et al. |
| 2009/0133922 | A1 | 5/2009 | Okazaki et al. |
| 2009/0260848 | A1 | 10/2009 | Perera et al. |
| 2009/0302237 | A1 | 12/2009 | Bortz et al. |
| 2010/0003496 | A1 | 1/2010 | Dias et al. |
| 2010/0029161 | A1 | 2/2010 | Pourdeyhimi |
| 2010/0089607 | A1 | 4/2010 | Nakamura et al. |
| 2010/0315755 | A1 | 12/2010 | Gavin |
| 2011/0109611 | A1 | 5/2011 | Nakamura |
| 2011/0217544 | A1 | 9/2011 | Young et al. |
| 2012/0030935 | A1 | 2/2012 | Slade et al. |
| 2012/0077403 | A1 | 3/2012 | Gaillard et al. |
| 2012/0097194 | A1 | 4/2012 | Mcdaniel et al. |
| 2012/0148797 | A1 | 6/2012 | Tsai |
| 2012/0186719 | A1* | 7/2012 | Van Den Aker ..... B29C 66/81419 156/538 |
| 2012/0211156 | A1 | 8/2012 | Harvey |
| 2012/0231690 | A1 | 9/2012 | Pourdeyhimi et al. |
| 2013/0033378 | A1 | 2/2013 | Donovan et al. |
| 2013/0205979 | A1 | 8/2013 | Nelis et al. |
| 2014/0053315 | A1 | 2/2014 | Pond |
| 2014/0113813 | A1 | 4/2014 | Kwan |
| 2014/0170920 | A1 | 6/2014 | Manipatruni et al. |
| 2014/0329058 | A1 | 11/2014 | Lin |
| 2014/0366238 | A1 | 12/2014 | Owen et al. |
| 2015/0088027 | A1 | 3/2015 | Cranston et al. |
| 2015/0191607 | A1 | 7/2015 | Mcdaniel |
| 2015/0275404 | A1 | 10/2015 | Erlandsson et al. |
| 2016/0053169 | A1 | 2/2016 | Kunath et al. |
| 2016/0168759 | A1 | 6/2016 | Grassi et al. |
| 2016/0174650 | A1 | 6/2016 | Donovan et al. |
| 2016/0178454 | A1 | 6/2016 | Savaria et al. |
| 2016/0223878 | A1 | 8/2016 | Tran et al. |
| 2017/0029991 | A1 | 2/2017 | Chandrasekaran et al. |
| 2017/0058451 | A1 | 3/2017 | Smith et al. |
| 2018/0240396 | A1 | 8/2018 | Fontecchio et al. |
| 2018/0271180 | A1 | 9/2018 | Kim et al. |
| 2018/0271188 | A1 | 9/2018 | Matheny et al. |
| 2018/0364518 | A1 | 12/2018 | Paolini et al. |
| 2019/0040562 | A1 | 2/2019 | Moon |
| 2019/0064623 | A1 | 2/2019 | Gillaspie et al. |
| 2019/0071799 | A1 | 3/2019 | Zhou |
| 2019/0078237 | A1 | 3/2019 | Jeong et al. |
| 2019/0112733 | A1* | 4/2019 | Abouraddy ..... D01F 8/00 |
| 2019/0153630 | A1 | 5/2019 | Zhou |
| 2020/0024774 | A1 | 1/2020 | Yasutomo et al. |
| 2020/0029899 | A1 | 1/2020 | Bogdanovich et al. |
| 2020/0063296 | A1 | 2/2020 | Ozden et al. |
| 2020/0103720 | A1 | 4/2020 | Anseth et al. |
| 2020/0283931 | A1 | 9/2020 | Abouraddy et al. |
| 2022/0372663 | A1 | 11/2022 | Ino |

FOREIGN PATENT DOCUMENTS

| | | | |
|---|---|---|---|
| CN | 206921540 | U | 1/2018 |
| DE | 10 2009 052 848 | A1 | 5/2011 |
| EP | 1 221 500 | A1 | 7/2002 |
| FR | 2993888 | | 1/2014 |
| GB | 2 464 533 | A | 4/2010 |
| JP | 2826134 | B2 | 3/1991 |
| JP | H04-122620 | A | 4/1992 |
| JP | H08-027653 | A | 1/1996 |
| JP | H11-195329 | A | 7/1999 |
| JP | 3110521 | B2 | 11/2000 |
| JP | H02-041415 | A | 2/2002 |
| JP | 2004-137614 | A | 5/2004 |
| JP | 2007-521420 | A | 8/2007 |
| JP | H09-059823 | A | 3/2009 |
| JP | 2010-522283 | A | 7/2010 |
| JP | H11-053969 | A | 3/2011 |
| JP | 2012-500865 | A | 1/2012 |
| JP | 2012-528253 | A | 11/2012 |
| JP | 2013-529504 | A | 7/2013 |
| JP | 2021-050049 | A | 4/2021 |
| KR | 100901133 | B1 | 5/2009 |
| KR | 20120017436 | | 2/2012 |
| KR | 20130035821 | A | 4/2013 |
| KR | 101541214 | B1 | 8/2015 |
| WO | WO-97/27360 | A1 | 7/1997 |
| WO | WO-2005/096075 | A1 | 10/2005 |
| WO | WO-2006/123133 | A1 | 11/2006 |
| WO | WO-2014/020266 | A1 | 2/2014 |

OTHER PUBLICATIONS

Extended European Search Report issued in connection with EP Appl. No. 21809135.3 dated Dec. 17, 2024.

Gilsoo Cho: "Smart Clothing Technology and Applications", Jan. 1, 2010 (Jan. 1, 2010), XP055145274, ISBN: 978-1-42-008852-6.

EU Extended Search Report on EP 21809067.8 dated Dec. 20, 2024 (15 pages).

Karpagam, K.R., et al., Development of Smart Clothing for Military Applications Using Thermochromic Colorants, The Journal of Textile Institute, Aug. 15, 2016, pp. 1-6, XP055296130, GB ISSN: 0040-5000, DOI: 1080/00405000.2016.1220818.

Extended European Search Report issued in connection with EP Appl. No. 21808989.4 dated Feb. 24, 2025.

European Search Report received for EP Application No. 18869173.7 dated Jun. 14, 2021, 8 pages.

Final Office Action on U.S. Appl. No. 16/163,307 DTD Jan. 6, 2022.

Final Office Action on U.S. Appl. No. 16/163,307 DTD Feb. 5, 2021.

Final Office Action on U.S. Appl. No. 16/163,307 DTD May 11, 2023.

Final Office Action on U.S. Appl. No. 16/846,834 DTD Jan. 19, 2024.

Final Office Action on U.S. Appl. No. 16/846,834 DTD May 3, 2023.

(56) References Cited

OTHER PUBLICATIONS

Final Office Action on U.S. Appl. No. 16/880,793 DTD Jan. 25, 2024.
Final Office Action on U.S. Appl. No. 16/880,793 DTD Feb. 2, 2023.
Foreign Action other than Search Report on CN 201880081397.8 DTD Dec. 1, 2021.
Foreign Action other than Search Report on CN 201880081397.8 DTD Jun. 30, 2022.
Foreign Action other than Search Report on JP 2020-542537 DTD Jan. 5, 2022.
Foreign Action other than Search Report on KR 10-2020-7013654 DTD Apr. 20, 2022.
Foreign Action other than Search Report on PCT DTD Nov. 17, 2022.
Foreign Action other than Search Report on PCT DTD Dec. 1, 2022.
International Preliminary Report on Patentability on PCT Appl. Ser. No. PCT/US2018/056323 dated Apr. 30, 2020 (6 pages).
International Search Report and Written Opinion, PCT/US2018/056323, University of Central Florida Research Foundation, Inc., 9 pages (Jan. 2, 2019).
Japanese Office Action and English Translation Received for application No. 2020-542537 dated Jun. 15, 2021, 6 pages.
KR Office Action on KR Appl. Ser. No. 10-2020-7013654 dated May 28, 2021 (11 pages).
Laforgue et. al., "Multifunctional Resistive-Heating and Color-Changing Monofilaments Produced by a Single-Step Coaxial Melt-Spinning Process," ACS Appl. Mater. Interfaces 2020, 4 pages.
Li, Qiang et. al., "Reduced graphene oxide functionalized stretchable and multicolor electrothermal chromatic fibers,", Journal of Materials Chemistry C, 2017, 6 pages.
MatWeb. "Nickel" and "Steel" Data Sheets. (Year: 2000).
Non-Final Office Action on U.S. Appl. No. 16/163,307 DTD Jun. 25, 2021.
Non-Final Office Action on U.S. Appl. No. 16/163,307 DTD Jun. 26, 2020.
Non-Final Office Action on U.S. Appl. No. 16/163,307 DTD Aug. 22, 2022.
Non-Final Office Action on U.S. Appl. No. 16/846,834 DTD Oct. 4, 2023.
Non-Final Office Action on U.S. Appl. No. 16/846,834 DTD Oct. 25, 2022.
Non-Final Office Action on U.S. Appl. No. 16/880,793 DTD Jun. 27, 2023.
Non-Final Office Action on U.S. Appl. No. 16/880,793 DTD Jun. 28, 2022.
Notice of Allowance on U.S. Appl. No. 16/846,834 DTD Mar. 7, 2024.
Notice of Allowance on U.S. Appl. No. 16/880,802 DTD Mar. 8, 2023.
Notice of Allowance on U.S. Appl. No. 16/880,805 DTD Jun. 7, 2022.
Notice of Allowance on U.S. Appl. No. 17/901,183 DTD Jan. 3, 2024.
Notice of Reasons for Refusal on JP Appl. Ser. No. 2020-542537 dated May 31, 2022 (10 pages).
PCT International Search Report and Written Opinion for International Application No. PCT/US2021/033211 mailing date Aug. 25, 2021, 11 pages.
PCT International Search Report and Written Opinion for International Application No. PCT/US2021/033212 mailing date Sep. 8, 2021, 9 pages.
PCT International Search Report and Written Opinion for International Application No. PCT/US2021/033216 mailing date Sep. 10, 2021, 12 pages.
Preliminary Rejection on KR Patent Application No. 10-2020-7013654 dated May 28, 2021 11 pages.
Restriction Requirement on U.S. Appl. No. 16/846,834 DTD Aug. 18, 2022.
Teamlogo .com ("Custom Imprint and Embroidery"). Website: https ://web .archive org/web/20140701115135/https://teamlogo .com/ inc/ sdetail/988/991. Jul. 1, 2014. (Year: 2014).
US Office Action on US Dtd Jul. 31, 2023.
US Office Action on U.S. Appl. No. 16/880,805 DTD Jan. 27, 2022.

* cited by examiner

Fabric Edge

Coating Removal Fabric Edge

Core Connections

Electrical Connections

COLOR-CHANGING FABRIC AND APPLICATIONS

CROSS-REFERENCE TO RELATED PATENT APPLICATIONS

This application is a continuation of U.S. patent application Ser. No. 17/901,183, filed Sep. 1, 2022, which is a continuation of U.S. patent application Ser. No. 16/880,805, filed May 21, 2020, both of which are incorporated herein by reference in their entireties.

BACKGROUND

Thermochromic pigments change color in response to a thermal stimulus (e.g., as they change temperature, etc.). Thermochromic pigments may include liquid crystals, while other thermochromic pigments may use organic dyes (e.g., carbon-based dyes, etc.) known as leucodyes. Leucodyes are (i) optically transparent or have a particular color at a first temperature and (ii) become visible or change to a different color at a second temperature. Such a change is evident to an observer as the temperature rises or falls. Leucodyes are organic chemicals that change color when heat energy makes their molecules shift back and forth between two subtly differently structures, known as the leuco (colorless) and non-leuco (colored) forms. Thermochromic liquid crystals may shift color up and down the visible spectrum as they get hotter or colder, while leucodyes may be mixed in various ways to produce different kinds of color-changing effects at a wide range of temperatures.

SUMMARY

One embodiment relates to a color-changing product. The color-changing product includes a fabric. At least a portion of the fabric includes or is arranged using at least one of (i) a color-changing fiber or (ii) a color-changing yarn including the color-changing fiber. The color-changing fiber includes an electrically conductive core having a first tensile strength, a reinforcement core having a second tensile strength that is greater than the first tensile strength, and a coating disposed around and along the electrically conductive core and the reinforcement core. The coating includes a polymeric material having a color-changing pigment.

Another embodiment relates to a color-changing product. The color-changing product includes a a fabric, a connection bus, and a power source. The fabric includes a plurality of color-changing fibers. Each of the plurality of color-changing fibers includes an electrically conductive core and a coating disposed around and along the electrically conductive core. The coating includes a polymeric material having a color-changing pigment. The connection bus is disposed along at least a portion of the fabric. The connection bus forms a weld between at least a subset of electrically conductive cores of the plurality of color-changing fibers. The connection bus includes a first layer manufactured from a metallic material that electrically connects the subset of electrically conductive cores and a second layer that electrically isolates the weld from a surrounding environment. The power source is configured to provide electrical current to the connection bus and, thereby, the subset of electrically conductive cores to cause a color-change to the plurality of color-changing fibers associated with the subset of electrically conductive cores.

Still another embodiment relates to a color-changing product system. The color-changing product system includes a plurality of color-changing products and a control system. Each of the plurality of color-changing products includes a fabric, a power source, a first wireless communications interface, and a controller. At least a portion of the fabric includes or is arranged using at least one of (i) a color-changing fiber or (ii) a color-changing yarn including the color-changing fiber. The power source is configured to provide electrical current to the color-changing fiber to cause a color-change to the portion of the fabric. The controller is configured to selectively activate the power source based on a control signal received by the first wireless communications interface. The control system includes a second wireless communications interface configured to broadcast the control signal to the first wireless communications interface of each of the plurality of color-changing products to synchronize the color-change of the plurality of color-changing products.

Yet another embodiment relates to a color-changing product. The color-changing product include a fabric, a power source, and a controller. At least a portion of the fabric includes or is arranged using at least one of (i) a color-changing fiber or (ii) a color-changing yarn including the color-changing fiber. The power source is configured to provide electrical current to the color-changing fiber to cause a color-change to the portion of the fabric. The controller is configured to selectively activate the power source in response to at least one of: (i) receiving an activation signal from a sensor, (ii) receiving a first wireless signal including an indication regarding a notification generated at or data available at a user device, or (iii) receiving a second wireless signal from a remote device. The sensor includes at least one of a hazard sensor, a light sensor, a health sensor, an audio sensor, or an activity sensor. The second wireless signal synchronizes a color-changing operation of the color-changing product with other color-changing products proximate the color-changing product.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
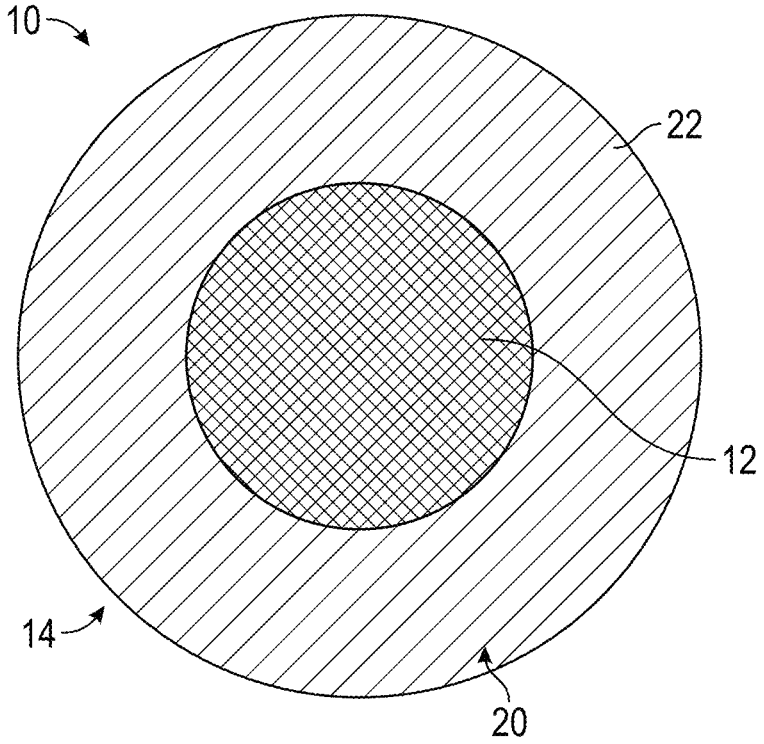
FIG. 1 is a cross-sectional view of a color-changing monofilament, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

The present disclosure is generally directed to the field of fabric technology and, more particularly, is directed to fibers, yarns, and fabrics having an on-demand (e.g., active, dynamic, selectively controllable, etc.) color-changing capability. According to an exemplary embodiment, a color-changing monofilament (e.g., a filament, a strand, a fiber, etc.), which is optionally formed (e.g., combined, twisted, braided, etc.) into a multifilament (e.g., yarn, thread, etc.), is configured to be either (i) incorporated into (e.g., stitched into, sewn into, embroidered into, integrated into, coupled to via a patch, etc.) an existing product or (ii) arranged (e.g., knit, woven, etc.) to form a new product. The color-changing monofilament includes at least one conductive core (e.g., an electrically conductive core, a thermally conductive core, a multi-core, etc.) and a color-changing coating disposed around and along the at least one conductive core. The color-changing coating includes one or more layers (e.g., one, two, three, four, etc.). Each of the one or more layers has one or more different color-changing portions or segments having a respective thermochromic pigment. An electrical current provided to the conductive core, and thereby the temperature of the conductive core, is selectively controllable to actively and dynamically adjust the color of the color-changing coating.

Current fabric products having appearance and color-changing capabilities are passively controlled in response to environmental stimuli (e.g., sunlight, body heat, etc.). By way of example, photochromic dyes may be used in prints on clothing that change color in sunlight. By way of another example, thermochromic dyes may be used to passively change the color of a fabric through body heat and/or ambient heat. Advantageously, the color-changing monofilament of the present disclosure facilitates dynamically changing one or more visual characteristics of a fabric or product on-demand.

According to various exemplary embodiments, the color-changing monofilament is capable of being incorporated into or arranged to form (i) apparel such as headbands, wristbands, ties, bowties, shirts, jerseys, gloves, scarves, jackets, pants, shorts, dresses, skirts, blouses, footwear/shoes, belts, hats, etc.; (ii) accessories such as purses, backpacks, luggage, wallets, jewelry, hair accessories, etc.; (iii) home goods, décor, and fixed installations such as curtains, window blinds, furniture and furniture accessories, table cloths, blankets, bed sheets, pillow cases, rugs, carpet, wallpaper, art/paintings, automotive interiors, etc.; (iv) outdoor applications and equipment such as tents, awnings, umbrellas, canopies, signage, etc.; and/or (v) still other suitable applications. Further applications may include camouflage (e.g., military camouflage, hunting camouflage, etc.), which may be dynamically (e.g., selectively, adaptively, etc.) changed to suit daytime, nighttime, season, desert locations, snow locations, forest locations, urban locations, and/or other environmental conditions.

Color-Changing Fiber

According to the various exemplary embodiments shown in FIGS. 1-7, a color-changing monofilament (e.g., a filament, a fiber, a strand, etc.), shown as color-changing fiber 10, includes a first core or conductive element, shown as conductive core 12, and a color-changing coating (e.g., sheath, cover, casing, etc.), shown as coating 14, disposed around and along the conductive core 12 such that the conductive core 12 is embedded within the coating 14. According to an exemplary embodiment, the conductive core 12 is manufactured from an electrically conductive material. In one embodiment, the conductive core 12 is manufactured from a metal or metal alloy. By way of example, the conductive core 12 may be manufactured from copper, nickel, aluminum, zinc, silver, gold, titanium, tungsten, molybdenum, chromium, platinum, palladium, nichrome, combinations thereof, and/or another suitable metal or metal alloy. In other embodiments, the conductive core 12 is manufactured from a non-metallic, electrically conductive material. By way of example, the conductive core 12 may be manufactured from a heavily doped semiconductor, a polymer doped with a conductive phase (e.g., an electrically conductive (conjugated) polymer, etc.), and/or carbon phases (e.g., graphite, graphene, carbon nanofibers, carbon nanowires, etc.). In some embodiments, the conductive core 12 includes electrically conductive contacts manufactured from a metallic material that is different than the material of the conductive core 12. In such embodiments, the conductive core 12 itself may or may not be conductive (e.g., a plastic core, any flexible core capable of being woven, etc.). According to an exemplary embodiment, the color-changing fibers 10 are flexible to permit weaving, knitting, and embroidery, and are durable as textile fibers such that the resultant end product is launderable (i.e., capable of being washed or laundered).

According to the various exemplary embodiments shown in FIGS. 65-69, the color-changing fiber 10 includes a second core or reinforcing element, shown as reinforcement core 16, embedded within the coating 14 with the conductive core 12. In some embodiments, the reinforcement core 16 is a monofilament or fiber. In some embodiments, the reinforcement core 16 is a yarn. According to an exemplary embodiment, the reinforcement core 16 is manufactured from a low denier, high tensile strength material having a greater tensile strength than the conductive core 12. By way of example, the reinforcement core 16 may increase the tensile strength of the color-changing fiber 10 by 50-500%. By way of example, the tensile strength of the color-changing fiber 10 may be able to withstand between a five pound tensile load and a thirty pound tensile load (e.g., depending on the type and/or number of the reinforcement cores 16 of the color-changing fiber 10). In one embodiment, the reinforcement core 16 has a tensile strength that can withstand up to a five pound tensile load. In another embodiment, the reinforcement core 16 has a tensile strength that can withstand up to a ten pound tensile load. In still another embodiment, the reinforcement core 16 has a tensile strength that can withstand up to a twenty pound tensile load. In other embodiments, the reinforcement core 16 has a tensile strength that can withstand up to a different tensile load (e.g., fifteen pounds, twenty-five pounds, thirty pounds, etc.). In some embodiments, the reinforcement core 16 is manufactured from a liquid crystal polymer fiber (e.g., a Kevlar-like liquid crystal aromatic polyester, etc.). By way of example, the liquid crystal polymer fiber may be or include Vectran. In some embodiments, the reinforcement core 16 is manufactured from an aramid fiber. By way of example, the aramid fiber may be or include Kevlar. In some embodiments, the reinforcement core 16 is manufactured from another material such as a low denier, high tensile strength nylon or polyester fiber/yarn, or fluorocarbon. According to an exemplary embodiment, the color-changing fibers 10 including the reinforcement core 16 are still flexible to permit weaving, knitting, and embroidery to provide a textile with increased durability.

Figure 65:
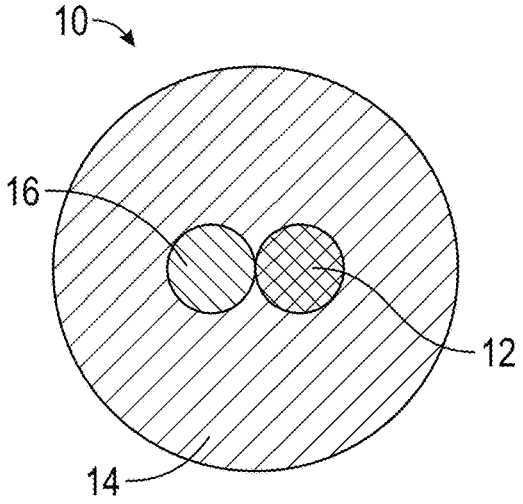
FIGS. 65-69 are various cross-sectional views of a core of a color-changing monofilament including a reinforcement fiber, according to various exemplary embodiment.
Figure 66:
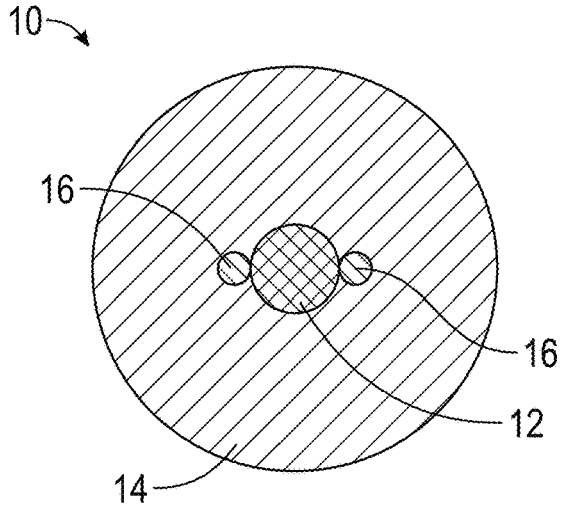
Figure 67:
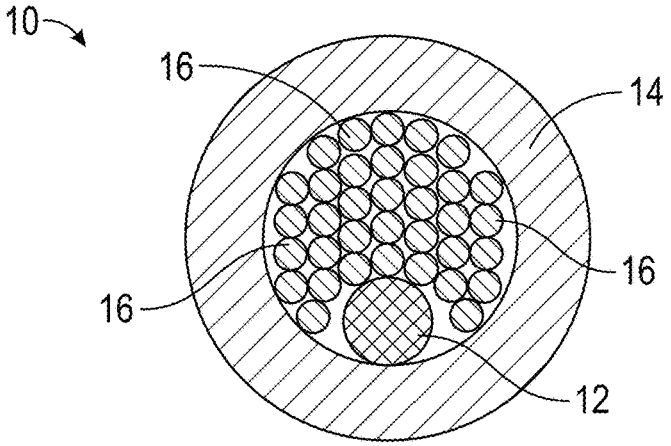
Figure 68:
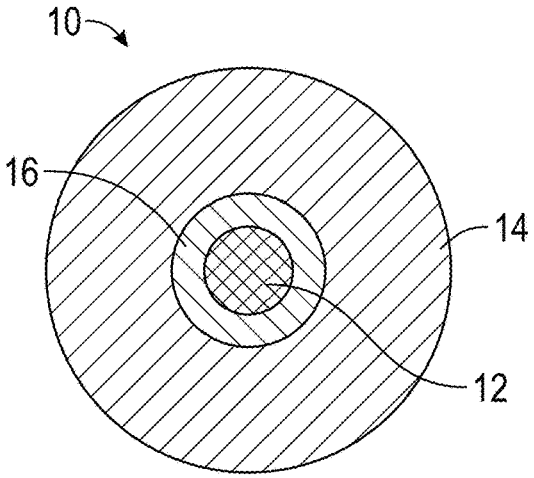
Figure 69:
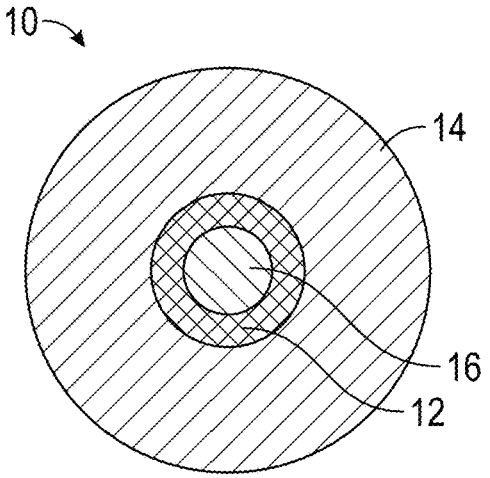

As shown in FIG. 65, the color-changing fiber 10 includes a single reinforcement core 16 disposed within the coating 14 and extending along the conductive core 12. In some embodiments, the reinforcement core 16 extends parallel and alongside the conductive core 12. In some embodiments, the reinforcement core 16 is spiraled around the conductive core 12. As shown in FIG. 66, the color-changing fiber 10 includes a plurality of the reinforcement cores 16 disposed within the coating 14, extending along the conductive core 12, and positioned variously around the periphery of the conductive core 12. While two reinforcement cores 16 are shown, more than two reinforcement cores 16 may be disposed within the coating 14 (e.g., three, four, five, etc.). In some embodiments, the multiple reinforcement cores 16 are used to provide a desired tensile strength of the color-changing fiber 10. Each reinforcement core 16 may have the same tensile strength (e.g., multiple fibers each having a five pound tensile strength, multiple fibers each having a ten pound tensile strength, etc.). Alternatively, the reinforcement cores 16 may have varying tensile strengths (e.g., one fiber with a five pound tensile strength and one fiber with a fifteen pound tensile strength, etc.). As shown in FIG. 67, the color-changing fiber 10 includes a plurality of the reinforcement cores 16 disposed within the coating 14, extending along the conductive core 12, and positioned along a portion of the periphery of the conductive core 12 in a multiple layer or staked arrangement. In some embodiments, a sufficient number of individual reinforcement cores 16 are included and arranged such that they form a reinforcement ring around the conductive core 12. As shown in FIG. 68, the reinforcement core 16 is a tubular element disposed within the coating 14 and the conductive core 12 is disposed within the reinforcement core 16. As shown in FIG. 69, the conductive core 12 is a tubular element disposed within the coating 14 and the reinforcement core 16 is disposed within the conductive core 12.

According to an exemplary embodiment, the color-changing fiber 10 has dimensions (e.g., diameter, etc.) suitable for weaving in an industrial loom. By way of example, the transverse dimensions (e.g., diameter, width, etc.) of the color-changing fiber 10 and/or a multifilament fiber (e.g., thread, yarn, etc.) formed therefrom may generally be less than 1 millimeter. In some embodiments, the transverse dimensions are less than 700 micrometers. In some embodiments, the transverse dimensions are less than 40 micrometers. In some embodiments, the transverse dimensions are in a range from 15 micrometers to 30 micrometers. The diameter of the conductive core 12 may range between 1 micrometer and 500 micrometers. The diameter of the reinforcement core(s) 16 may range from 1 micrometer and 500 micrometers (e.g., 200-300 micrometers, 50 micrometers, 100 micrometers, less than 300 micrometers, less than 200 micrometers, 260-350 micrometer, etc.). The diameter of reinforcement core(s) 16 may be less than, greater than, or substantially the same as the conductive core 12 (e.g., dependent upon the desired tensile strength and overall diameter of the color-changing fiber 10, 100-150 micrometer, etc.). The internal cross-sectional structure of the color-changing fiber 10 may have many variations from, for example, a single conductive core with a cladding coating, a multi-conductive-core within a cladding coating, a single conductive core with concentric ring coating layers, a single conductive core with a multi-segment coating in the azimuthal direction, combinations thereof, all of the above with one or more reinforcement cores, etc. Further, while the color-changing fiber 10 is shown in FIGS. 1-7 and 65-69 to have a circular cross-sectional shape, in other embodiments, the color-changing fiber 10 has a different cross-sectional shape (e.g., square, triangular, rectangular, etc.). In such embodiments, the conductive core 12 and/or the reinforcement core 16 may have a circular cross-sectional shape or may have another shape that corresponds with the cross-sectional shape of the coating 14.

According to an exemplary embodiment, the coating 14 includes one or more layers of polymeric material (e.g., a polymer, a polymer composite, a polymer with polycrystalline material, Hytrel, cyclic olefin copolymer, polypropylene, nylon, polyester, etc.). At least one of the one or more layers of polymeric material includes a reversible thermochromic pigment combined (e.g., mixed, compounded, impregnated, etc.) therewith such that the respective layer changes color in response to a temperature change thereof (e.g., the thermochromic pigment transitions from a first color to a second color when heated and transitions from the second color to the first color when cooled, etc.) and/or (ii) in response to an electrical current being provided to the conductive core 12. Generally, any suitable reversible thermochromic pigment composition may be used. For example, the thermochromic pigment may include a liquid crystal material and/or a leucodye. In one embodiment, the coating 14 includes a single layer of polymeric material. In another embodiment, the coating 14 includes a plurality of concentric layers of polymeric material. In some embodiments, each of the plurality of concentric layers of polymeric material includes a respective thermochromic pigment. In some embodiments, at least one of the plurality of layers of polymeric material does not include a thermochromic pigment, but rather the pigment of the at least one polymeric material is substantially fixed and does not change (due to temperature or electrical current). The material of the coating 14 may 14 may be appropriately chosen for its properties based on the specific application for the color-changing fiber 10.

In operation, an electrical current (e.g., provided by a power source such as a battery, a solar panel, a photovoltaic fiber, etc. for portable applications; provided by a power source such as battery, a solar panel, a photovoltaic fiber, a mains power supply, a standard wall socket, etc. for fixed installations; etc.) is passed through the conductive core 12. The resistance of the conductive core 12 to the electrical current causes the temperature of the conductive core 12 to elevate and thereby heat and activate the thermochromic pigment of the coating 14 to transition the color thereof from a first color to a second color (e.g., from a darker color to a lighter color, from one opaque color to a different opaque color, from opaque to transparent, or the like when a temperature transition threshold is reached). The color-changing fiber 10 may operate at low voltages (e.g., 12 volts or less, etc.). By way of example, the conductive core 12 may be selected so that the current drawn from the power source is about 1 ampere, which then for a 5 volt DC power means the conductive core 12 should have a resistance of about 5 ohms. In some embodiments, the conductive core 12 has a higher resistance (e.g., based on the material of the conductive core 12, based on the arrangement of the conductive cores 12 in a parallel or parallel-series configuration, etc.) such that higher current/voltage power sources may be used. In some embodiments, the color-changing fiber 10 transitions from the first color to the second color in 10s or 100s of milliseconds (e.g., depending on the amount of power applied, etc.). In some embodiments, the transition may be extended to seconds or even minutes to reduce energy consumption.

The color-changing fiber 10 may remain continuously biased at the second color and thus retain the second color until the user decides to remove the applied power to enable transitioning the color of the coating 14 back to the first color. In some embodiments, removing the electrical current results in the coating 14 transitioning from the second color back to the first color. The coating 14 may remain at the second color for several seconds or minutes following the removal of the electrical current. The transition time from the second color back to the first color may depend on the environmental temperature (e.g., body temperature of the person, temperature of the ambient environment, etc.) and the temperature at which the thermochromic pigment activates/deactivates (e.g., the temperature transition threshold, etc.).

In some embodiments, removing the electrical current does not result in the coating 14 transitioning from the second color back to the first color. By way of example, the temperature at which the thermochromic pigment returns to the first color may be below the environmental temperature. In such a case, removing the electrical current does not result in the color transitioning from the second color back to the first color. Rather, in such embodiments, the color of the coating 14 may remain fixed until extra cooling is applied to the color-changing fiber 10 to change the color back to the first color. By way of another example, the coating 14 may include a respective thermochromic pigment that exhibits thermal hysteresis in its photo-thermal behavior. For example, once the respective thermochromic pigment reaches its temperature transition threshold, the color thereof transitions. However, the coating 14 may 14 may retain the new color even when the temperature drops below the temperature transition threshold. In such a case, the respective thermochromic pigment may need to be brought to a temperature lower than the temperature transition threshold to return to its original color (e.g., 5, 10, 15, etc. degrees lower than the temperature transition threshold, etc.). Such an asymmetric transition capability may advantageously assist in reducing the electrical power needed for maintaining the second color of the coating 14 following the transition from the original, first color of the coating 14 to the second color.

According to an exemplary embodiment, impregnating or otherwise mixing the material of the coating 14 with one or more thermochromic pigments facilitates controlling the optical properties of the resultant fabric or other end product that the color-changing fiber 10 is incorporated into. By way of example, changing the pigment concentration may yield a variety of dynamically controllable optical effects, such as transitioning from one solid color to another, transitioning from a solid color to a semi-transparent sheer effect, transitioning from a solid color to transparent or substantially transparent, etc. By way of another example, the selection of the type and concentration of the pigments within the material of the coating 14 may be specifically tailored to suit each individual application in order to provide a desired original color and transition color, optimize the transition temperature, provide a desired transition time, and/or minimize power consumption required to perform and/or maintain the transition.

In some embodiments, the color-changing fiber 10 includes phosphor (e.g., within the coating 14, disposed between the conductive core 12 and/or the reinforcement core 16 and the coating 14, in an independent coating layer, etc.). The phosphor may facilitate providing a color-changing fiber 10 with a selectively controllable "glow-in-the-dark" effect. By way of example, if the coating 14 transitions to a transparent state from an opaque state, with the phosphor disposed underneath the coating, the phosphor may glow through the coating 14 when in the transparent state to provide a luminescent fiber. By way of another example, if the coating 14 includes phosphor, the phosphor may "glow" as an electrical current is provided to the color-changing fiber 10.

As shown in FIG. 1, the coating 14 of the color-changing fiber 10 includes a first layer (e.g., a single layer, etc.), shown as layer 20, disposed around and along the conductive core 12. The layer 20 includes a first material, shown as material 22. The material 22 may include a respective polymer or polymer composite that includes a respective thermochromic pigment. The material 22 may transition from a first color (e.g., a relatively darker color, purple, green, etc.) to a second color (e.g., a relatively lighter color, red, yellow, etc.) at a first temperature transition threshold. The first temperature transition threshold may be dependent on (i) the respective polymer or polymer composite, (ii) the respective thermochromic pigment, and/or (iii) the concentration of the respective thermochromic pigment. The first temperature transition threshold may be designed to be at a temperature between about 0 degrees Celsius and about 70 degrees Celsius. The temperature transition threshold may be selected based on the intended application of the end product including the color-changing fibers 10. By way of example, the temperature transition threshold may be about 0 degrees Celsius (e.g., between-15 and 15 degrees Celsius, at 0 degrees Celsius, at −5 degrees Celsius, at 5 degrees Celsius, below 5 degrees Celsius, below 10 degrees Celsius, etc.) for a garment intended for an outdoor winter application. By way another of example, the temperature transition threshold may be about 27 degrees Celsius (e.g., between 15 and 30 degrees Celsius, etc.) for a garment intended for an indoor application. By way of yet another example, the temperature transition threshold may be about 38 degrees Celsius (e.g., between 30 and 45 degrees Celsius, etc.) for a garment intended for an outdoor summer application. By way of still another example, the temperature transition threshold may be about 49 degrees Celsius (e.g., between 45 and 50 degrees Celsius, etc.) for a garment intended for a desert environment application (e.g., military use, etc.). In some embodiments, the transition from the first color to the second color includes a spectrum of colors between the first color and the second color. By way of example, the first color may be purple, the second color may be white, and an intermediate color or colors may be blue and/or red. In some embodiments, the second color is colorless or transparent such that the color of the conductive core 12 is exposed and visible.

Figure 2:
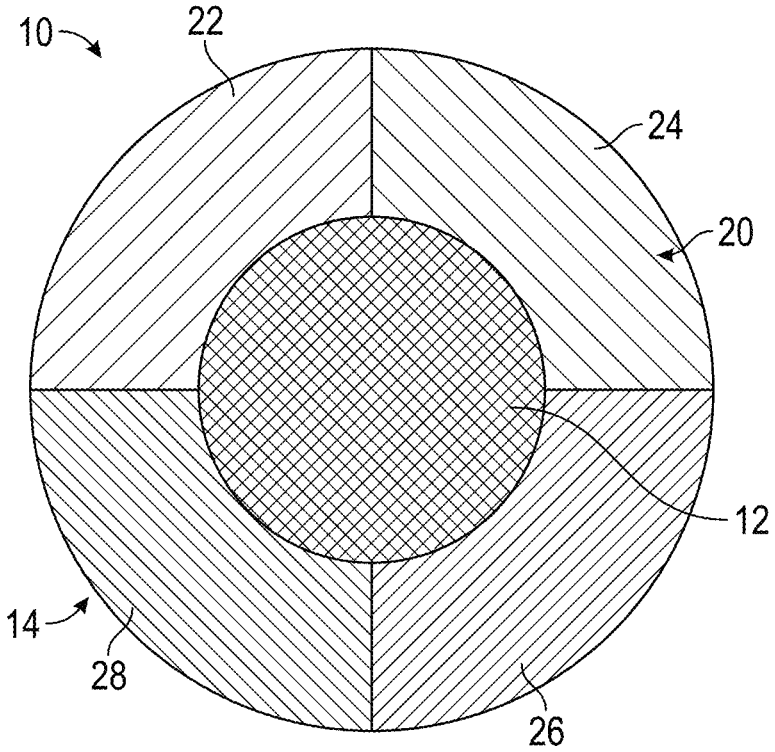
FIG. 2 is a cross-sectional view of a color-changing monofilament, according to another exemplary embodiment.

FIG. 2 illustrates a color-changing fiber according to another exemplary embodiment, in which a coating thereof is divided into different segments (for ease of reference, similar components in the various exemplary embodiments discussed herein bear the same reference numerals). As shown in FIG. 2, the coating 14 of the color-changing fiber 10 includes a layer 20 disposed around and along the conductive core 12 that has four azimuthal segments in which a first segment includes the material 22, a second segment includes a second material (shown as material 24), a third segment includes a third material (shown as material 26), and a fourth segment includes a fourth material (shown as material 28). In other embodiments, the layer 20 includes fewer or greater than four azimuthal segments (e.g., two, three, five, six, etc. segments). In some embodiments, the azimuthal segments are equally sized. In other embodiments, the azimuthal segments may be differently sized. Each of the material 22, the material 24, the material 26, and/or the material 28 may include a polymer or polymer composite that includes a thermochromic pigment. The composition of the various segments may differ depending on the desired effect. In some embodiments, the polymer or polymer composite of the material 22, the material 24, the material 26, and/or the material 28 are the same, and the thermochromic pigments thereof and/or the concentrations of the thermochromic pigments may differ between the different segments (according to other embodiments, the polymer or polymer composite used for one or more of the various segments may also vary). Each of the material 22, the material 24, the material 26, and/or the material 28 may transition from a first color to a second color at a first temperature transition threshold, a second temperature transition threshold, a third temperature transition threshold, and a fourth temperature transition threshold, respectively. The first color of the material 22, the material 24, the material 26, and/or the material 28 may be different or the same. The second color of the material 22, the material 24, the material 26, and the material 28 may be different or the same. The first temperature transition threshold, the second temperature transition threshold, the third temperature transition threshold, and/or the fourth temperature transition threshold may be the same, similar, or different (e.g., dependent on the respective polymer or polymer composite and/or the respective thermochromic pigment and concentration thereof, etc.).

The color of the coating 14 may be seen differently based on the angle at which the azimuthal segments of the coating 14 are being viewed. In some embodiments, the azimuthal segments of the coating 14 facilitate providing the appearance of a shimmering or iridescent material. By way of example, if the coating 14 has multiple azimuthal segments, then the angle at which the color-changing fibers 10 are viewed may change how the colors appear, leading to a shimmering effect. Also, if one or more of the azimuthal segment of the coating 14 include a pigment that transitions to a transparent state, then the conductive core 12 may show through, leading to a shimmering or iridescent effect depending on the angle at which the color-changing fibers 10 are viewed.

Figure 3:
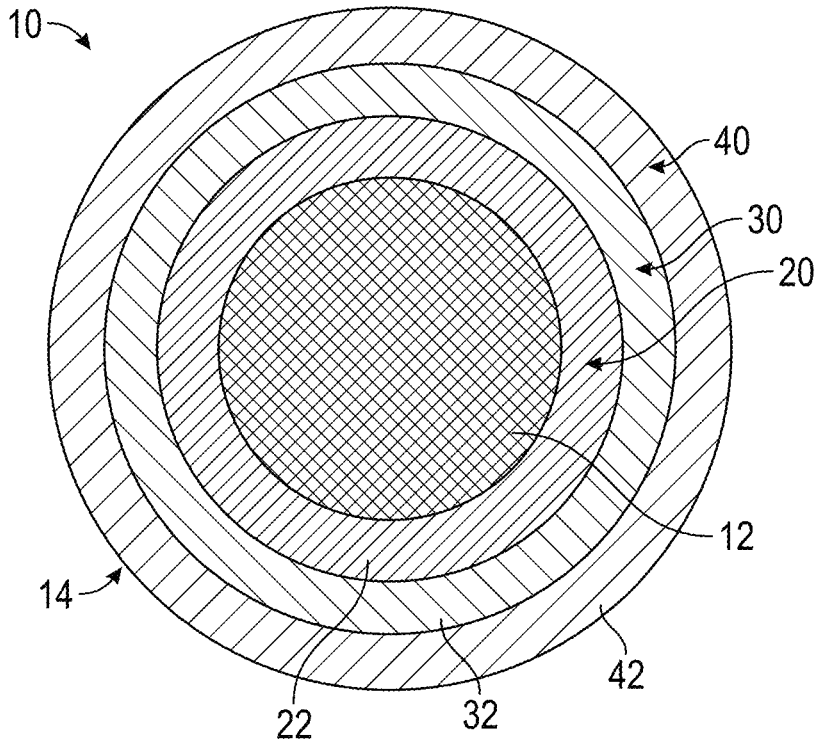
FIG. 3 is a cross-sectional view of a color-changing monofilament, according to another exemplary embodiment.

FIG. 3 illustrates another embodiment of a color-changing fiber. As shown in FIG. 3, the coating 14 of the color-changing fiber 10 has a plurality of concentric layers including the layer 20 disposed around and along the conductive core 12, a second layer, shown as layer 30, disposed around and along the layer 20, and a third layer, shows as layer 40, disposed around and along the layer 30. In other embodiments, the coating 14 includes fewer or greater than three layers (e.g., two, four, etc. layers). The thickness of the layer 20, the layer 30, and/or the layer 40 may be the same or different.

As shown in FIG. 3, the layer 20 includes the material 22, the layer 30 includes a second material, shown as material 32, and the layer 40 includes a third material, shown as material 42. Each of the material 22, the material 32, and/or the material 42 may include a respective polymer or polymer composite that includes a respective thermochromic pigment. In some embodiments, the polymer or polymer composite of the material 22, the material 32, and/or the material 42 are the same, but the thermochromic pigments thereof and/or the concentrations of the thermochromic pigments differ. Each of the material 22, the material 32, and/or the material 42 may transition from a first color to a second color at a first temperature transition threshold, a second temperature transition threshold, and a third temperature transition threshold, respectively. In some embodiments, the material 22 of the layer 20 does not include a thermochromic pigment such that the color thereof is substantially fixed. In such an embodiment, the material 32 of the layer 30 and the material 42 of the layer 40 may transition from an opaque color to transparent to expose the fixed color of the layer 20. According to an exemplary embodiment, the first temperature transition threshold is greater than the second temperature transition threshold and/or the second temperature transition threshold is greater than the third temperature transition threshold. Accordingly, (i) the material 42 of the layer 40 may transition from a first color to transparent at the third temperature transition threshold to expose a second color of the material 32 of the layer 30 underneath, (ii) the material 32 of the layer 30 may transition from the second color to transparent at the second temperature transition threshold to expose a third color of the material 22 of the layer 20 underneath, and (iii) either (a) the material 22 of the layer 20 may transition from the third color to transparent at the first temperature transition threshold to expose the conductive core 12, (b) the material 22 of the layer 20 may transition from the third color to a fourth color (e.g., a non-transparent color, etc.) at the first temperature transition threshold, or (c) the color of the material 22 is substantially fixed.

Figure 4:
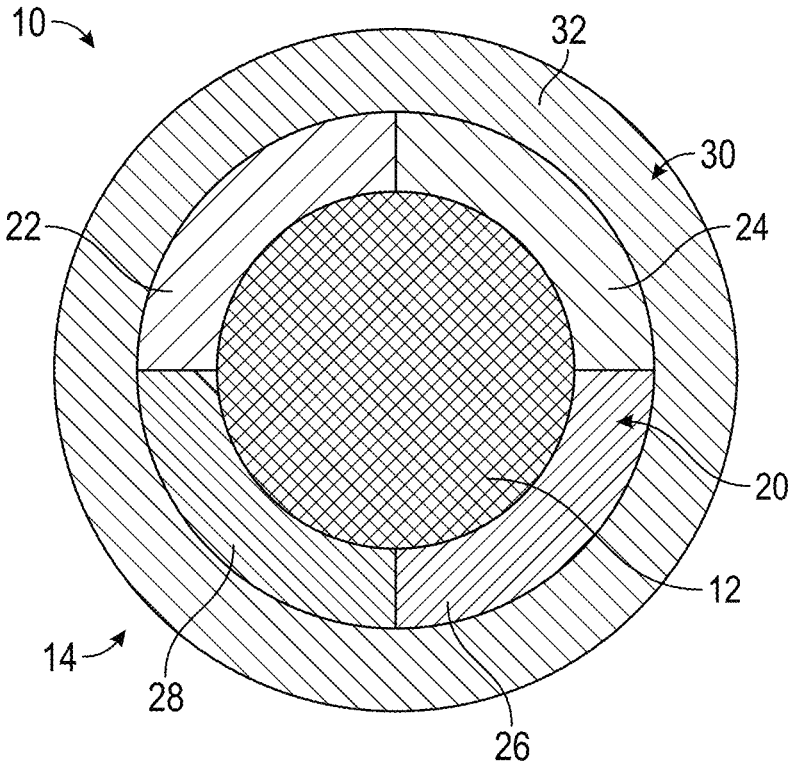
FIG. 4 is a cross-sectional view of a color-changing monofilament, according to another exemplary embodiment.

FIG. 4 illustrates another embodiment of a color-changing fiber. As shown in FIG. 4, the coating 14 of the color-changing fiber 10 is a combination of the embodiments shown in FIGS. 2 and 3. Specifically, the coating 14 includes the layer 20 disposed around and along the conductive core 12 and the layer 30 disposed around and along the layer 20 where the layer 20 has four azimuthal segments that include the material 22, the material 24, the material 26, and the material 28. The layer 20 of FIG. 4 may be similar or function similarly to that of the layer 20 of FIG. 2 and the layer 30 of FIG. 4 may be similar or function similarly to that of the layer 30 of FIG. 3.

Figure 5:
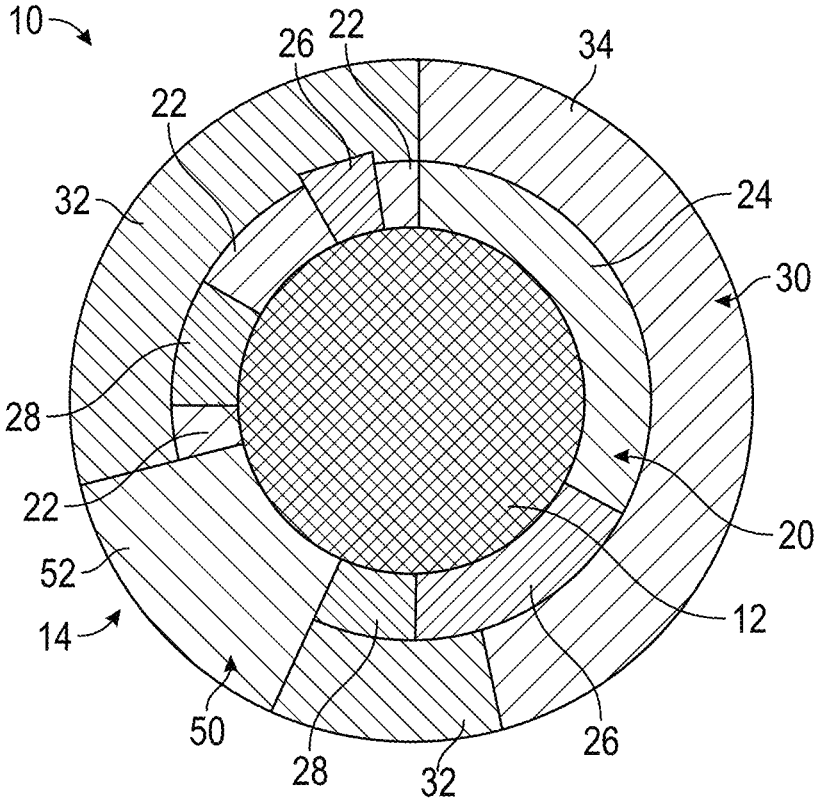
FIG. 5 is a cross-sectional view of a color-changing monofilament, according to another exemplary embodiment.

FIG. 5 illustrates another embodiment of a color-changing fiber. As shown in FIG. 5, the coating 14 of the color-changing fiber 10 includes the layer 20 disposed around and along the conductive core 12 and the layer 30 disposed around and along the layer 20. Both the layer 20 and the layer 30 include a plurality of azimuthal segments of different materials (e.g., a similar polymeric material with different thermochromic pigments, etc.) including (i) the material 22, the material 24, the material 26, and the material 28 variously positioned about the layer 20 and (ii) the material 32 and a material 34 variously positioned about the layer 30. Other combinations of materials or number of azimuthal segments may be used within the layer 20 and/or the layer 30 (e.g., a single material, more materials, fewer azimuthal segments, more azimuthal segments, etc.). As shown in FIG. 5, the layer 20 and the layer 30 only partially extend around the conductive core 12 (e.g., 45, 90, 115, 145, 180, 215, 245, 270, 300, 315, 330, etc. degrees), leaving a gap. The gap is filled with a thicker layer, shown as layer 50, that extends the thickness of the layer 20 and the layer 30.

In some embodiments, the color-changing fiber 10 includes three or more concentric layers such that the layer 50 may extend the thickness of the three or more concentric layers.

Figure 6:
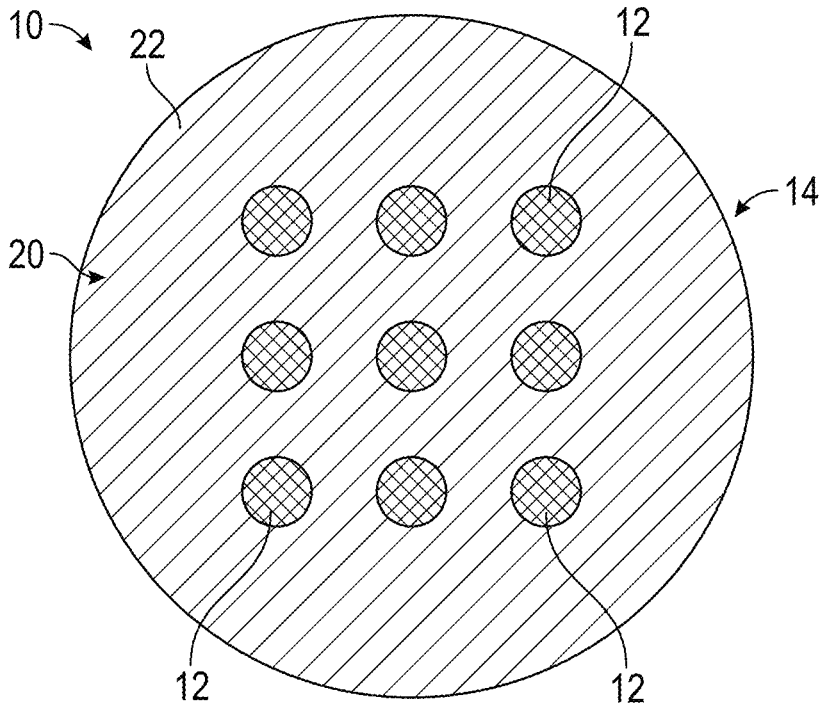
FIG. 6 is a cross-sectional view of a color-changing monofilament, according to another exemplary embodiment.
Figure 7:
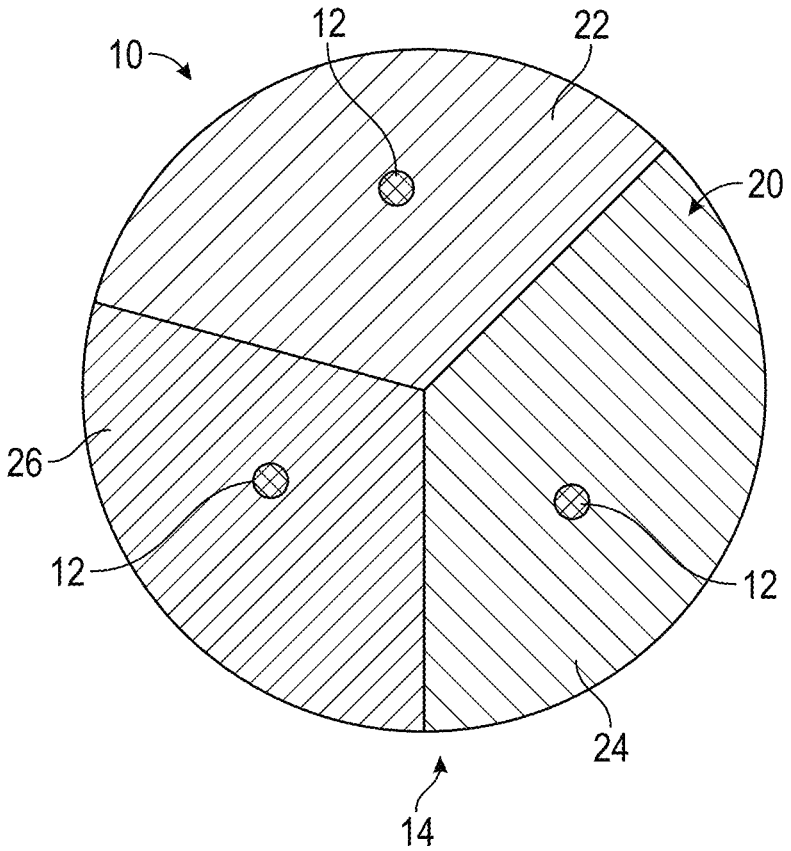
FIG. 7 is a cross-sectional view of a color-changing monofilament, according to another exemplary embodiment.

FIGS. 6 and 7 illustrate additional exemplary embodiments of color-changing fibers. As shown in FIGS. 6 and 7, the color-changing fiber 10 includes a plurality of conductive cores 12 (e.g., a multi-core, etc.). As shown in FIG. 6, the color-changing fiber 10 includes nine separate conductive cores 12 disposed within the material 22 of the layer 20 (i.e., the material 22 is disposed around, along, and between the conductive cores 12). In other embodiments, the color-changing fiber 10 includes a different number of the conductive cores 12 (e.g., two, three, four, five, six, seven, eight, ten, etc. of the conductive cores 12). As shown in FIG. 7, the color-changing fiber 10 includes three separate conductive cores 12, where each of the conductive cores 12 is disposed within a different material, i.e., the material 22, the material 24, and the material 26, respectively, of the layer 20. The material 22, the material 24, and the material 26 are arranged to form the layer 20 of the color-changing fiber 10 that has a multi-segmented pie structure with a respective conductive core 12 within each of the segments of the multi-segmented pie structure. In some embodiments, the polymer or polymer composite of the material 22, the material 24, and/or the material 26 are the same, but the thermochromic pigments thereof and/or the concentrations of the thermochromic pigments differ. In other embodiments, the color-changing fiber 10 includes a different number of conductive cores 12 (e.g., two, four, five, etc.) and the layer 20 includes a corresponding number of materials such that each of the conductive cores 12 is embedded within a respective material of the layer 20. Each of the conductive cores 12 may therefore be individually provided an electrical current to affect the visual characteristics of the material associated therewith. In some embodiments, the color-changing fiber 10 of FIGS. 6 and 7 includes additional layers (e.g., the layer 30, the layer 40, etc.) disposed around the layer 20.

Figure 8:
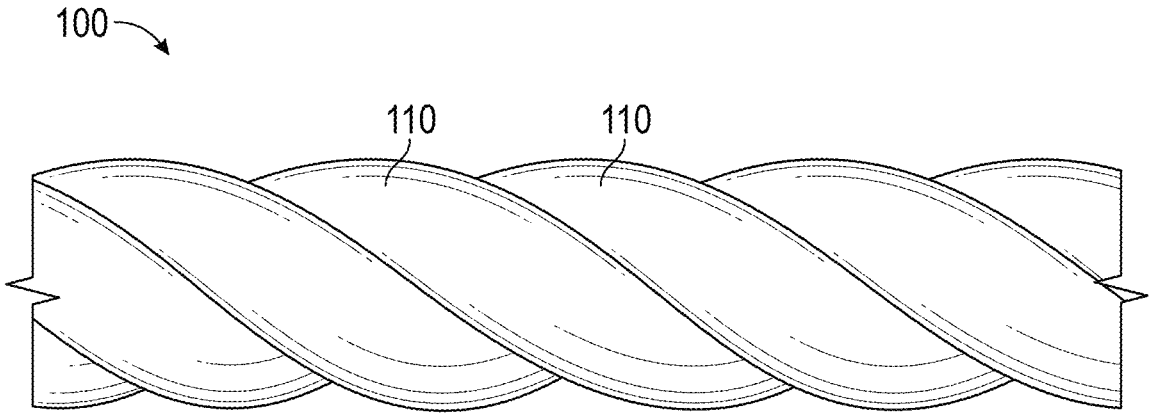
FIG. 8 is a side view of a color-changing multifilament at least partially formed from one or more of the color-changing monofilaments of FIGS. 1-7, according to an exemplary embodiment.

In some embodiments, the color-changing fiber 10 is used to form fabric (e.g., in weaving or knitting processes, etc.) as a monofilament and/or is incorporated into an existing product or fabric (e.g., sewn into an existing fabric, embroidery, etc.) as a monofilament. In some embodiments, as shown in FIG. 8, the color-changing fiber 10 is formed into or incorporated into a multifilament fiber (e.g., yarn, thread, etc.), shown as color-changing yarn 100. The color-changing yarn 100 may be formed by twisting, braiding, or otherwise joining two or more fibers, shown as fibers 110. In some embodiments, the fibers 110 of the color-changing yarn 100 include one type of the color-changing fibers 10 of FIGS. 1-7 and 65-69. In other embodiments, the fibers 110 of the color-changing yarn 100 include a combination of two or more of the types of the color-changing fibers 10 of FIGS. 1-7 and 65-69. In still other embodiments, the fibers 110 of the color-changing yarn 100 include at least one of the color-changing fibers 10 of FIGS. 1-7 and 65-69, and at least one non-color-changing fiber. The non-color-changing fiber may be a (i) natural fiber including plant-based fiber (e.g., linen, etc.) and/or an animal-based fiber (e.g., wool, silk, etc.) and/or (ii) a synthetic fiber (e.g., rayon, acetate, nylon, acrylic, polyester, etc.).

In some embodiments, the non-color-changing fiber is a photovoltaic fiber. The photovoltaic fibers may be used to generate electrical energy from light energy to (i) charge or power a power source and/or (ii) directly provide an electrical current to the color-changing fibers 10 within the color-changing yarn 100 to facilitate the transition between the possible colors thereof. In some embodiments, the color-changing fiber 10 and/or the color-changing yarn 100 includes a glass core or another type of transparent core. In some embodiments, the color-changing fiber 10 includes sensors, the non-color-changing fiber includes sensors, and/or sensors are otherwise embedded within the color-changing yarn 100 (e.g., sensors to measure temperature, force, pressure, acceleration, moisture, etc.). By way of example, the sensors may be or include piezoelectric sensors that sense a depressive force or pressure (e.g., on the fabric that the color-changing yarn 100 is woven into, etc.). The piezoelectric sensors may send an electrical signal to a controller and the controller may take an appropriate action in response to the depression (e.g., provide electrical current to the color-changing fibers 10 to activate the thermochromic pigment to transition the color, etc.).

Manufacture of the Color-Changing Fiber

Figure 9A:
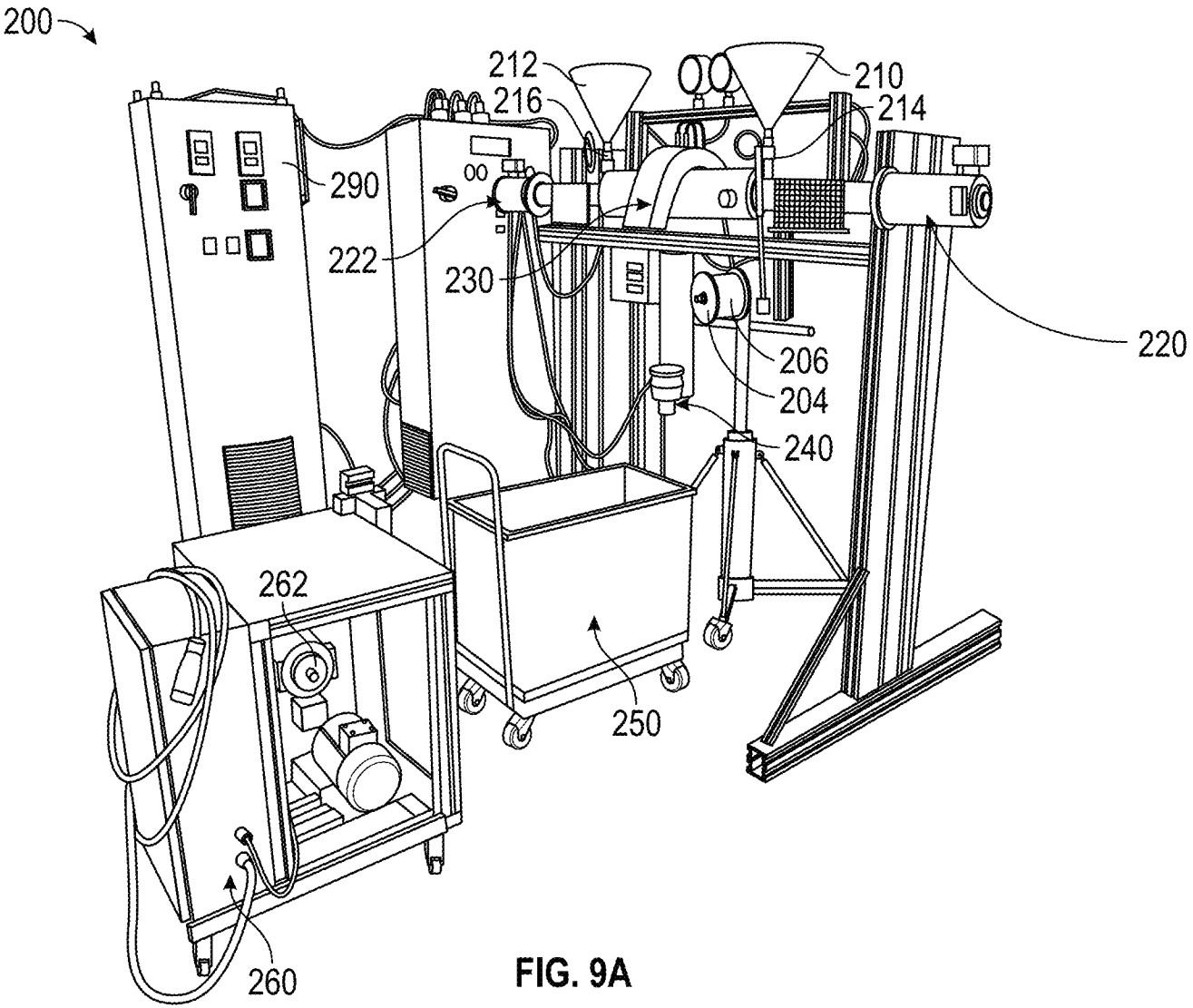
FIG. 9A is a perspective view of a fiber fabrication machine used to produce color-changing monofilaments, according to an exemplary embodiment.

According to the exemplary embodiment shown in FIGS. 9A-16, a machine, shown as fiber fabricator 200, is configured to manufacture the color-changing fiber 10. As shown in FIG. 9A, the fiber fabricator 200 includes a pair of hoppers, shown as first hopper 210 and second hopper 212, coupled to a pair of drivers, shown as first screw extruder 220 and second screw extruder 222, via conduits, shown as first feed tube 214 and second feed tube 216, respectively.

According to an exemplary embodiment, the first hopper 210 is configured to receive a first raw material of the coating 14 and the second hopper 212 is configured to receive a second raw material of the coating 14. By way of example, the first raw material may be a polymeric material such as thermoplastics, thermoplastic elastomers, polycrystalline polymers, and/or any other suitable material that softens sufficiently to traverse a fiber spinning system and then solidify upon cooling. The second raw material may be (i) a concentrate of the thermochromic pigment, (ii) a concentrate of the thermochromic pigment with added fillers or additives, and/or (iii) a concentrate of the thermochromic pigment and/or additives in a polymer host. The concentrate of the thermochromic pigment may come in the form of powder, pellets of any shape, slurry, ink, and/or another liquid. In other embodiments, the first hopper 210 and the second hopper 212 receive the same material (e.g., a thermochromic pigment and polymer mixture; see, e.g., FIGS. 10A-10E; etc.). In still other embodiments, the fiber fabricator 200 includes a different number of hoppers (e.g., three, four, eight, etc.) that each receive different material and/or facilitate increasing the capacity of material able to be loaded into the fiber fabricator 200.

According to the exemplary embodiment shown in FIG. 9A, the first screw extruder 220 is configured to receive the first raw material through the first feed tube 214 and the second screw extruder 222 is configured to receive the second raw material from the second hopper 212 through the second feed tube 216. In other embodiments, the fiber fabricator 200 does not include the second hopper 212, the second feed tube 216, or the second screw extruder 222, but rather the fiber fabricator 200 is configured to receive a premixed mixture or compound of the first raw material and the second raw material. Therefore, (i) the concentrate of the pigment may be pre-mixed uniformly with virgin polymer pellets (e.g., of thermoplastics, thermoplastic elastomers, polycrystalline polymers, etc.) and fed into the first screw extruder 220, (ii) the concentrate of the pigment may be pre-compounded with the virgin polymer pellets and fed into the first screw extruder 220, and/or (iii) the virgin polymer and the concentrate of the pigment may be kept separate and fed into the first screw extruder 220 and the second screw extruder 222 separately to be combined by a spinneret in a prescribed ratio to produce the desired color change for the color-changing fiber 10.

As shown in FIGS. 10A-10E, example raw materials 202 include (a) a concentrate of the thermochromic pigment in the form of a powder, (b) a concentrate of the thermochromic pigment in the form of a powder compounded with a host virgin polymer, (c) a concentrate of the thermochromic pigment in the form of pellets dispersed in a host resin with additives and fillers, (d) the pellets from (c) mixed with virgin polymer pellets, and (e) the pellets from (c) alongside virgin polymer pellets that may be separately introduced into the fiber fabricator 200.

As shown in FIG. 9A, the fiber fabricator 200 includes a pump, shown as melt pump 230, coupled to the first screw extruder 220 and the second screw extruder 222. According to an exemplary embodiment, the first screw extruder 220 and the second screw extruder 222 include heating elements that soften or melt the first raw material and/or the second raw material, respectively, which the first screw extruder 220 and the second screw extruder 222 drive into the melt pump 230. According to an exemplary embodiment, the processing temperature of the first raw material and the second raw material (e.g., the raw materials 202, etc.) within the first screw extruder 220 and the second screw extruder 222 is below a degradation temperature of the thermochromic pigment to avoid the destruction of the thermochromic pigment.

Figure 11:
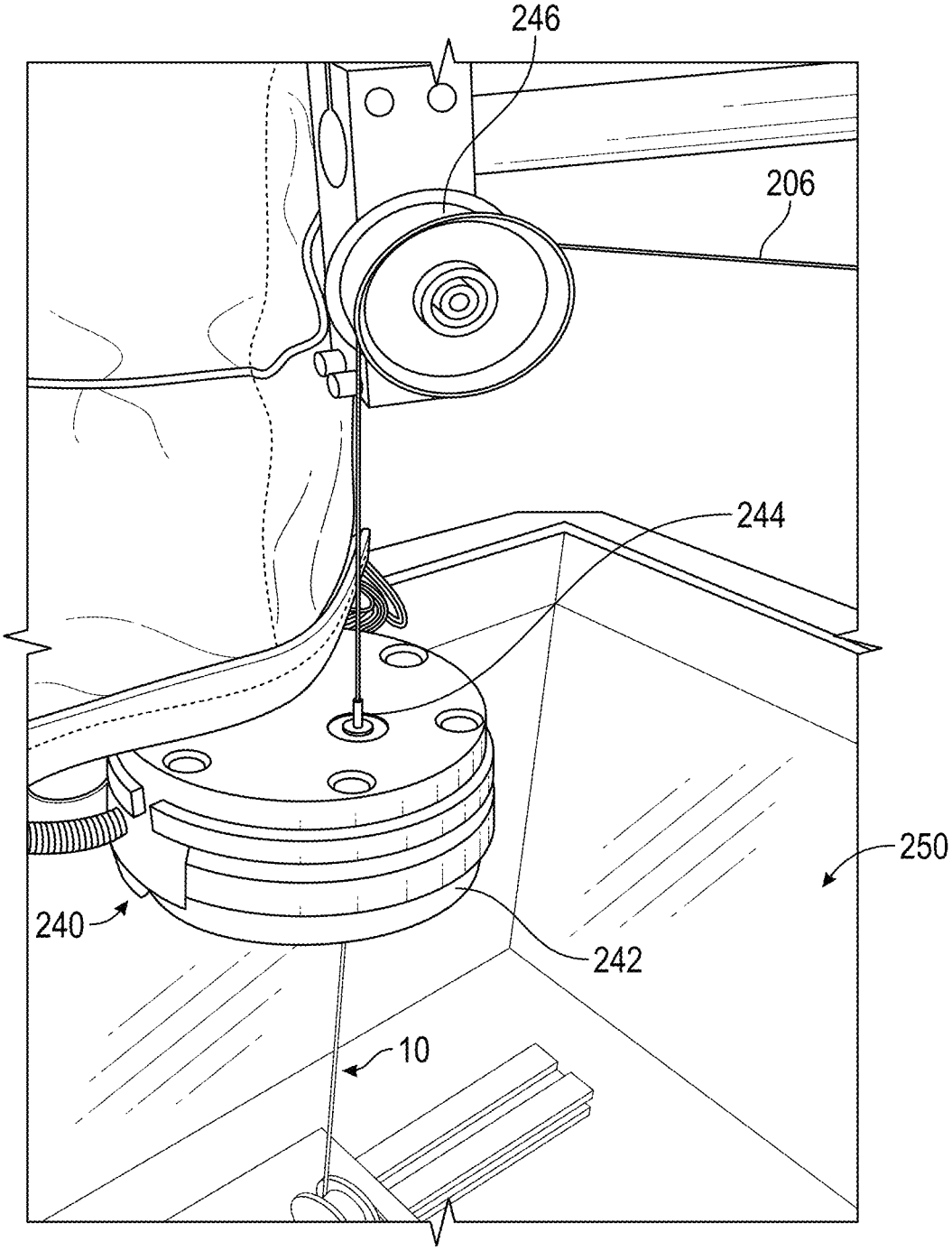
FIG. 11 is a detailed view of a spinneret of the fiber fabrication machine of FIG. 9A, according to an exemplary embodiment.

As shown in FIGS. 9A and 11, the fiber fabricator 200 includes a fiber coater, shown as spinneret 240, coupled to the melt pump 230. According to an exemplary embodiment, the melt pump 230 is configured to regulate the volume of the softened and/or melted material that is metered into the spinneret 240. As shown in FIG. 11, the spinneret includes a body, shown as housing 242, and a nozzle, shown as hollow needle 244, extending from the housing 242. As shown in FIG. 9A, the fiber fabricator 200 includes a first wire payoff attachment including a first spool, shown as wire spool 204, having a length of first prefabricated wire (e.g., wire for the conductive core 12), shown as wire 206, wound therearound. In some embodiments, the fiber fabricator 200 includes a second wire payoff attachment including a second spool having a length of second prefabricated wire (e.g., wire for the reinforcement core 16) wound therearound.

Figure 9B:
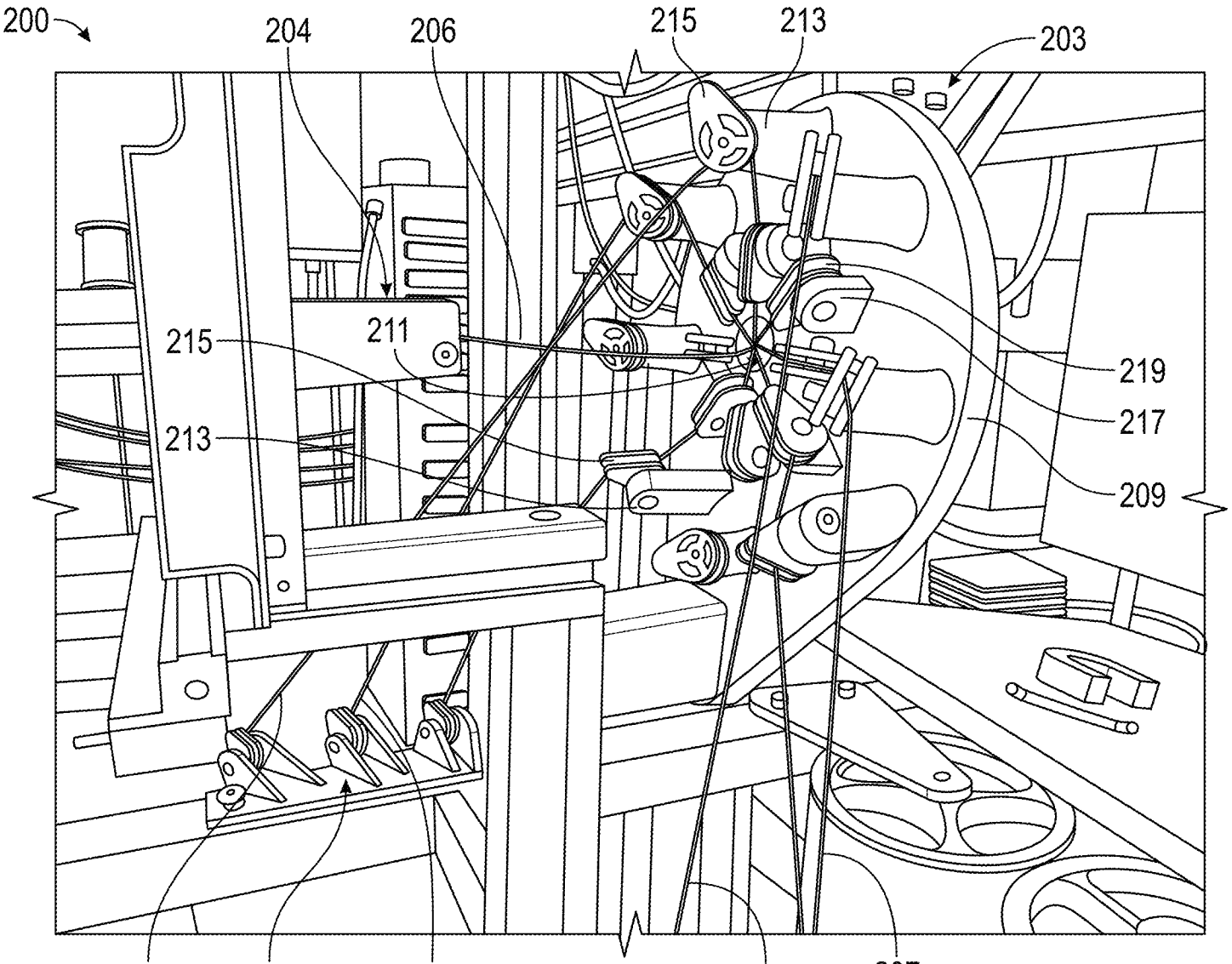
FIG. 9B is a perspective view of a wire dispensing apparatus of the fiber fabrication machine of FIG. 9A, according to an exemplary embodiment.
Figure 10A:
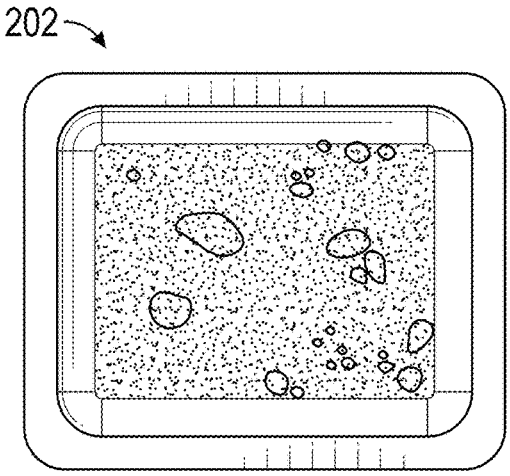
FIGS. 10A-10E are various raw materials that may be used by the fiber fabrication machine of FIG. 9A to form a coating of the color-changing monofilaments, according to an exemplary embodiment.
Figure 10B:
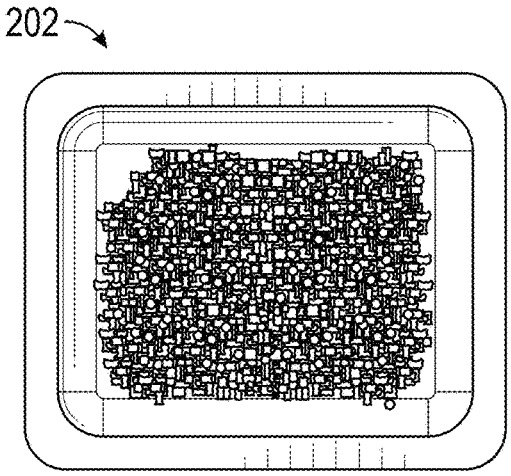
Figure 10C:
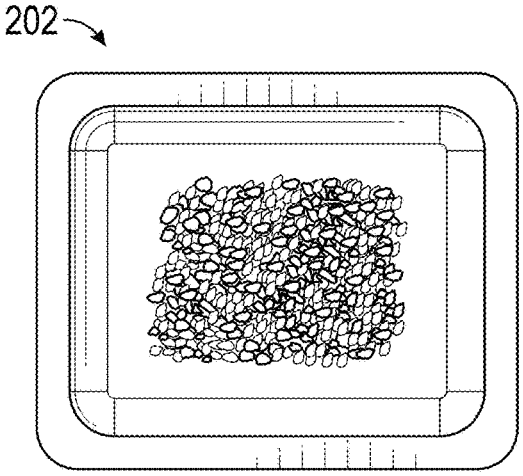
Figure 10D:
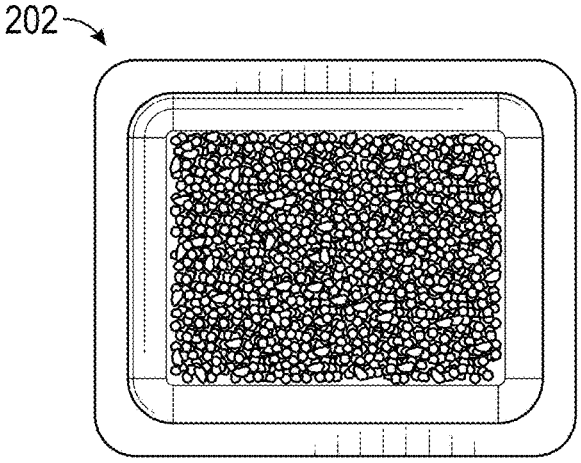
Figure 10E:
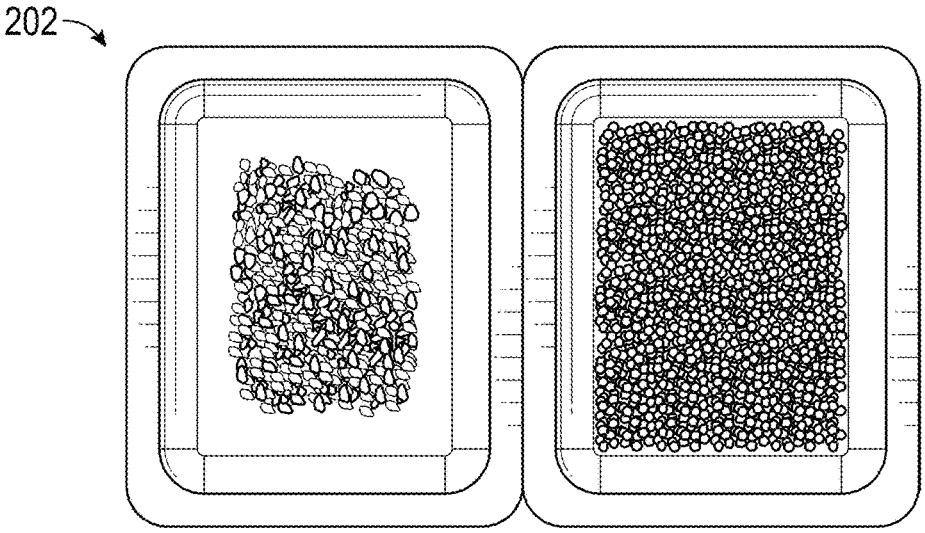

In some embodiments, as shown in FIG. 9B, the fiber fabricator 200 includes a wire dispensing apparatus, shown as wire payoff apparatus 203, configured to dispense a plurality of individual wires simultaneously (e.g., a plurality wires for a plurality of reinforcement cores 16, a first wire for the conductive core 12 and one or more second wires for one or more reinforcement cores 16, etc.). As shown in FIG. 9B, the wire payoff apparatus 203 includes (i) a first wire payoff attachment including the wire spool 204 having the wire 206 and (ii) a plurality of second wire payoff attachments including a plurality of second spools, shown as wire spools 205, having a length of second prefabricated wire (e.g., wire for the reinforcement cores 16), shown as wire 207, wound therearound. In some embodiments, the wire payoff apparatus 203 does not include the wire spool 204 such that the wire payoff apparatus 203 only provides/combines a plurality of the wires 207. In some embodiments, the wire payoff apparatus 203 only includes one of the wire spools 205 such that only one wire 207 is provided/combined with the wire 206.

As shown in FIG. 9B, the wire payoff apparatus 203 includes a base, shown as dispensing base 209, defining an aperture, shown as through-hole 211, positioned at the center of the dispensing base 209. The dispensing base 209 includes (i) a first plurality of mounts, shown as outer mounts 213, positioned/spaced around an outer periphery of the dispensing base 209 and (ii) a second plurality of mounts, shown as inner mounts 217, spaced radially inward from the outer mounts 213 and positioned around the through-hole 211. According to an exemplary embodiment, each of the inner mounts 217 is aligned with a respective one of the outer mounts 213. As shown in FIG. 9B, (i) each of the outer mounts 213 includes a first guide, shown as outer eyelet 215, that receives either the wire 206 from the wire spool 204 or one of the wires 207 from one of the wire spools 205 and (ii) each of the inner mounts 217 include a second guide, shown as inner eyelet 217, that receives the wire 206 or the wire 207 from the outer eyelet 215 associated therewith. The inner eyelets 217 direct the wire 206 and/or one or more of the wires 207 through the through-hole 211 to be provided together to the next component (e.g., a pulley, a needle, etc.) of the fiber fabricator 200.

As shown in FIG. 11, the fiber fabricator 200 includes a first pulley, shown as pulley 246, positioned to receive the wire 206 from the wire spool 204 and guide the wire 206 to the hollow needle 244 and into the housing 242 of the spinneret 240. In some embodiments, the pulley 246 receives the wire 206 and/or one or more of the wires 207 from the wire payoff apparatus 203. In some embodiments, the fiber fabricator 200 does not include the pulley 246, but rather the wire payoff apparatus 203 provides the wire 206 and/or the one or more of the wires 207 directly to the spinneret 240. The spinneret 240 is configured to coat the wire 206 and/or the one or more of the wires 207 with the material provided by the melt pump 230, which collapses onto the wire 206 and/or the one or more of the wires 207 to form the color-changing fiber 10 where the wire 206 functions as the conductive core 12, the one or more wires 207 function as one or more reinforcement cores 16, and the material functions as the coating 14. The color-changing fiber 10 is drawn out of or extruded from the housing 242 at a desired diameter by manipulating the amount of material provided by the melt pump 230 to the spinneret 240 and/or the speed of the wire 206 passing through the spinneret 240. In embodiments where the color-changing fiber 10 includes the reinforcement core 16, the material for the reinforcement core 16, e.g., the second prefabricated wire, may be received by the pulley 246 or a second pulley and guided with the wire 206 to the hollow needle 244 and into the housing 242 of the spinneret 240. The spinneret 240 is configured to coat both the wire 206 and the second prefabricated wire with the material provided by the melt pump 230, which collapses thereon to form a reinforced color-changing fiber 10.

Figure 12:
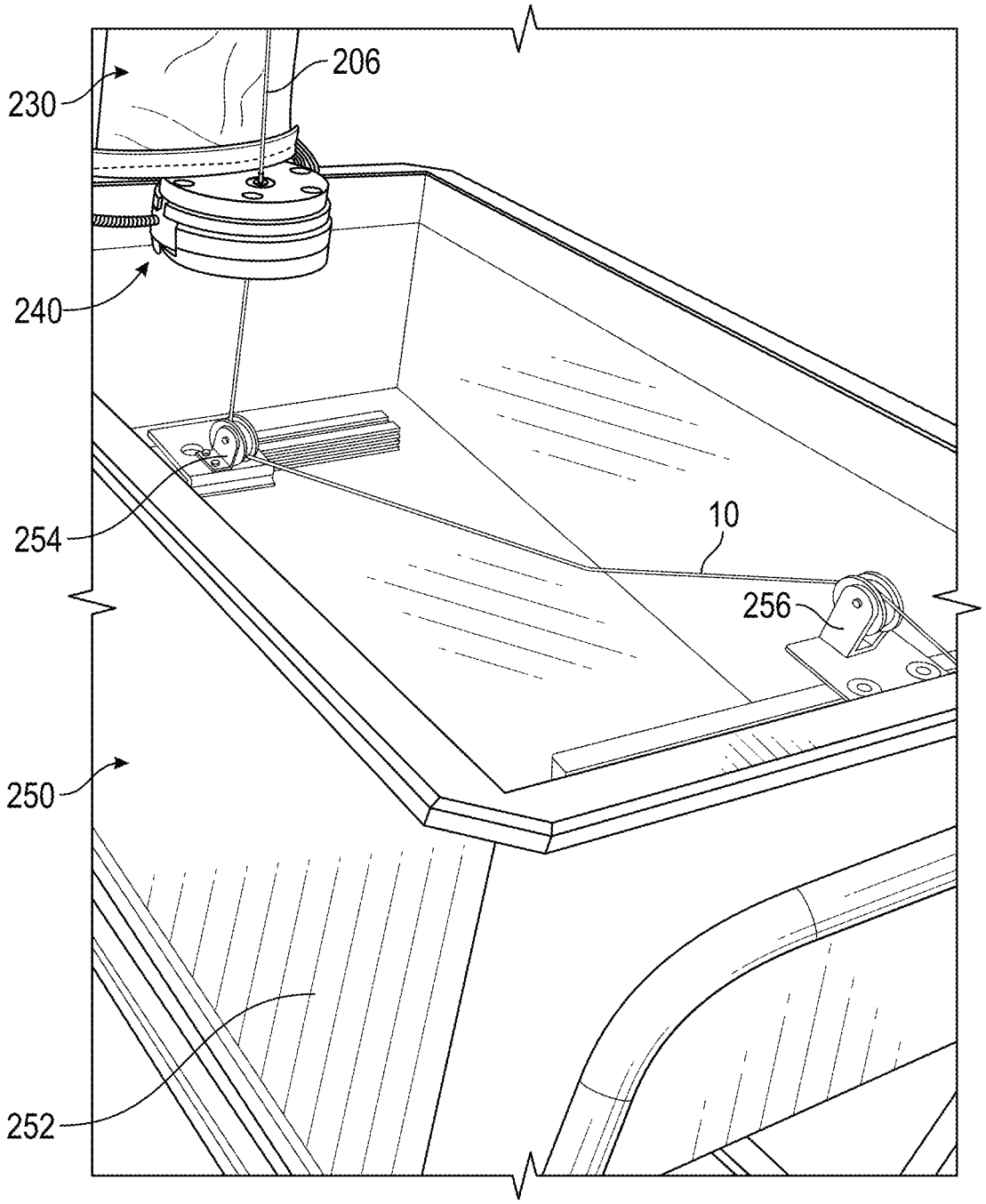
FIG. 12 is a detailed view of a quench assembly of the fiber fabrication machine of FIG. 9A, according to an exemplary embodiment.

The newly formed color-changing fiber 10 may then be quenched to solidify and prevent deformation of the coating 14 around the wire 206. As shown in FIGS. 9A, 11, and 12, the fiber fabricator 200 includes a quenching assembly, shown as water quench 250. As shown in FIG. 12, the water quench includes a fluid container, shown as tub 252, that holds a volume of fluid such as water (or other suitable fluid). The water quench 250 further includes a second pulley, shown as pulley 254, positioned at the bottom of the tub 252, submerged in the fluid, and proximate a first end of the tub 252, and a third pulley, shown as pulley 256, positioned along a top edge of the tub 252 at an opposing, second end of the tub 252. The pulley 254 is positioned to receive the color-changing fiber 10 from the spinneret 240 and guide the color-changing fiber 10 through the fluid in the tub 252 to the pulley 256. In other embodiments, the coating 14 of the color-changing fiber 10 is quenched via air blade quenching or quenching in the ambient air environment.

Figure 13:
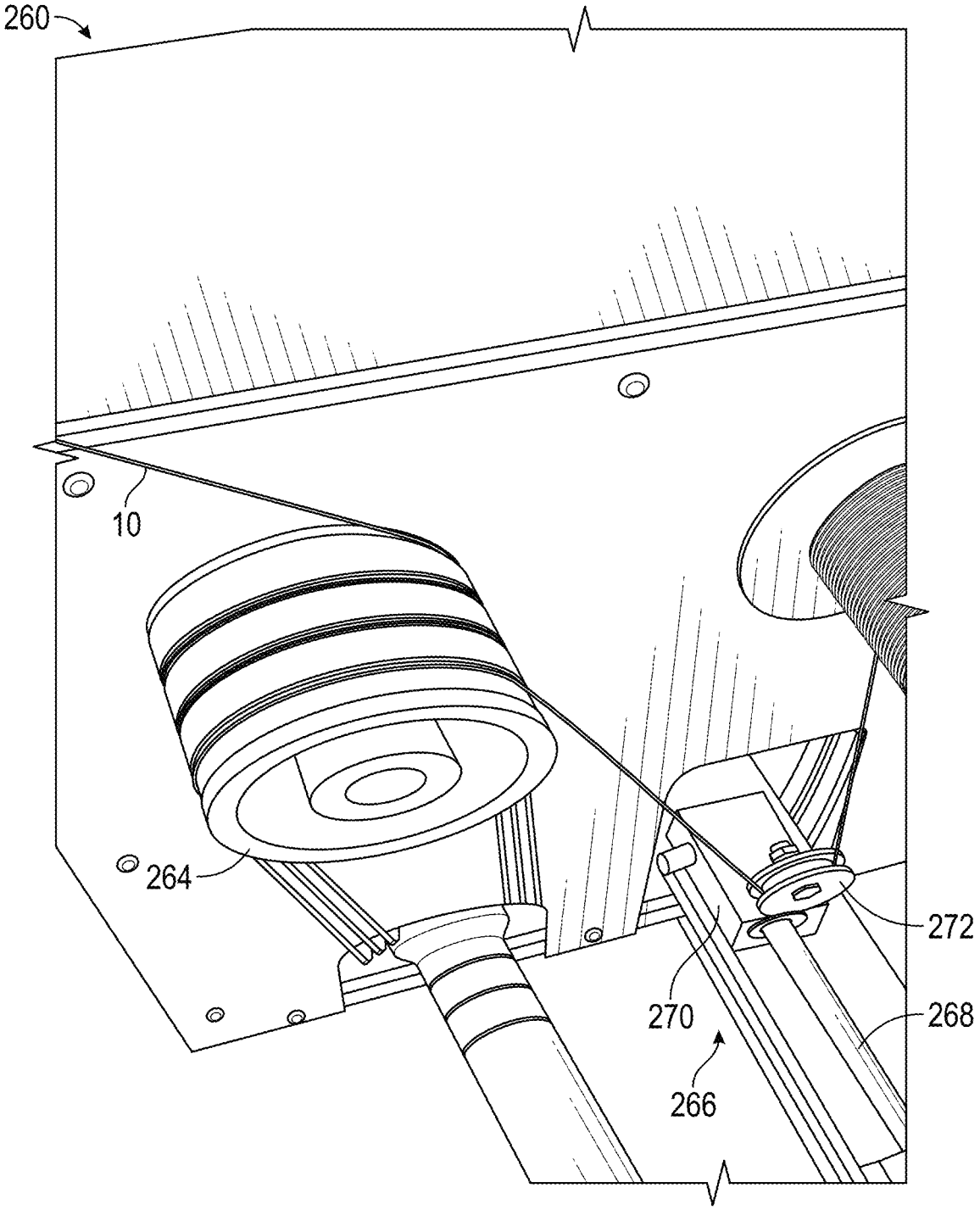
FIGS. 13 and 14 are detailed views of a winder assembly of the fiber fabrication machine of FIG. 9A, according to an exemplary embodiment.
Figure 14:
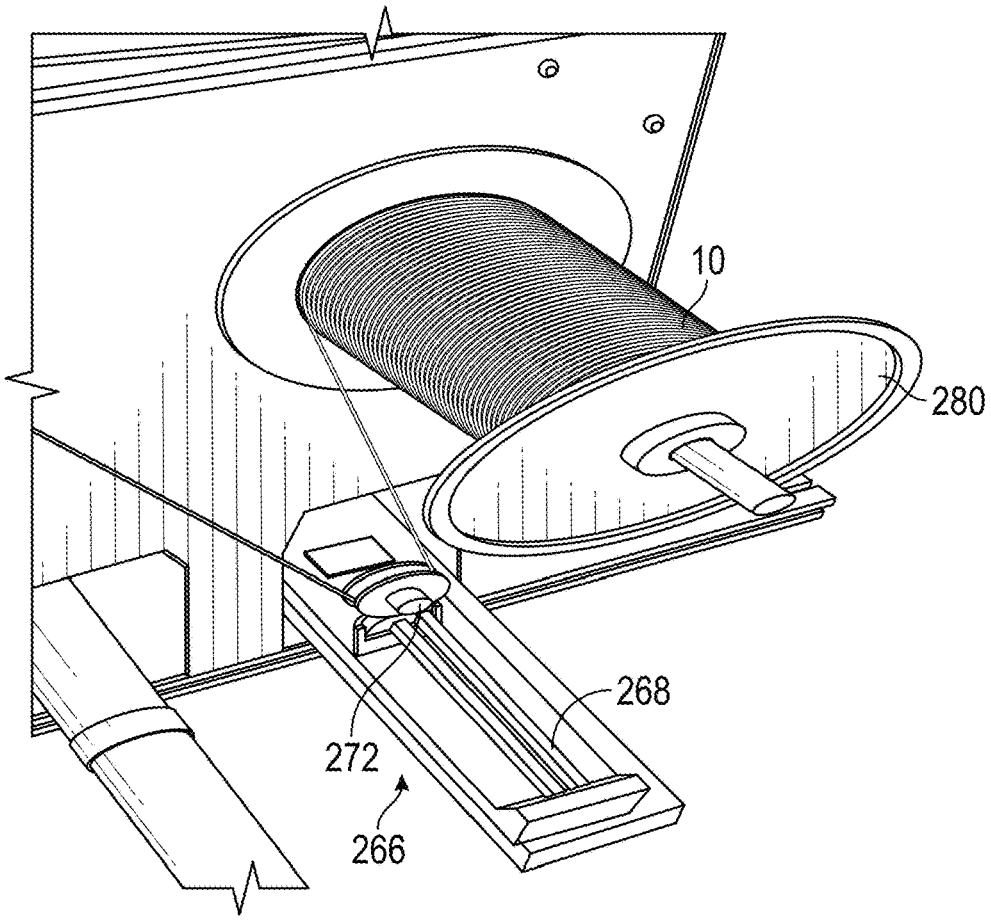

As shown in FIGS. 9A and 13, the fiber fabricator 200 includes a winding assembly, shown as winder 260. The winder 260 includes a motor, shown as drive motor 262, a fourth pulley, shown as godet roll 264, coupled to and driven by the drive motor 262, a traverse assembly, shown as traverse 266, and a take-up roll, shown as fiber spool 280. The traverse 266 includes a guide, shown as track 268, a slide, shown as slide 270, slidably coupled to the track 268, and a fifth pulley, shown as pulley 272, coupled to the slide 270. The godet roll 264 receives the color-changing fiber 10 from the pulley 256 of the water quench 250 and provides the color-changing fiber 10 to the pulley 272 of the traverse 266. The pulley 272 then guides the color-changing fiber 10 to the fiber spool 280. According to an exemplary embodiment, the slide 270 is configured to translate back and forth along the track 268 as the color-changing fiber 10 accumulates on the fiber spool 280 to evenly distribute the color-changing fiber 10 onto the fiber spool 280. The fiber spool 280 may be driven by a corresponding motor (e.g., at a speed based on the speed of the godet roll 264, etc.).

As shown in FIG. 9A, the fiber fabricator 200 includes a control system, shown as controller 290. The controller 290 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to an exemplary embodiment, the controller 290 includes a processing circuit having a processor and a memory. The processing circuit may include an ASIC, one or more FPGAs, a DSP, circuits containing one or more processing components, circuitry for supporting a microprocessor, a group of processing components, or other suitable electronic processing components. In some embodiments, the processor is configured to execute computer code stored in the memory to facilitate the activities described herein. The memory may be any volatile or non-volatile computer-readable storage medium capable of storing data or computer code relating to the activities described herein. According to an exemplary embodiment, the memory includes computer code modules (e.g., executable code, object code, source code, script code, machine code, etc.) configured for execution by the processor.

According to an exemplary embodiment, the controller 290 is configured to control operation of the first screw extruder 220, the second screw extruder 222, the melt pump 230, the spinneret 240, the drive motor 262, and/or the traverse 266. By way of example, the controller 290 may control the speed of the wire 206 through the fiber fabricator 200 (e.g., by controlling the speed of the drive motor 262, etc.), the thickness of the coating 14 disposed onto the wire 206 (e.g., by controlling the flow of the melted coating provided by the melt pump 230, the speed of the drive motor 262, etc.), the temperature of the heating elements in the first screw extruder 220 and the second screw extruder 222, and/or the speed at which the first screw extruder 220 and the second screw extruder 222 are driven.

It should be understood that the description of the fiber fabricator 200 in relation to FIGS. 9A-15 is just one possible implementation of a machine that may be used to manufacture the color-changing fibers 10 and should not be considered as limiting. In other implementations, the fiber fabricator 200 may include different or variations of components, additional components, fewer components, etc. By way of example, the fiber fabricator 200 may include more hoppers (e.g., three, four, five, etc. hoppers). By way of another example, the fiber coater, the quench assembly, and/or the winder may be different than or a variation of the spinneret 240, the water quench 250, and/or the winder 260 disclosed herein.

Increased production is possible by adjusting the fiber fabricator 200 to include multiple spinnerets 240 with an equal number of winders 260. More complex monofilament structures (e.g., the structures described in FIGS. 2, 4, and 5, etc.) may be produced through the use of distribution plates. The distribution plates may be placed directly above and/or within the spinneret 240, and through carefully designed internal channels, combine raw materials from different screw extruders to produce the desired structure. By way of example, the distribution plates may guide softened polymer in such a way as to create a desired cross-sectional pattern onto the conductive core 12. These structures may enable the production of the color-changing fiber 10 having multiple different thermochromic pigments segregated into each a plurality of segments within the cross-sectional structure. Color-changing fibers 10 with multi-layer coatings (e.g., the coating 14 of FIGS. 3-5, etc.) may be produced by passing the color-changing fiber 10 through the fiber fabricator 200 or a different fiber fabricator 200 one or more additional times to add additional layers to the coating 14. The melt-spinning process may be employed to produce fibers with highly complex, multi-component cross sections, such as a multi-segmented pie that alternates between two or more colors as shown in FIG. 7, which can enable optical effects that cannot be achieved by simply mixing the thermochromic pigments in polymer or braiding different threads into a yarn.

In some embodiments, a pixelated cross-section pattern of the coating 14 is generated using distribution plates. In such embodiments, the pixelated cross-sections may be arranged in such a way to form or generate an image in the resulting fabric.

According to another example embodiment, a second fabrication procedure involves the continuous injection of a conductive core material, rather than using a prefabricated wire such as the wire 206. The second fabrication procedure includes the use of raw materials. The raw materials for the coating 14 include those described above, in addition to a raw material or raw materials to form the conductive core 12 (i.e., no pre-existing wire is used). The raw materials to form the conductive core 12 may include (i) low-melting-temperature metals such as tin, indium, etc., (ii) low-melting-temperature metal alloys, (iii) a semiconductor material, (iv) a conductive polymer, or (v) combinations thereof. In some embodiments, the melt temperature of the raw materials for the conductive core 12 is less than the melt temperature of the raw materials for the coating 14.

Figure 16:
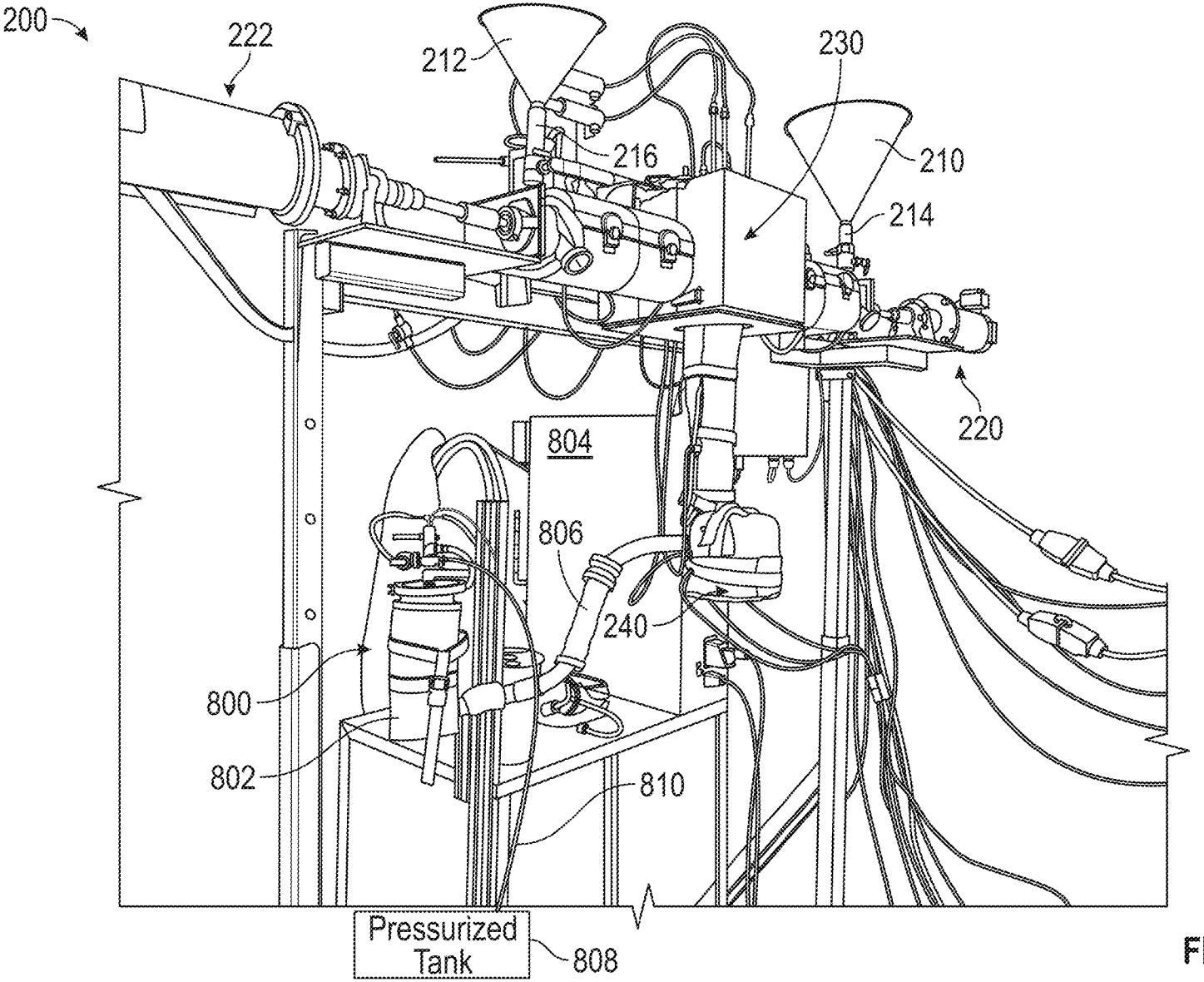
FIG. 16 is a perspective view of a fiber fabrication machine used to produce color-changing monofilaments, according to another exemplary embodiment.

As shown in FIG. 16, the fiber fabricator 200 does not include the wire spool 204 or use the wire 206, but, rather, the fiber fabricator 200 alternatively includes a liquid injection system, shown as conductive core injection system 800, that facilitates performing the second fabrication procedure. The conductive core injection system 800 includes a reservoir, shown as molten core reservoir 802, which may be heated to maintain molten core materials in a liquid/molten state; a heating unit, shown as heating cabinet 804, including heating elements that are configured to melt raw core materials, which are stored in the molten core reservoir 802; a first conduit, shown as heated hose 806, connecting the molten core reservoir 802 to the spinneret 240 to facilitate providing the molten core materials from the molten core reservoir 802 to the spinneret 240; a pressure source, shown as pressurized tank 808, configured to store pressurized gas (e.g., air, oxygen, nitrogen, etc.); and a second conduit, shown as gas line 810, extending between the molten core reservoir 802 and the pressurized tank 808 to facilitate providing the pressurized gas from the pressurized tank 808 to the molten core reservoir 802 to drive (e.g., force, push, etc.) the molten core materials through the heated hose 806 into the spinneret 240.

The second fabrication procedure may be performed as follows: (i) the raw materials for the coating 14 are fed into a hopper (e.g., the first hopper 210, the second hopper 212, etc.), (ii) the raw materials for the conductive core 12 are loaded into the conductive core injection system 800 (e.g., the heating cabinet 804, etc.), (iii) the raw materials for the conductive core 12 are melted and delivered via the conductive core injection system 800 to a specialized spinneret (e.g., a bicomponent melt extrusion pack, the spinneret 240, etc.), (iv) the raw materials for the coating 14 are melted and delivered via the first screw extruder 220, the second screw extruder 222, and/or the melt pump 230 to the specialized spinneret, (v) the specialized spinneret co-extrudes the conductive core 12 and the coating 14 into a core/cladding monofilament architecture (i.e., the color-changing fiber 10), and (vi) the color-changing fiber 10 is quenched and spooled.

According to an exemplary embodiment, the fiber fabrication processes disclosed herein provide flexibility with respect to the materials selection, structure, size, and even shape of each individual fiber. Exercising control over these degrees of freedom facilitates optimizing the heat transfer and thermal distribution over a fabric formed from the individual fibers. For example, materials with different thermal conductivities may heat up and cool down at different rates. The freedom to choose materials that either hold heat (i.e., allowing for less electrical energy to maintain the color change) or dissipate heat (i.e., allowing for quicker color change/return) facilitates tailoring the material to the application. Further, control over the size of the color-changing fiber 10 and the ratio of the diameter of the conductive core 12 and/or the reinforcement core 16 to the diameter of the coating 14 facilitates optimizing the largest material volume change per unit electrical energy. Furthermore, control over the diameter of the conductive core 12 (which is the typically a heavier metal component) and/or the reinforcement core 16 facilitates controlling the weight (i.e., how "heavy") of the resultant fabric. Such control therefore facilitates tailoring the fibers based on different application needs.

Figure 15:
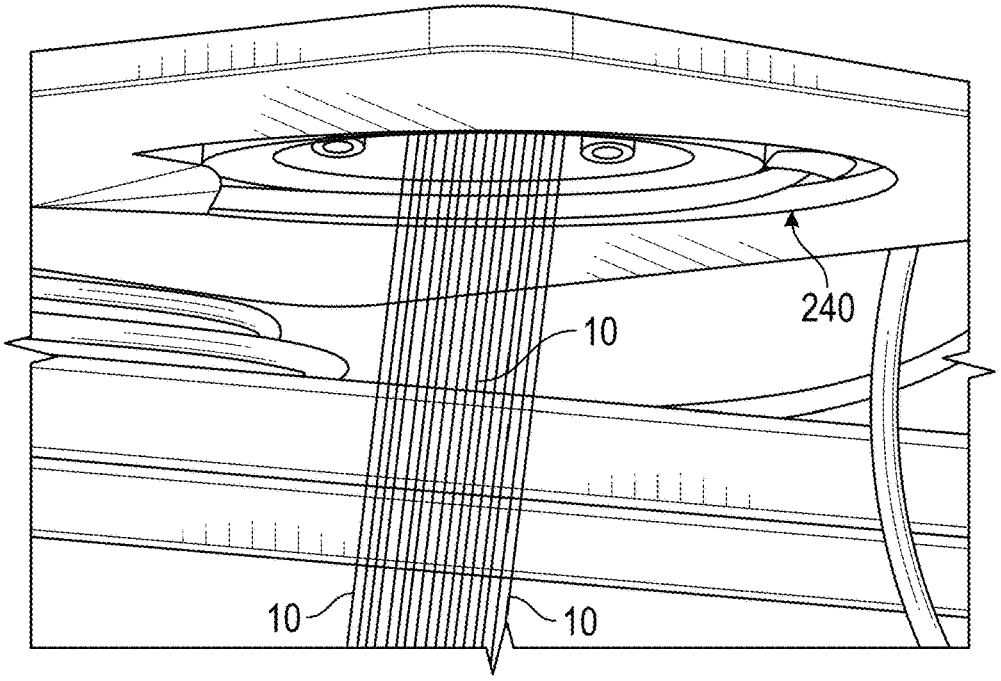
FIG. 15 is a detailed view of a multi-filament spinneret of the fiber fabrication machine of FIG. 9A, according to an exemplary embodiment.

The fabrication of the color-changing yarn 100 may be performed in many ways. In one embodiment, the color-changing fiber 10 on the fiber spool 280 is combined (e.g., twisted, braided, etc.) with (i) one or more other color-changing fibers 10 from other fiber spools 280 and/or (ii) one or more non-color-changing fibers from other spools. In another embodiment, multiple fiber fabricators 200 are set up in parallel (e.g., each including the hoppers, the screw extruders, the melt pumps, the spinnerets, etc.). The resultant color-changing fiber 10 from each fiber fabricator 200 may be fed into a combining machine (e.g., a braiding machine, etc.) that forms the color-changing yarn 100 from the plurality of color-changing fibers 10. The color-changing yarn 100 may then be spooled. In still another embodiment, as shown in FIG. 15, the spinneret 240 (e.g., a multi-filament spinneret, etc.) is configured to receive a plurality of the wires 206 and facilitate coating each of the plurality of wires 206 with the coating 14 such that a plurality of color-changing fibers 10 exit the spinneret 240 simultaneously. The plurality of color-changing fibers 10 may be individually spooled using respective winders 260 or the plurality of color-changing fibers 10 may be fed into a combining machine (e.g., a braiding machine, etc.) that forms the color-changing yarn 100 from the plurality of color-changing fibers 10. The multi-filament spinneret may also be adapted to work with the conductive core injection system 800 of FIG. 16.

Color-Changing Fabric

Prototype Fabrics and Testing

Applicant has produced various color-changing fabric prototypes through its research and development. The first generation fabric prototype included fibers from cyclic olefin copolymer that cold-drew under tension during weaving, which resulted in buckling of the fabric.

Figure 17:
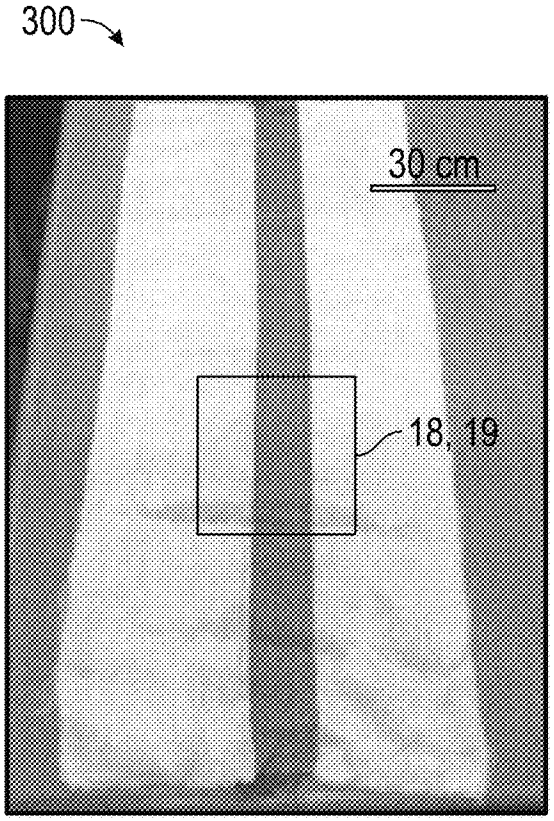

A second generation fabric prototype included fibers with a thermoplastic elastomer coating comprising a species of Hytrel, which did not undergo cold-drawing under tension during the weaving process. The fibers were fabricated using a melt-spinning machine (e.g., the fiber fabricator 200, etc.) to extrude the polymer infused with the thermochromic pigment around a 37 AWG copper wire. The resultant monofilament (e.g., the color-changing fiber 10, etc.) had an outer diameter of approximately 450 micrometers. As shown in FIGS. 17-20, a fabric, shown as color-changing fabric 300, was woven from the monofilament with a cotton-nylon blend in the warp direction. As shown in FIG. 17, an active area of the color-changing fabric 300 had a dark color (e.g., a blue color, etc.), which comprised the color-changing fibers. The color-changing fabric 300 had dimensions of 53 inches by 22 inches, and the dark strip containing the color-changing fibers was approximately 4 inches wide. To electrically connect the cores of the fibers, Applicant selectively dissolved approximately one inch of the coating from the end of the fibers, leaving the ends of the cores exposed. The end of the cores were then grouped into clusters or separate segments and soldered together (e.g., groups of 12-13 cores, etc.).

Figure 19:
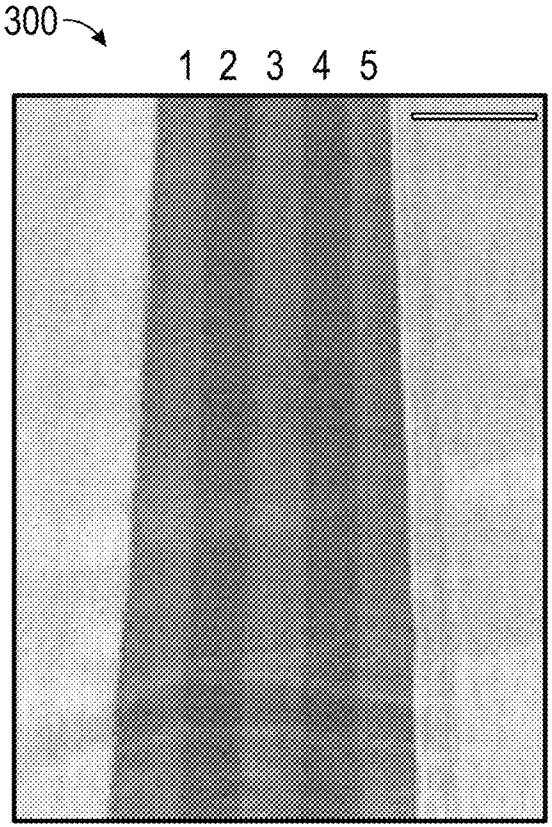
FIGS. 17-19 are various images of a fabric prototype, according to an exemplary embodiment.
Figure 18:
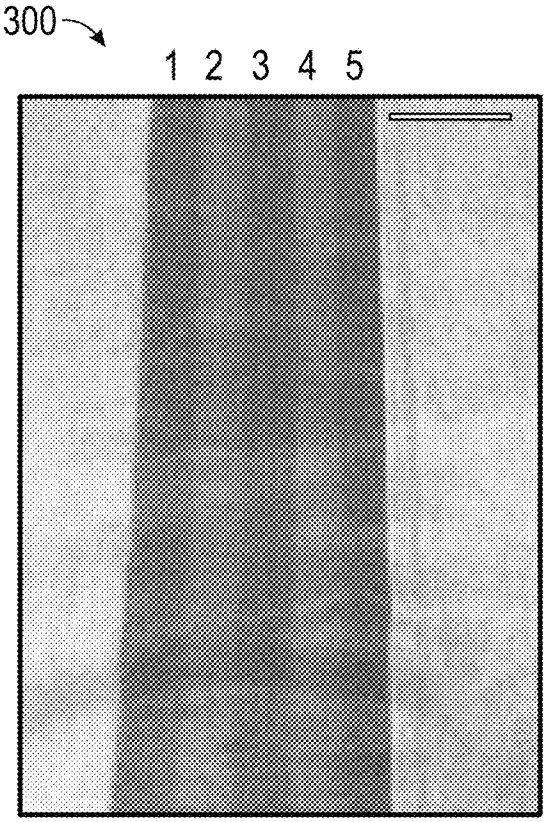
Figure 20:
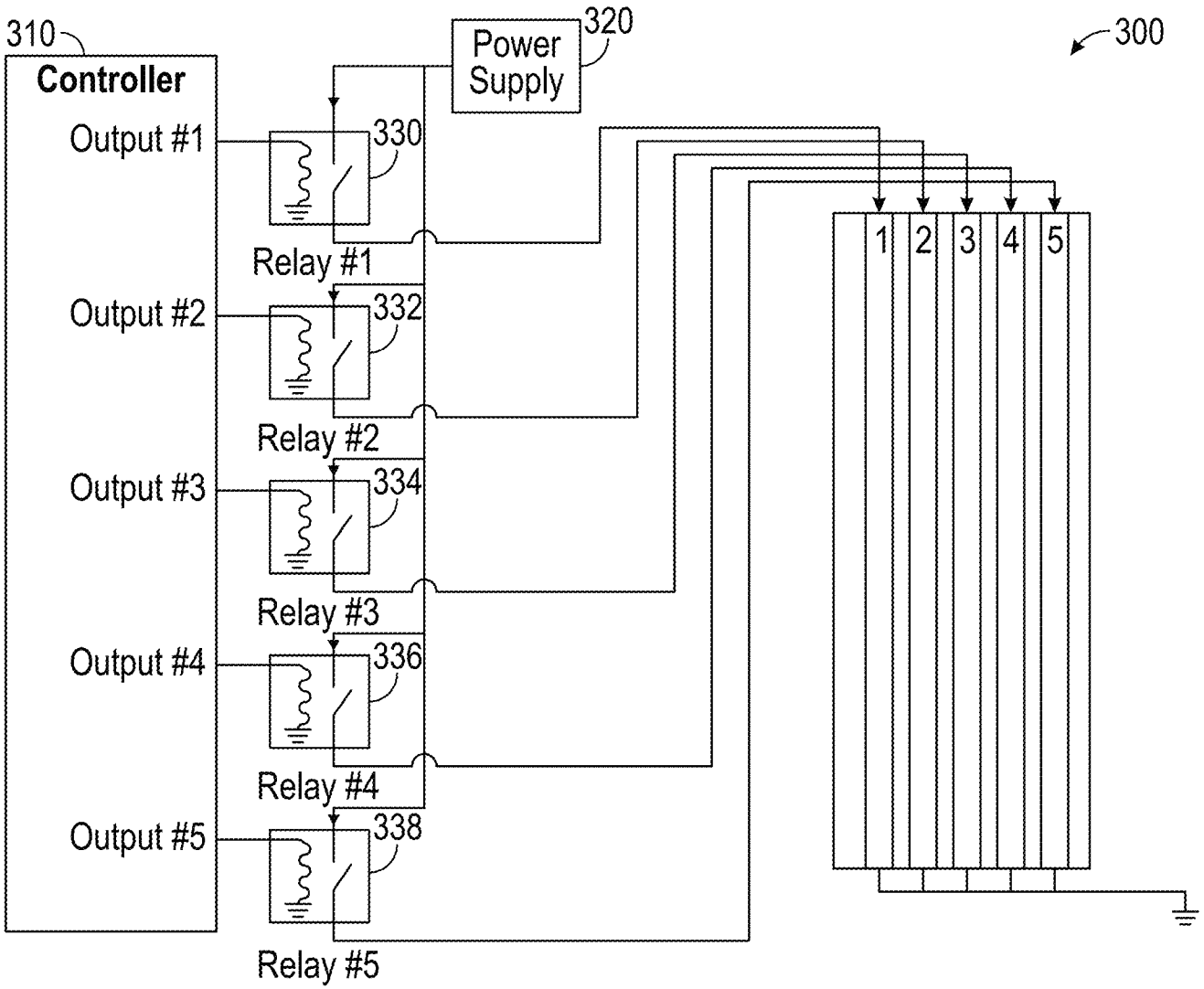
FIG. 20 is a schematic of the fabric prototype of FIGS. 17-19, according to an exemplary embodiment.

As shown in FIGS. 18-20, the 4 inch wide portion of the color-changing fabric 300 comprising the color-changing fibers was electrically separated into five segments, shown as first segment, second segment, third segment, fourth segment, and fifth segment. As shown in FIG. 20, each of the five segments was electrically coupled to a respective switch device, shown as first relay 330, second relay 332, third relay 334, fourth relay 336, and fifth relay 338. The first relay 330, the second relay 332, the third relay 334, the fourth relay 336, and the fifth relay 338 were configured to facilitate selectively electrically coupling the first segment, the second segment, the third segment, the fourth segment, and the fifth segment, respectively, to a control system (in this prototype an Arduino controller), shown as controller 310, and a power source, shown as power supply 320. The controller 310 was configured to selectively engage and disengage the first relay 330, the second relay 332, the third relay 334, the fourth relay 336, and the fifth relay 338 to selectively provide electrical current from the power supply 320 to the first segment, the second segment, the third segment, the fourth segment, and the fifth segment, respectively.

As shown in FIG. 18, the controller 310 selectively engaged the second relay 332 and the fourth relay 336 such that the second segment and the fourth segment transitioned from a darker color (blue) to a lighter color (white/colorless), while the first relay 330, the third relay 334, and the fifth relay 338 were left disengaged such that the first segment, the third segment, and the fifth segment remained the darker color. As shown in FIG. 19, the controller 310 then (i) selectively engaged the first relay 330, the third relay 334, and the fifth relay 338 such that the first segment, the third segment, and the fifth segment transitioned from the darker color to the lighter color and (ii) selectively disengaged the second relay 332 and the fourth relay 336 such that the second segment and the fourth segment transitioned back to the darker color from the lighter color.

A third generation fabric prototype was fabricated from a new spool of color-changing fiber with an even larger active area. The concentration of the thermochromic pigment was increased approximately 50% relative to the second prototype from 4% by mass thermochromic pigment (96% by mass virgin Hytrel) to 6% by mass thermochromic pigment (94% by mass virgin Hytrel) and the polymeric material was switched to a different species of Hytrel (from Hytrel 3038 to Hytrel 5526). The fibers of the second prototype had a tacky surface, likely due to the softness of the species of Hytrel chosen. The tackiness made the weaving process difficult and slow. The new species of Hytrel did not result in a tacky surface after coating the wire core, and the weaving speed was able to be performed at up to 150 picks per minute. In addition, a different thermochromic pigment concentrate was blended with the Hytrel polymer, which caused the color-changing fibers to transition from green to yellow, rather than from blue to colorless.

A red hue could be seen in the second prototype when the segments were activated due to the copper wire in the core of the fibers. The enamel coating on the copper had a red tint, and when the blue pigment transitioned to colorless, the fibers became semi-transparent, revealing the wire inside. With the third prototype, the green-to-yellow pigment never transitioned colorless such that the copper wire core was not visible. The width of the active area in the third fabric prototype was 16 inches and the length of the active area was 66 inches. In the third prototype, the active color-changing area was increased by a factor of approximately 6.7 relative to the second prototype. In the third prototype, Applicant grouped the cores into sixteen independently controllable segments along the width of the fabric. With the various prototypes and testing, Applicant has identified various ways to manufacture the color-changing fibers 10 and the color-changing yarns 100, and then arrange (e.g., weave, knit, etc.) or incorporate (e.g., embroider, stitch, etc.) the color-changing fibers 10 and the color-changing yarns 100 into a fabric and/or end product that has visual characteristics that may be selectively, adaptively, and/or dynamically controlled (e.g., colors, patterns, etc.).

Fabric Manufacturing Process

Figure 21:
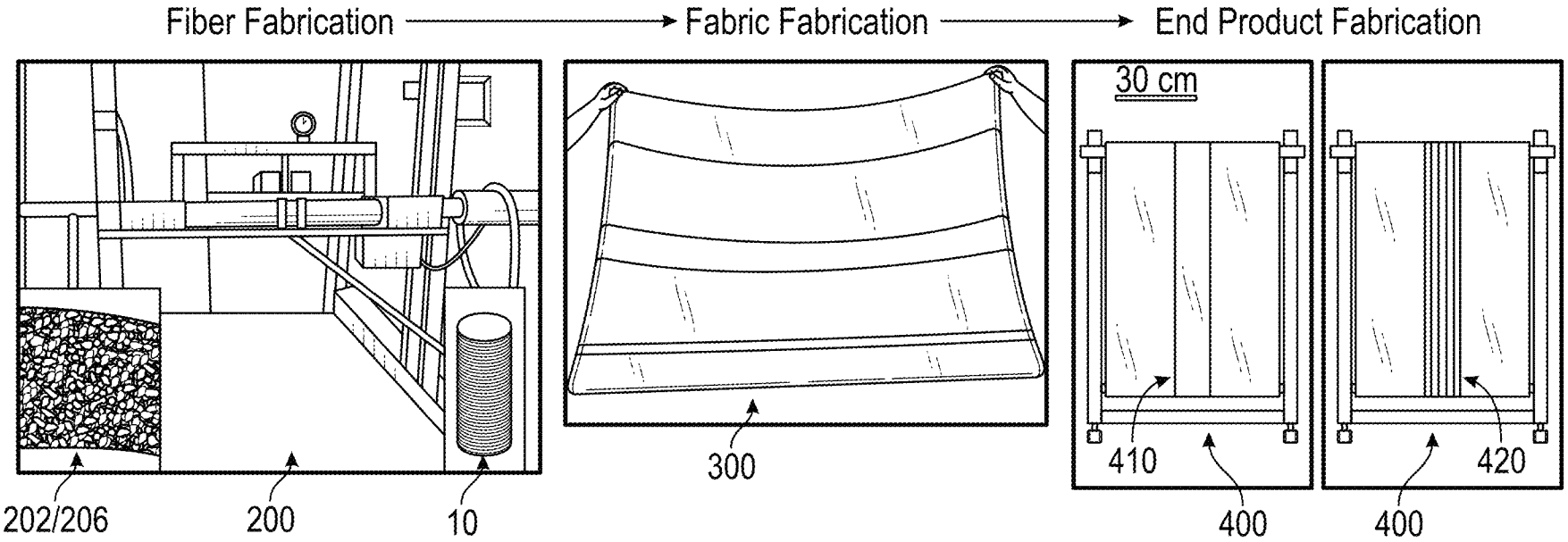
FIG. 21 visually depicts a process of manufacturing an electrically controllable, color-changing end product, according to an exemplary embodiment.

Referring to FIG. 21, a process of manufacturing an electrically controllable, color-changing end product is visually depicted, according to an exemplary embodiment. As shown in FIG. 21, the fiber fabricator 200 receives raw materials (e.g., the raw materials 202 for the coating 14, the wire 206 for the conductive core 12, the raw materials for the conductive core 12, etc.) and produces the color-changing fiber 10 therefrom. The color-changing fiber 10 may 10 may then be: (i) combined with other fibers (e.g., the same color-changing fiber 10, a different color-changing fiber 10, a non-color-changing fiber, etc.) to make the color-changing yarn 100, which may then be woven with non-color-changing fibers or yarns (e.g., a cotton-nylon blend, etc.) to form the color-changing fabric 300 (e.g., the non-color-changing fibers or yarns are woven in a first direction of the fabric and the color-changing yarns 100 are woven in a second direction, etc.), (ii) woven directly with non-color-changing fibers or yarns to form the color-changing fabric 300 (e.g., the non-color-changing fibers or yarns are woven in a first direction of the fabric and the color-changing fiber 10 are woven in a second direction, etc.), (iii) combined with other fibers to make the color-changing yarn 100, which may then be knitted to form the color-changing fabric 300 (or the color-changing product 400 directly), or (iv) knitted to form the color-changing fabric 300 (or the color-changing product 400 directly). The color-changing fibers 10 of the color-changing fabric 300 may be electrically connected in a desired manner and then the color-changing fabric 300 may be manipulated (e.g., cut, shaped, joined to other fabrics, etc.) to form an end product, shown as color-changing product 400 (e.g., shown here as a window-blind, etc.), that is capable of transitioning a visual characteristic thereof from a first state, shown as state 410, to a second state, shown as state 420.

Various weaving and/or knitting techniques may be used to arrange the color-changing fibers 10 and/or the color-changing yarns 100 into the color-changing fabric 300 and/or the color-changing product 400. By way of example, the weaving and/or knitting techniques may include a twill/herringbone weave, a satin weave, a loom weave, a basket weave, a plain weave, a Jacquard weave, an Oxford weave, a rib weave, courses and wales knitting, weft and warp knitting, and/or other suitable weaving and/or knitting techniques. Once the color-changing fabric 300 is formed, it can be cut and joined with (e.g., sewn to, etc.) other fabrics (e.g., the same color-changing fabric 300, different color-changing fabric 300, non-color-changing fabrics, etc.) to make any desired end product (e.g., the color-changing products 400, etc.). One difference between traditional end product formation and end product formation using the color-changing fabric 300 may be that excess loose fabric extends beyond seams of the joined fabrics (e.g., one, two, etc. inches) to allow electrical connections of the color-changing fibers 10 and/or the color-changing yarns 100 of the color-changing fabrics 300 together, to relays, to a power source, and/or to a controller.

Embroidery

In addition to weaving and knitting, another method for incorporating the color-changing fibers 10 and/or the color-changing yarns 100 into regular and/or color-changing fabrics and products is embroidery. For traditional embroidery, the color-changing fibers 10 having the reinforcement core 16 may be used. By way of example, a color-changing fiber 10 or a color-changing yarn 100 may be fed through a needle, punched through fabric onto which the color-changing fiber 10 or color-changing yarn 100 is being embroidered, grabbed by a bottom yarn in a bobbin beneath the fabric, and then punched back through the fabric. The color-changing fiber 10 or the color-changing yarn 100 undergoes a fairly high level of tensile stress and a very tight bend radius from the looping back and forth between the top and the underside of the fabric. The reinforcement core 16 may provide sufficient strength to the color-changing fiber 10 or the color-changing yarn 100 to survive this process (e.g., prevent breaking, tearing, etc.).

Figure 70:
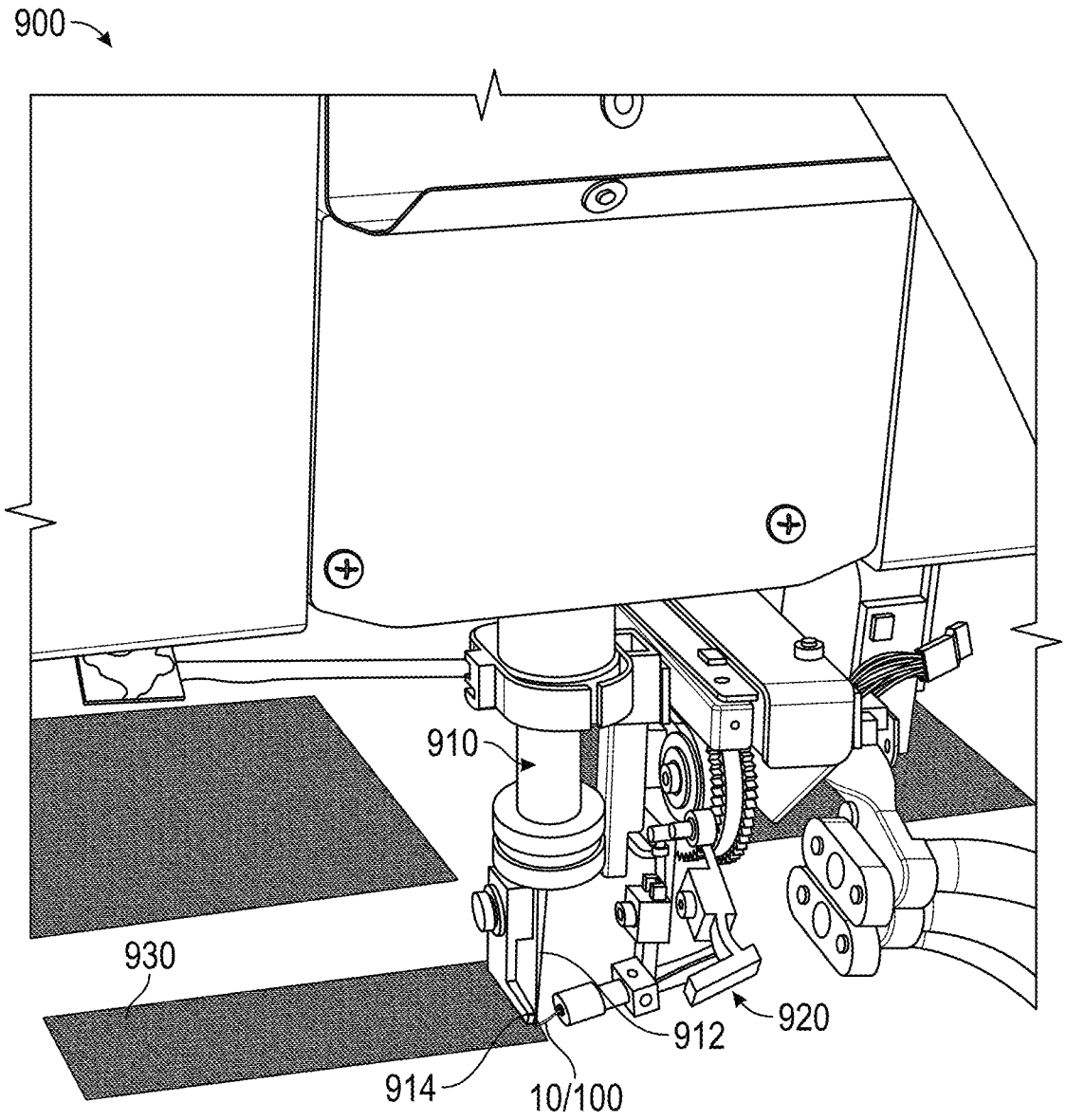
FIG. 70 is a perspective view of an embroidery system, according to an exemplary embodiment.
Figure 72:
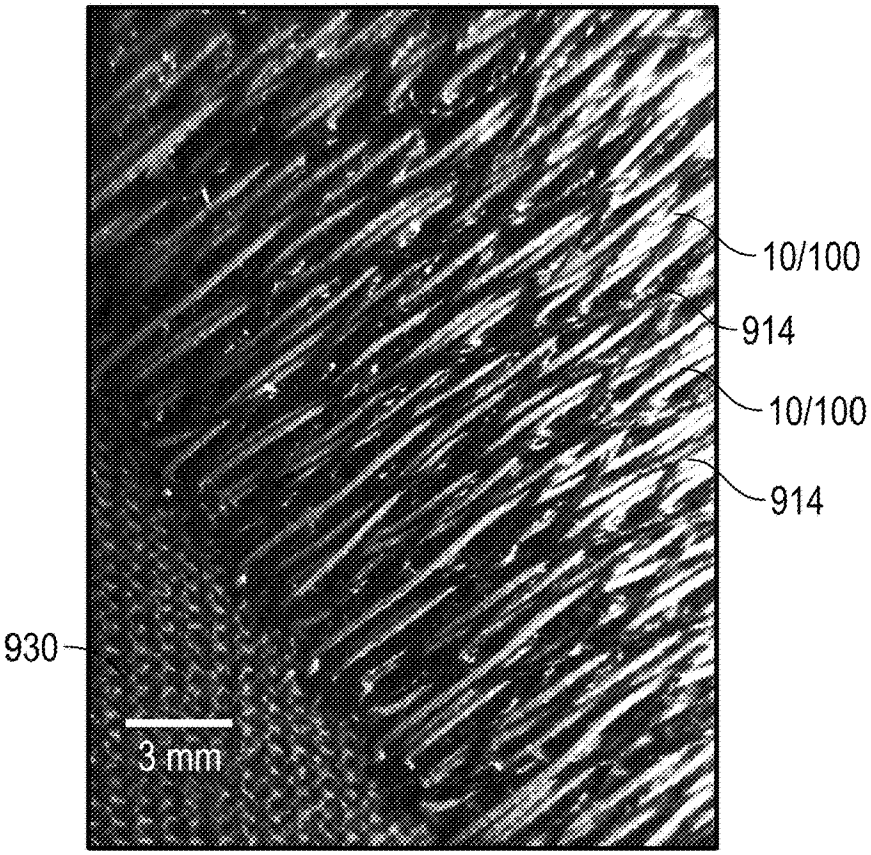
FIGS. 71 and 72 are various views of a color-changing embroidered fabric, according to various exemplary embodiments.
Figure 71:
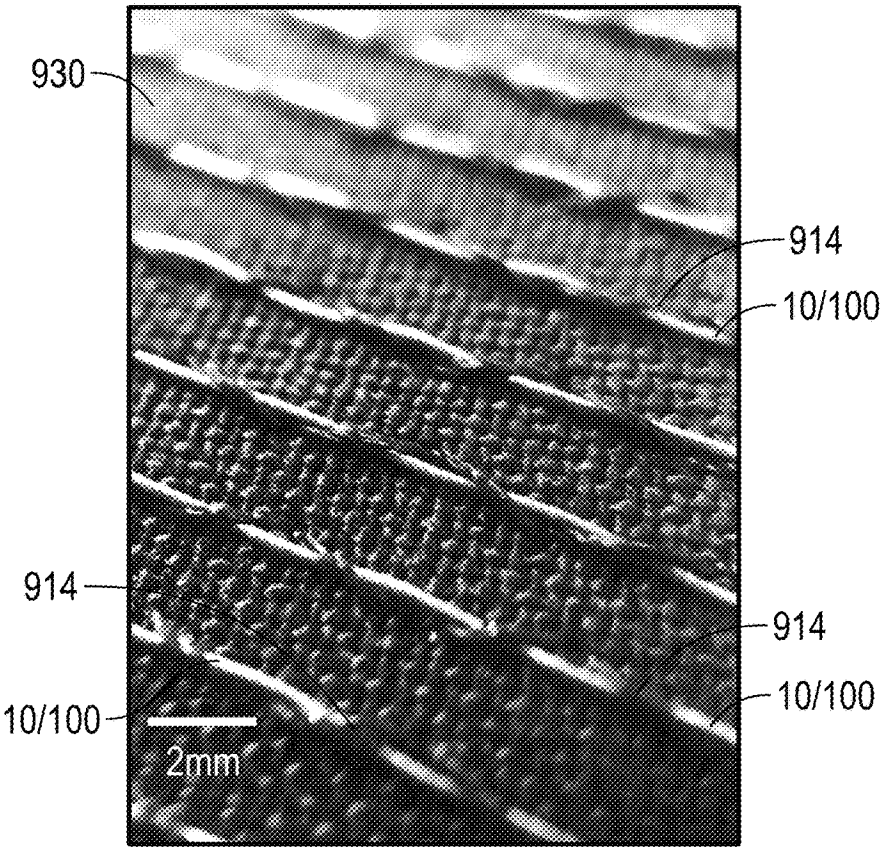

Other types of embroidery processes may be used that have less stringent requirements on the properties of the color-changing fibers 10 and the color-changing yarns 100 such that the reinforcement core 16 may not be needed. Specifically, referring to FIGS. 70-72, an embroidery system, shown as embroidery machine 900, may be used to create a fabric having embroidery, shown as fabric 930. As shown in FIG. 70, the embroidery machine 900 includes a needle punching mechanism, shown as stich mechanism 910, and a fiber laying mechanism, shown as fiber guide 920. The fiber guide 920 is configured to lay the color-changing fiber 10 and/or the color-changing yarn 100 along the fabric 930 and the stich mechanism 910, via a needle 912, is configured to secure the color-changing fiber 10 and/or the color-changing yarn 100 to the fabric 930 by stitching a securing thread 914 along the color-changing fiber 10 and/or the color-changing yarn 100 to provide embroidery. Specifically, as shown in FIGS. 71 and 72, the securing thread 914 is looped over the color-changing fiber 10 and/or the color-changing yarn 100 and a bottom thread is then looped through the securing thread 914 as it is punched through to the underside of the fabric 930 to keep the color-changing fiber 10 and/or the color-changing yarn 100 tightly in place. The color-changing fiber 10 and/or the color-changing yarn 100 is, therefore, not fed through a needle, looped tightly, or punched through the fabric 930 as in the previous embroidery process described above. Rather, the color-changing fiber 10 and/or the color-changing yarn 100 is fed through the fiber guide 920 under zero tension and laid down onto the fabric 930 to create a desired pattern.

In some embodiments, the embroidery machine 900 is a another type of embroidery system, which may be used to create a fabric having another style embroidery. Such an embroidery system may use a cording device to lay down the color-changing fiber 10 and/or the color-changing yarn 100. Specifically, the color-changing fiber 10 and/or the color-changing yarn 100 may be lead through a cord of the cording device and laid down onto a fabric and stitched into place with a top thread without the need to punch the color-changing fiber 10 and/or the color-changing yarn 100 through the fabric or apply any tensile strain thereto. Advantageously, this type of embroidery system facilitates embroidering the color-changing fiber 10 and/or the color-changing yarn 100 directly onto finished goods (e.g., t-shirts, jackets, pants, bags, etc.). It should be understood that the embroidery systems detailed herein are not limiting, and other types of embroidery systems may be used.

Using the embroidery machine 900, various parameters may be manipulated to adjust the color and contrast of the fabric 930. For example, the spacing between the color-changing fibers 10 and/or the color-changing yarns 100 may be manipulated, as shown in FIGS. 71 and 72. The more densely packed the color-changing fibers 10 and/or the color-changing yarns 100 are, the more strongly the color and color change will show. As another example, the stitch length of the securing thread 914 may be manipulated. The stich length determines the distance between the loop that the securing thread 914 forms around the color-changing fibers 10 and/or the color-changing yarns 100 to hold them in place on the fabric 930. The smaller the stitch length, the more securing thread 914 will cover the color-changing fibers 10 and/or the color-changing yarns 100, reducing the appearance of the color and color change. Conversely, the longer the stitch length, the less the securing thread 914 will cover the color-changing fibers 10 and/or the color-changing yarns 100. The spacing and stich length parameters can be controlled in the software for the embroidery machine 900 and selected by an operator as desired. As yet another example, the diameter of (i) the color-changing fibers 10 and/or the color-changing yarns 100 and/or (ii) the securing thread 914 may be chosen to provide desired color changing performance. Firstly, the thicker the coating 14 is, the more absorption of the color changing pigment and the stronger the color will appear. Secondly, for a given stitch length of the securing thread 914, (i) a larger diameter color-changing fiber 10 and/or color-changing yarn 100 and/or (ii) a smaller diameter securing thread 914 will result in less total area covered by the securing thread 914, which may be selected to maximize the strength of the color and the contrast in the color change.

The applications of embroidery is vast. For example, the color-changing fibers 10 may 10 may embroidered in a pattern onto traditional fabric that can then be cut and sewn into a finished product. The embroidered pattern may include one long color changing fiber 10 with two electrical leads for the positive and negative terminals (e.g., for connection to a battery pack, etc.). In this case, the entire pattern will change color all at once when a sufficient current is applied thereto. Alternatively, the pattern can be broken up electrically into sub-segments.

As one example, the word "HI" can be embroidered all with one length of fiber. The entire word "HI" would therefore change color when a sufficient current is applied. Conversely, the letters of the word "HI" can be broken up into separate segments with separate electrical positive/negative leads for each letter. Thus, the "H" can change color on its own and likewise for the "I." Furthermore, each letter could be broken up into sub-segments such that the top half or left half of the "H" can have separate electrical leads so that the top half or left half can change color separately from the bottom half or right half, respectively.

As another example, the color-changing fibers 10 may be used to form an embroidered image such as a flower that includes petals that are electrically isolated to change color separately from the stem. Or, furthermore, individual petals could be made to change color separately from the other petals. For example, the colors of the stem or individual petals in an embroidered flower pattern can be different fibers having different colors. The stem could be made of fibers that change from green to white, for example, while the petals could be made of different fibers that change from purple to red or red to white, to name one example.

As yet another example, the color-changing fibers 10 may be embroidered into a fabric as a multi-segment display (e.g., having between two and twenty or more segments). The multi-segment display may be used to variably display numbers and/or letters in a series to form various numbers or words (e.g., like a digital clock or calculator). Each segment may include separate electrical leads that each can be activated individually. By activating specific segments out of the multi-segment display, any number between zero and nine can be displayed and/or various letters.

Electrical Connections

Connecting each of the color-changing fibers 10 of a respective color-changing fabric 300 or a respective color-changing product 400 to a power source (e.g., the power supply 320, the power supply 620, etc.) and/or control circuitry (e.g., the controller 310, the controller 610, etc.) can range from being a relatively simple process to a relatively complicated process depending on the desired performance or color-changing capabilities of the respective color-changing fabric 300 and/or the respective color-changing product 400.

By way of example, if a uniform color change for the entire area of the color-changing fabric 300 or the color-changing product 400 that comprises the color-changing fiber 10 is desired, the electrical connections to the color-changing fibers 10 and/or the color-changing yarns 100 may be simplified to a two position connector. More specifically, for a single, uniform color changing application, Applicant has devised a procedure in which: (i) the coating 14 is stripped from the conductive cores 12 on each end of the color-changing fabric 300 (e.g., by selective dissolution, etc.), (ii) the exposed conductive cores 12 along each side of the color-changing fabric 300 are coupled together (e.g., by soldering, by ultrasonic welding, etc.) en masse, and (iii) each of the connected ends of the color-changing fabric 300 is electrically connected to a respective electrical node, which is then coupled to the power source, forming a closed loop.

Figure 22A:
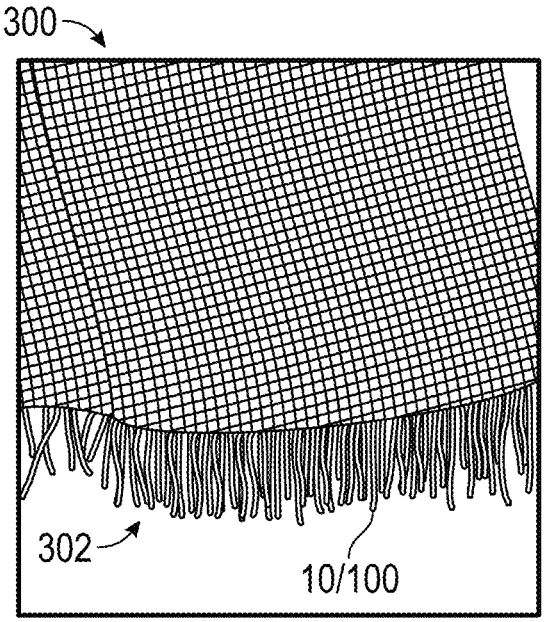
FIG. 22A-22D visually depict a process of electrically connecting color-changing fibers to a power source, according to an exemplary embodiment.
Figure 22B:
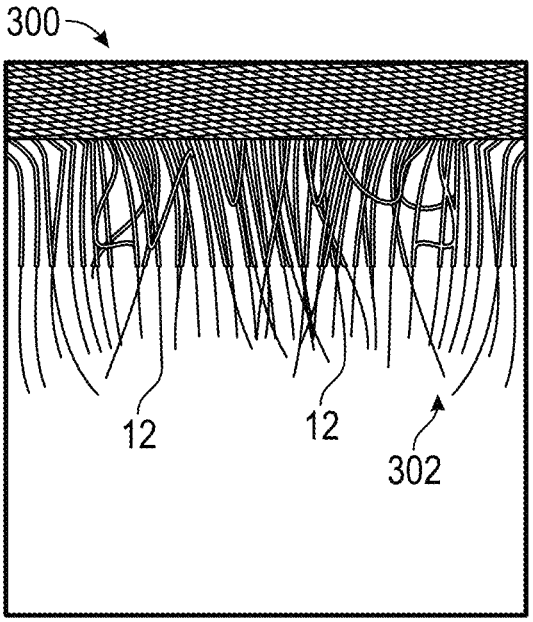
Figure 22C:
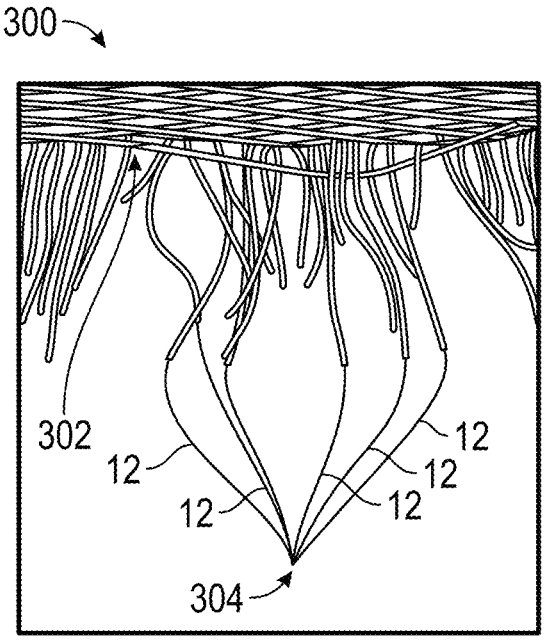
Figure 22D:
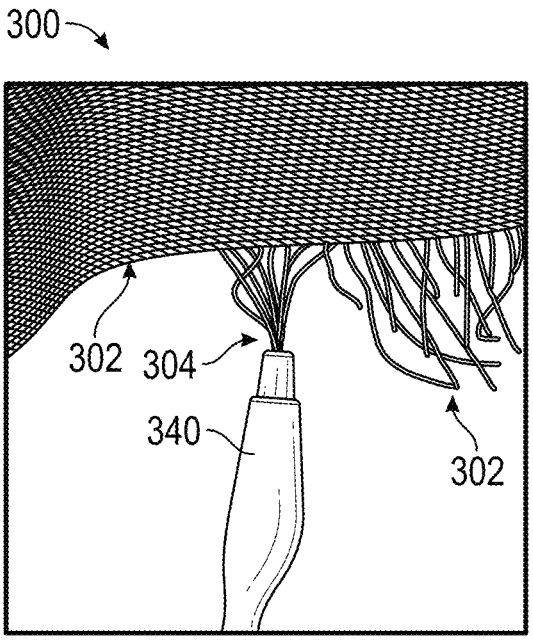

Whereas a more complex pattern or control scheme for color changing may necessitate connecting and addressing the color-changing fibers 10 and/or the color-changing yarns 100 individually or grouping them together. As shown in FIG. 22A, edges 302 of the color-changing fabric 300 may have loose ends of color-changing fibers 10 and/or color-changing yarns 100 extending therefrom. As shown in FIG. 22B, the coating 14 may be selectively removed from the ends of the color-changing fibers 10 and/or the color-changing yarns 100 to expose the conductive cores 12 thereof. The removal of the coating 14 from the loose ends of the color-changing fibers 10 and/or the color-changing yarns 100 may be performed using a chemical removal process (e.g., dissolving the coating 14 in a solution, etc.), a mechanical removal process (e.g., mechanically stripping the coating 14 therefrom, etc.), and/or still another suitable removal process. As shown in FIGS. 22C and 22D, ends of selected conductive cores 12 may be grouped and connected together. By way of example, the grouped ends may be soldered together. By way of another example, the ends may be joined using an ultrasonic welding process. For example, an ultrasonic welding system may connect a first plurality of conductive cores 12 along a preselected distance (e.g., 0.1 inches, 0.25 inches, 0.5 inches, 1 inch, 1.5 inches, 2 inches, 4 inches, 6 inches, 1 foot, etc.) of the edge 302, move or index the color-changing fabric 300 the preselected distance (e.g., via a conveyor, etc.), connect a second plurality of conductive cores 12 along the preselected distance of the edge 302, and so on. As shown in FIG. 22D, the grouped ends, shown as groupings 304, may then each be connected to the power source and/or the control system via a connector, shown as electrical connector 340.

Figure 23:
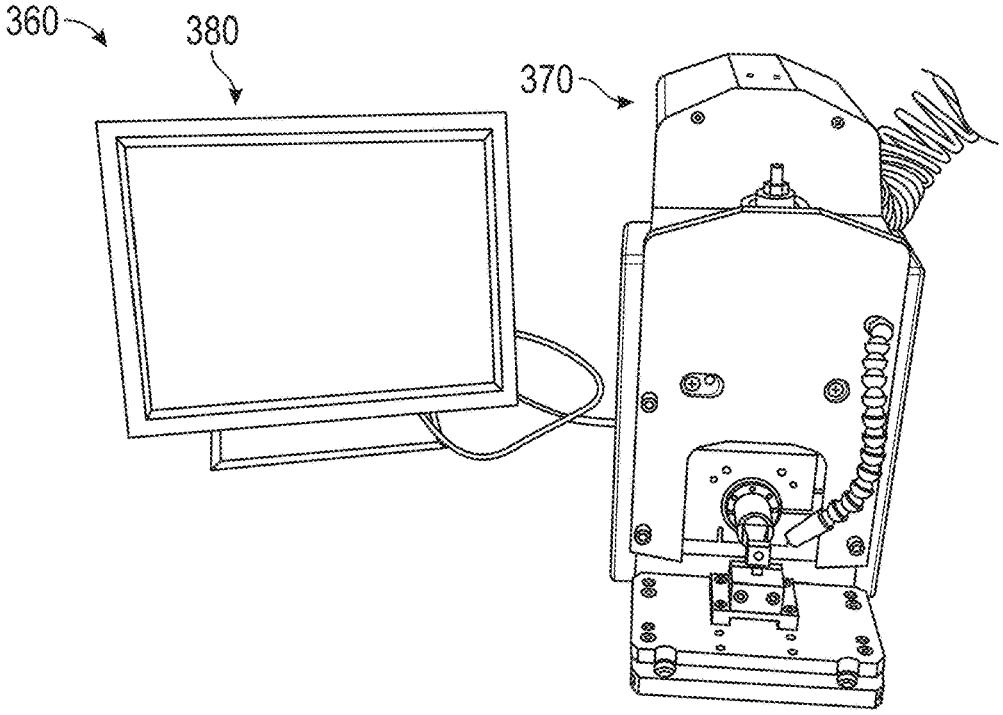
FIG. 23 is a perspective view of an electrical connectorization system, according to an exemplary embodiment.
Figure 24:
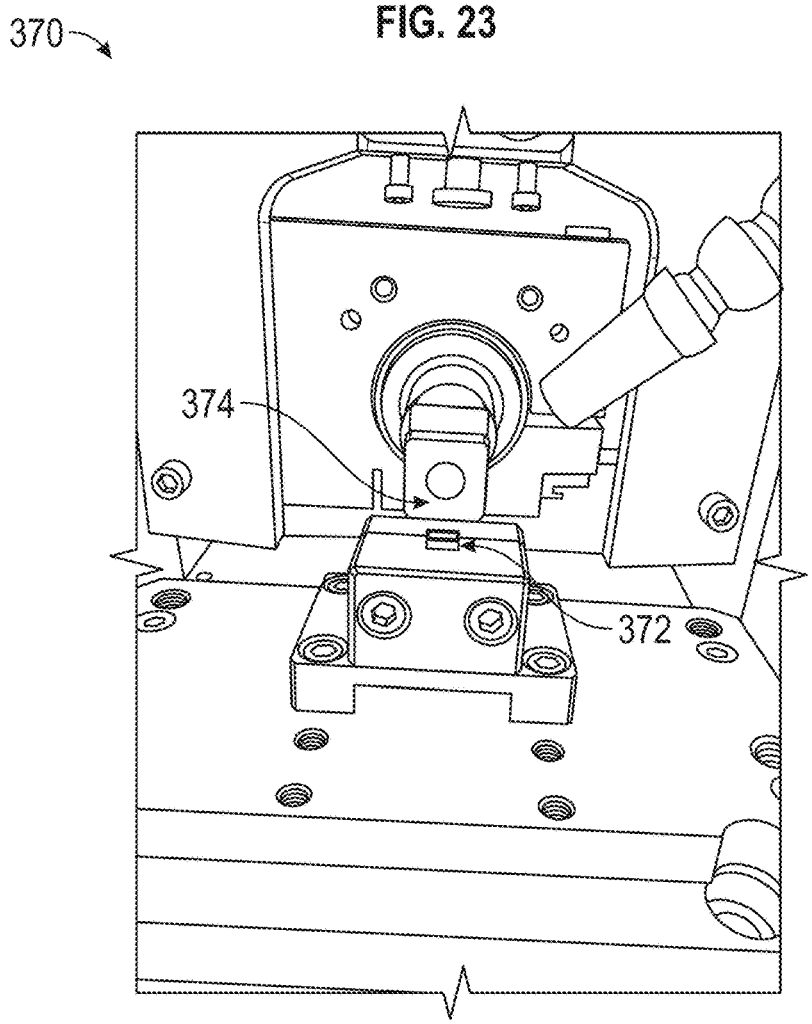
FIG. 24 is a detailed view of an electrical connectorization device of the electrical connectorization system of FIG. 23, according to an exemplary embodiment.

As shown in FIGS. 23 and 24, a first electrical connectorization system, shown as connectorization system 360, includes an electrical connectorization device, shown as ultrasonic welder 370, and a control system, shown as controller 380, configured to control various operating parameters of the ultrasonic welder 370 to facilitate electrically connecting the color-changing fibers 10 and/or the color-changing yarns 100 of the color-changing fabric 300 and/or the color-changing product 400 together. As shown in FIG. 24, the ultrasonic welder 370 includes a base, shown as anvil 372, and a head, shown as horn 374, positioned to align with the anvil 372. In some embodiments, the anvil 372 and/or the horn 374 are smooth. In some embodiments, the anvil 372 and/or the horn 374 are knurled. In such embodiments, the anvil 372 and/or the horn 374 may have pyramid-like shapes on the surface thereof with various possible sizes and/or pitches.

According to an exemplary embodiment, the ultrasonic welder 370 is configured to manipulate the horn 374 such that the horn 374 applies pressure to and oscillates relative to the anvil 372 to form a bond between (i) one or more bus wires (e.g., the bus wires 392, etc.) and/or bus foil (e.g., the bus foil 396, etc.) and (ii) the conductive cores 12 of the color-changing fibers 10 and/or the color-changing yarns 100 of the color-changing fabric 300 and/or the color-changing product 400. According to an exemplary embodiment, the ultrasonic welder 370 is capable of oscillating the horn 374 at a frequency up to 40 kilohertz ("kHz") with an amplitude up to 30 micrometers ("μm"). In other embodiments, the ultrasonic welder 370 is capable of oscillating the horn 374 at a frequency greater than 40 kHz with an amplitude up to greater than 30 μm. According to an exemplary embodiment, the controller 380 is configured to control the pressure applied by the horn 374, the oscillation frequency of the horn 374, and the amplitude of the oscillations of the horn 374 to provide a desired amount of energy dissipation to form a desirable ultrasonic weld or connection between (i) the conductive cores 12 of the color-changing fibers 10 and/or the color-changing yarns 100 of the color-changing fabric 300 and/or the color-changing product 400 and (ii) the bus wires and/or the bus foil.

Figure 25:
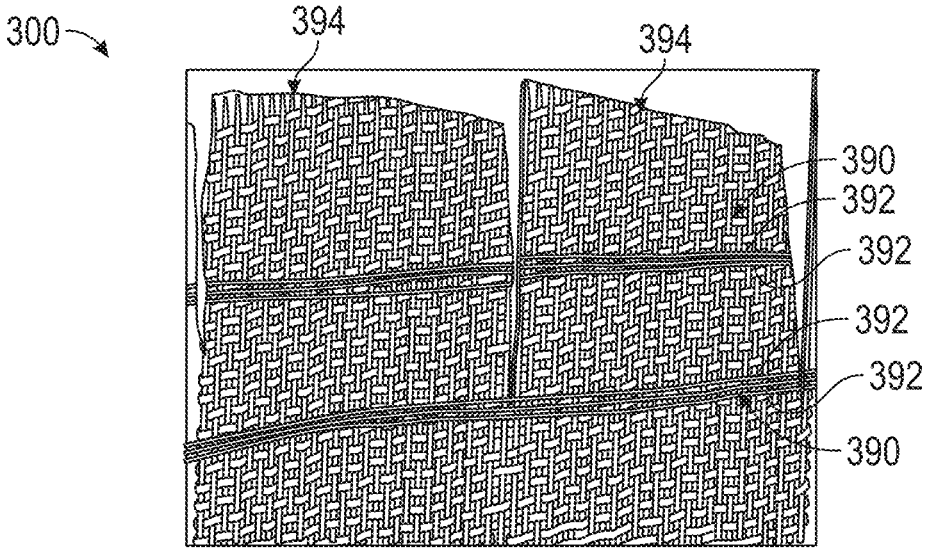
FIGS. 25-27 are various views of a fabric having the fibers thereof electrically connected via the electrical connectorization system of FIG. 23, according to an exemplary embodiment.
Figure 26:
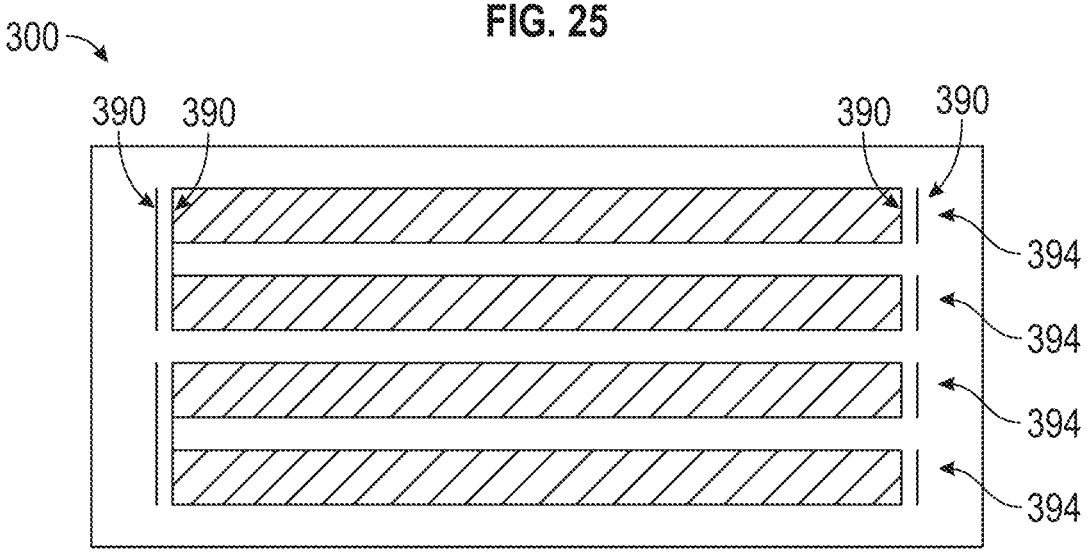
Figure 27:
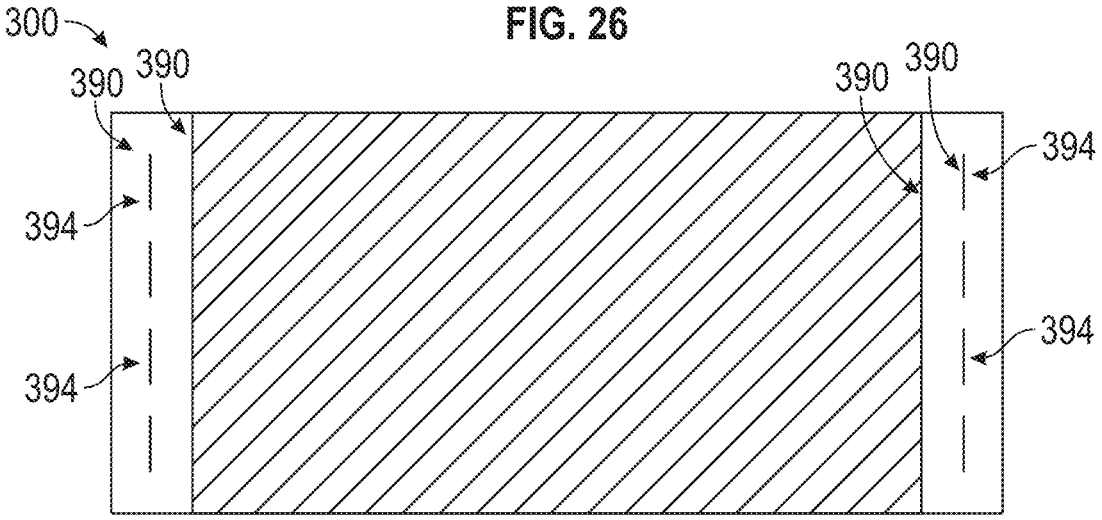

As shown in FIGS. 25-27, the color-changing fabric 300 has been processed by the ultrasonic welder 370 of the connectorization system 360 to generate ultrasonic welds, shown as welds 390, along the ends of the color-changing fabric 300. According to the exemplary embodiment shown in FIGS. 25-27, the color-changing fabric 300 includes a plurality of the welds 390 (e.g., two, three, etc.) positioned at each end of the color-changing fabric 300 that are spaced apart from one another. In other embodiments, the color-changing fabric 300 includes a single weld 390 positioned at each end of the color-changing fabric 300. As shown in FIG. 25, each of the welds 390 includes a plurality of bus wires (e.g., two, three, four, etc. bus wires), shown as bus wires 392. In other embodiments, each of the welds 390 includes a single bus wire 392.

According to an exemplary embodiment, connections between the conductive cores 12 of the color-changing fibers 10 and/or the color-changing yarns 100 of the color-changing fabric 300 and/or the color-changing product 400 using a plurality of the bus wires 392 per weld 390 and/or by applying a plurality of the welds 390 increases the connections therebetween. By way of example, the color-changing fabric 300 and/or the color-changing product 400 may have (i) the color-changing fibers 10 and/or the color-changing yarns 100 extending in a first direction (e.g., a warp direction, a weft direction, etc.) and (ii) non-color-changing fibers or yarns extending in a second direction (e.g., a perpendicular direction, a weft direction, a warp direction, etc.). The bus wires 392 may be applied in a direction perpendicular to the first direction and parallel with the second direction. As such, in some positions, one of the bus wires 392 and/or the welds 390 may overlap the non-color-changing fibers or yarns, preventing connection between a conductive core 12 and the respective bus wire 392 or the respective weld 390. Therefore, by applying multiple welds 390 and/or multiple bus wires 392 per weld 390, the percentage of successful bonds between the weld 390 and the conductive cores 12 is maximized.

As shown in FIG. 27, each end of the color-changing fabric 300 includes a first weld 390 that extends continuously across the width thereof. The first welds 390 may facilitate activating all of the color-changing fibers 10 and/or the color-changing yarns 100 to change the color of the entire color-changing fabric 300 from a first color to a second color. As shown in FIG. 27, each end of the color-changing fabric 300 additionally includes a second weld 390 that includes a plurality of discrete weld portions, shown as discrete welds 394, having weld gaps therebetween. The discrete welds 394 of the second welds 390 may facilitate activating discrete portions of the color-changing fibers 10 and/or the color-changing yarns 100 to change the color of the discrete portions of color-changing fabric 300 from a first color to a second color, while the other portions remain the first color (e.g., providing a striped pattern, etc.). In some embodiments, the discrete welds 394 are connected together by one or more linking bus wires such that all of the discrete welds 394 are activated simultaneously. In some embodiments, the one or more linking bus wires are the same wires at the bus wires 392 (e.g., portions of the bus wires 392 are skipped and not welded during the ultrasonic welding of the bus wires 392, etc.). In some embodiments, the one or more linking bus wires are different wires than the bus wires 392 (e.g., the linking bus wires are connected to the discrete welds 394 following the ultrasonic welding process, etc.). In some embodiments, the discrete welds 394 are additionally or alternatively independently activatable (e.g., to facilitate providing a dynamic pattern, etc.). By way of example, each of the discrete welds 394 may include a lead wire connected thereto that is capable of being powered independently of the other lead wires. As shown in FIG. 26, the color-changing fabric 300 also includes a plurality of discrete welds 394, which, as shown, facilitates providing a striped pattern when the discrete welds 394 are activated (i.e., energized).

In some embodiments, the color-changing fabric 300 additionally or alternatively includes welds 390 that extend along other edges of the color-changing fabric 300 than shown in FIGS. 26 and 27. By way of example, the color-changing fabric 300 may have (i) the color-changing fibers 10 and/or the color-changing yarns 100 extending in a first direction (e.g., a warp direction, a weft direction, etc.) and/or (ii) the color-changing fibers 10 and/or the color-changing yarns 100 extending in a second direction (e.g., a perpendicular direction, a weft direction, a warp direction, etc.). Such an arrangement may facilitate providing different or more complex patterns and/or dynamic patterns (e.g., horizontal stripes, checkered, etc.).

Figure 74:
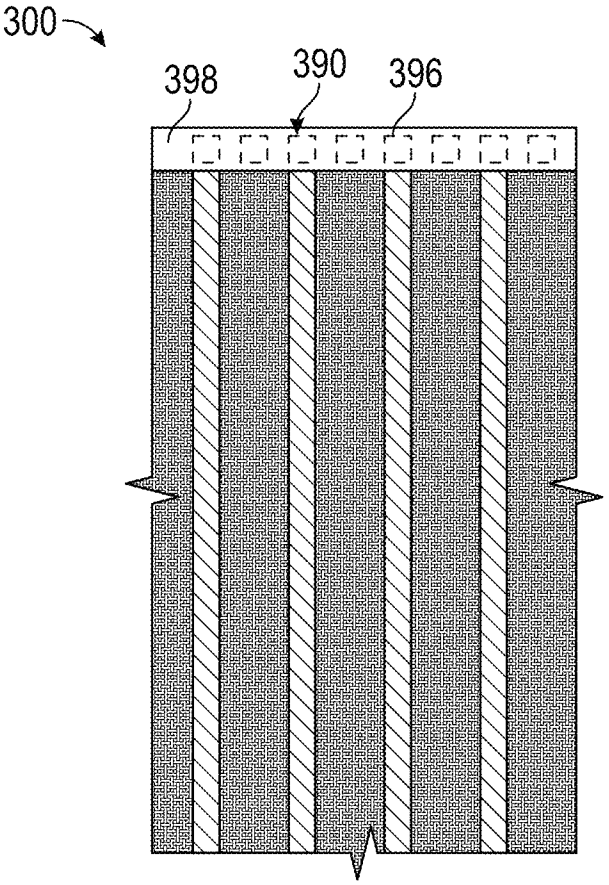
FIGS. 73 and 74 are various views of a fabric having the fibers thereof electrically connected via the electrical connectorization system of FIG. 23, according to another exemplary embodiment.
Figure 73:
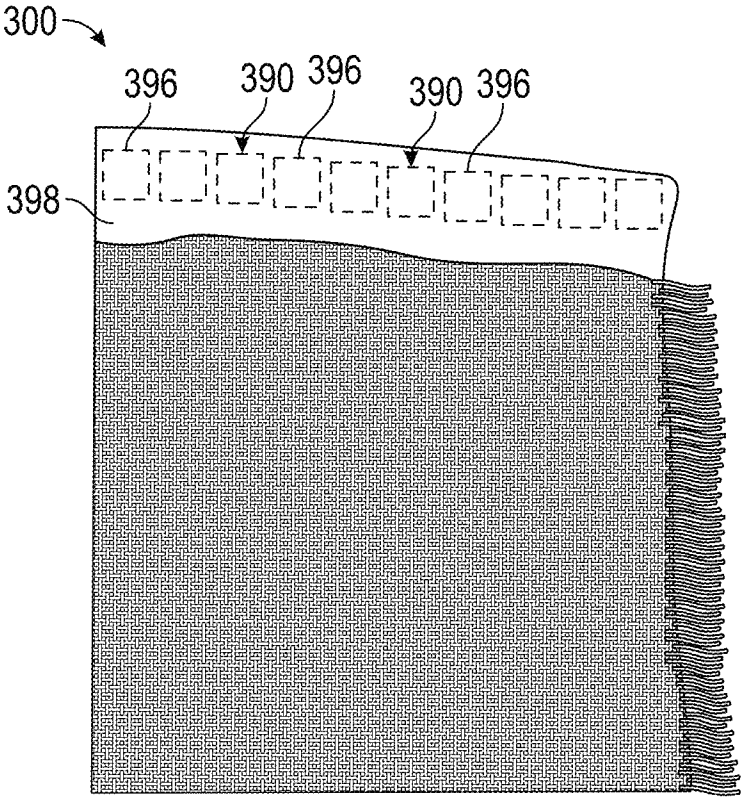

As shown in FIGS. 73 and 74, the color-changing fabric 300 has been processed by the ultrasonic welder 370 of the connectorization system 360 to generate the welds 390 along the ends of the color-changing fabric 300. Each of the welds 390 includes a connection bus, shown as bus foil 396. The bus foil 396 may be manufactured from a metallic material such as copper, aluminum, or another suitable metallic material for forming the welds 390. In some embodiments, the bus foil 396 is folded along the edge of the color-changing fabric 300 such that the bus foil 396 is positioned on the top and bottom of the color-changing fabric 300. In some embodiments, individual pieces of bus foil 396 are positioned on the top and bottom of the color-changing fabric 300 and aligned with one another. As shown in FIGS. 73 and 74, the color-changing fabric 300 includes a cover, shown fabric cover 398, positioned over the welds 390 and secured (e.g., glued, welded, stitched, etc.) along the edge of the color-changing fabric 300. The fabric cover 398 is positioned to protect and insulate the connections of the welds 390. As shown in FIG. 74, each of the bus foils 396 can be individually and selectively activated (e.g., provided an electrical current, etc.) to affect a color/pattern change in the color-changing fabric 300.

Figure 75:
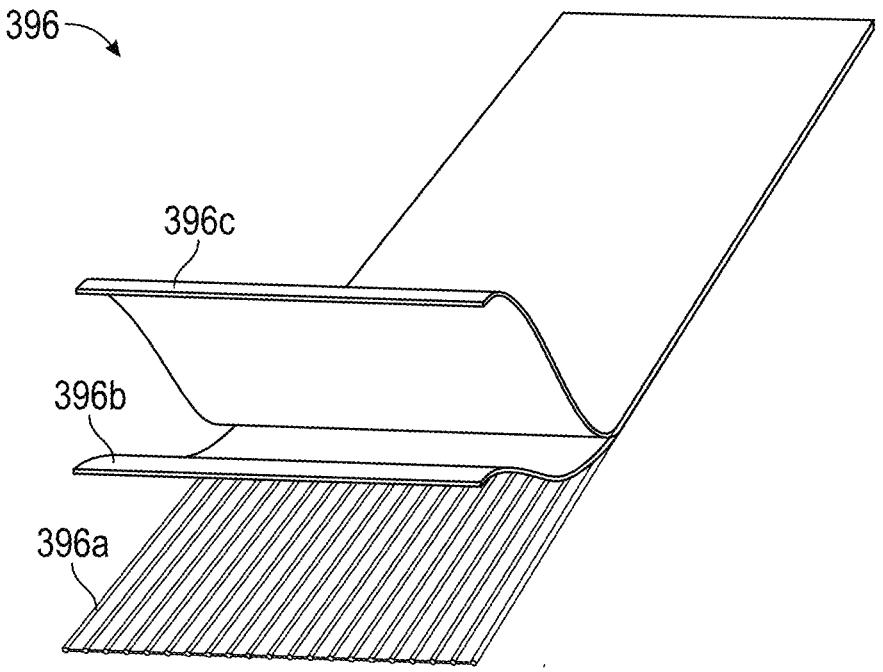
FIG. 75, is a perspective view of a multi-layer bus usable with an electrical connectorization system, according to an exemplary embodiment.

As shown in FIG. 75, the bus foil 396 is a multi-layer bus having a first, outer layer, shown as canvas layer 396*a*; a second, middle layer, shown as foil layer 396*b*; and a third, inner layer, shown as film layer 396*c*. The foil layer 396*b* may be manufactured from a metallic material such as copper, aluminum, or another suitable metallic material to perform the function described herein. The film layer 396*c* may be manufactured from a polycarbonate film or other suitable material to perform the function described herein. According to an exemplary embodiment, the canvas layer 396*a* is configured to increase friction between the horn 374 of the ultrasonic welder 370 and the materials below the canvas layer 396*a* such that energy from the vibration of the horn 374 can be efficiently transferred through the bus foil 396 to the color-changing fabric 300. Higher energy may therefore, be transferred to the conductive cores 12 during the welding process, which effectively clears away the coating 14 on the conductive cores 12 and removes any oxidation that may have formed on the surface of the conductive cores 12 providing an improved electrical connection. The foil layer 396*b* is configured to create an electrical contact that allows current to flow through the bus foils 396 and into the conductive cores 12 of the color-changing fabric 300. The film layer 396*c* is configured to soften during the ultrasonic welding process and act as an adhesive that reinforces the mechanical stability of the bus foil 396 on the color-changing fabric 300 and electrically isolates/insulates the weld from the surrounding environment. The multi-layer structure of the bus foil 396 may therefore, provide three main functions: (i) improved electrical connectorization, (ii) increased mechanical ruggedization, and (iii) electrical insulation.

Figure 76:
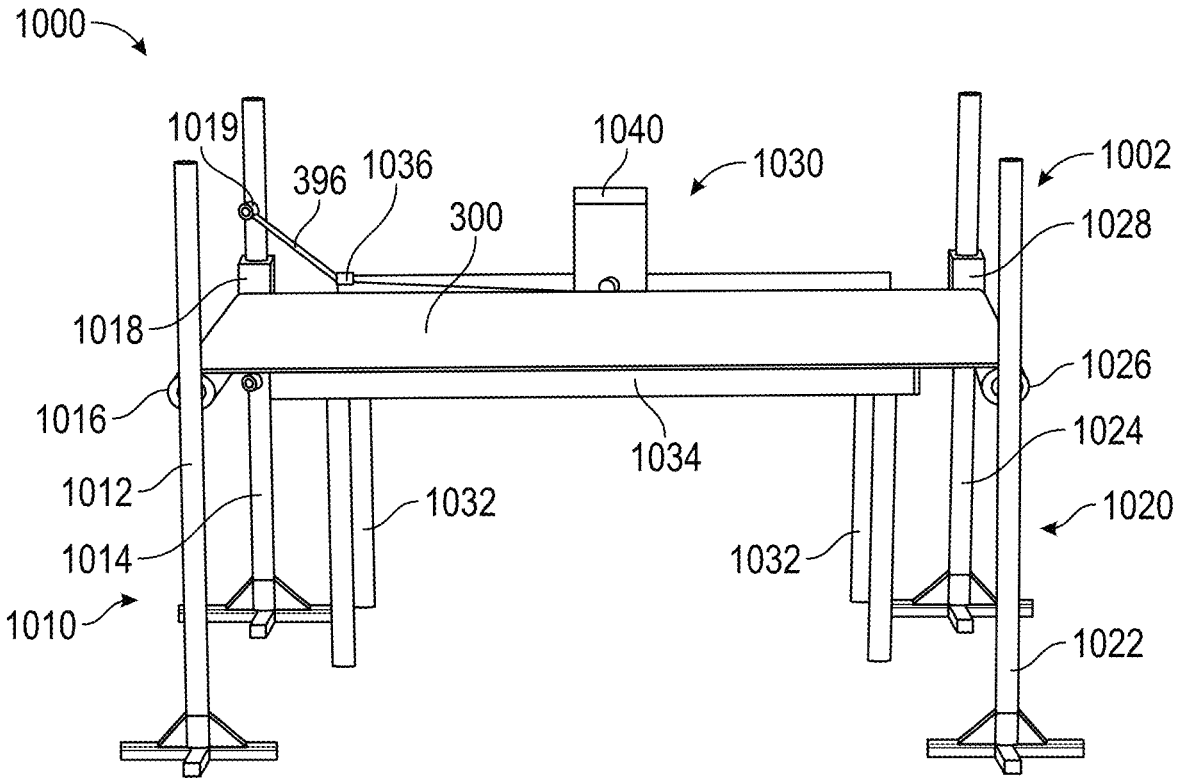
FIG. 76 is a front view of an electrical connectorization system, according to another exemplary embodiment.

While shown in FIGS. 73 and 74 as including a plurality of discrete and separate pieces of bus foil 396, in other embodiments, the color-changing fabric 300 includes a single, elongated piece of bus foil 396 to facilitate forming a continuous weld 390 along the edge thereof. As shown in FIG. 76, a second electrical connectorization system, shown as connectorization system 1000, includes a support frame, shown as frame assembly 1002, and an electrical connectorization device, shown as ultrasonic welder 1040. The frame assembly 1002 has a first support structure, shown as feed rack 1010, a second support structure, shown as intake rack 1020, and a third support structure, shown as platform 1030, positioned between the feed rack 1010 and the intake rack 1020. While shown as separate components, in some embodiments, the feed rack 1010, the intake rack 1020, and the platform 1030 are integrated into a single structure.

As shown in FIG. 76, the feed rack 1010 includes a first pair of supports, shown as feed support 1012 and feed support 1014, spaced from one another; a first roller, shown as feed roller 1016, extending between the feed support 1012 and the feed support 1014 and configured to secure a roll of the color-changing fabric 300 to the feed rack 1010; a first motor, shown as feed motor 1018, positioned to drive the feed roller 1016; and an interface, shown as bus interface 1019, extending from the feed support 1014, positioned above the feed roller 1016, and configured to receive a spool of the bus foil 396. In some embodiments, the feed rack 1010 does not include the feed motor 1018. As shown in FIG. 76, the intake rack 1020 includes a second pair of supports, shown as intake support 1022 and intake support 1024, spaced from one another; a second roller, shown as intake roller 1026, extending between the intake support 1022 and the intake support 1024 and configured to receive and roll/wind up the color-changing fabric 300 having the bus foil 396 secured thereto by the ultrasonic welder 1040; and a second motor, shown as intake motor 1028, positioned to drive the intake roller 1026.

Figure 77:
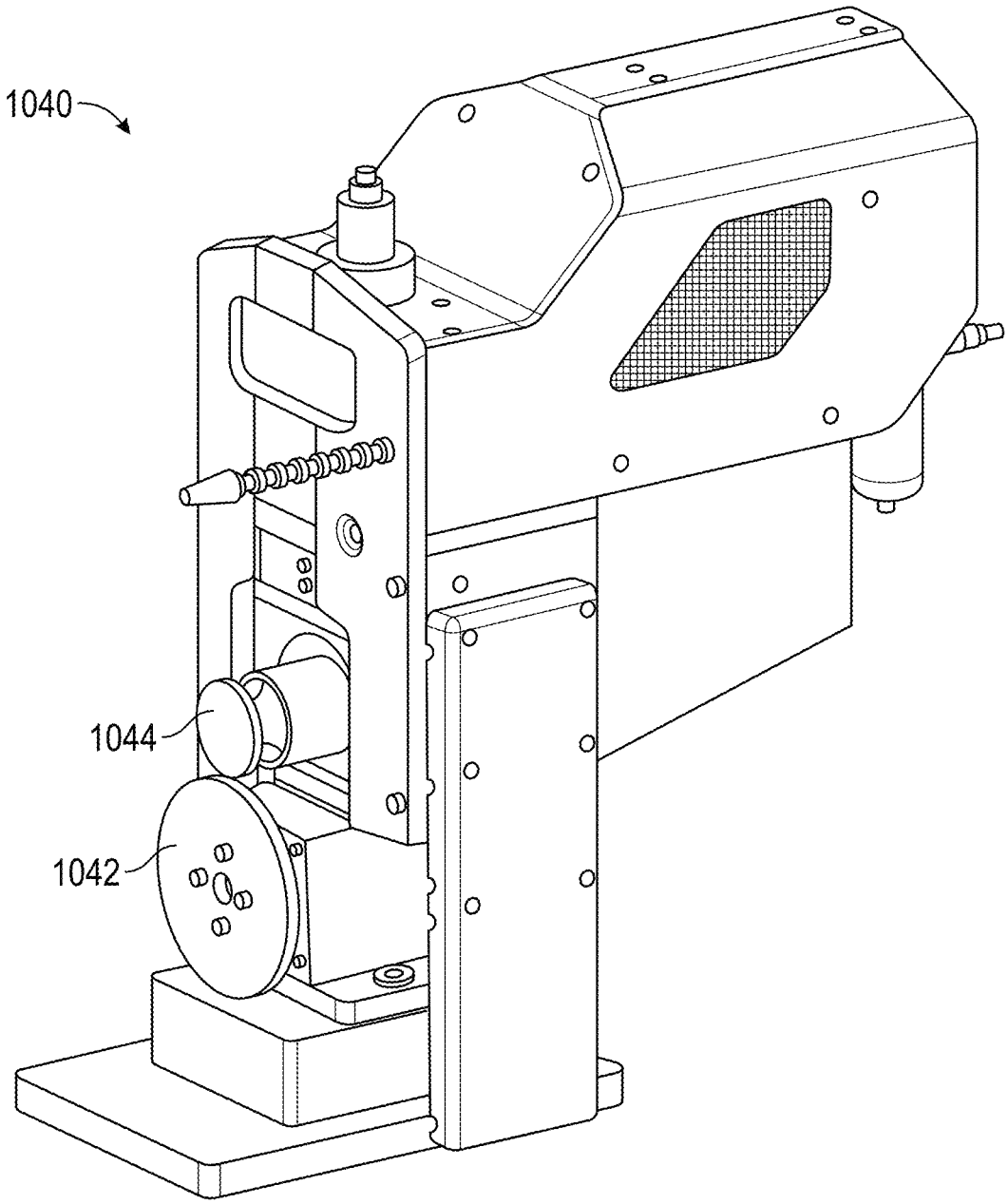
FIG. 77 is a perspective view of an electrical connectorization device of the electrical connectorization system of FIG. 76, according to an exemplary embodiment.

As shown in FIG. 76, the platform 1030 includes a plurality of legs, shown as legs 1032; a support surface, shown as welding surface 1034, coupled to the legs 1032 and that supports the color-changing fabric 300 and the ultrasonic welder 1040 during the welding process; and a guide, shown as bus guide 1036, coupled to the welding surface 1034 and positioned to receive and direct the bus foil 396 from the bus interface 1019 along the edge of the color-changing fabric 300 to be welded thereto by the ultrasonic welder 1040. According to an exemplary embodiment, the feed roller 1016, the intake roller 1026, and the welding surface 1034 are all positioned at a height such that the color-changing fabric 300 remains flat or horizontal through the welding region. As shown in FIG. 77, the ultrasonic welder 1040 includes a base, shown as anvil 1042, and a head, shown as horn 1044, aligned with the anvil 1042. According to the exemplary embodiment shown in FIG. 77, the anvil 1042 and the horn 1044 are cylindrical, circular plate, or disk shaped. In some embodiments, the anvil 1042 and/or the horn 1044 are smooth. In some embodiments, the anvil 1042 and/or the horn 1044 are knurled.

According to an exemplary embodiment, the ultrasonic welder 1040 is configured to manipulate the horn 1044 such that the horn 1044 applies pressure to and oscillates relative to the anvil 1042, while the anvil 1042 and the horn 1044 rotate relative to one another (e.g., in opposing rotational directions, etc.) to form a bond between (i) the bus foil 396 and (ii) the color-changing fabric 300 (as described above). According to an exemplary embodiment, the ultrasonic welder 1040 is capable of oscillating the horn 1044 at a frequency up to 40 kilohertz ("kHz") with an amplitude up to 30 micrometers ("μm") while providing a pressure of up to 60 pounds per square inch ("psi"). In other embodiments, the ultrasonic welder 1040 is capable of oscillating the horn 1044 at a frequency greater than 40 kHz with an amplitude up to greater than 30 μm and with a pressure greater than 60 psi.

According to an exemplary embodiment, the ultrasonic welder 1040 is positioned relative to or coupled to the welding surface 1034 such that the interface between the anvil 1042 and the horn 1044 is at the same level as the color-changing fabric 300 as the color-changing fabric 300 moves along the welding surface 1034 between the feed roller 1016 and the intake roller 1026. According to an exemplary embodiment, the feed motor 1018, the intake motor 1028, and/or the anvil 1042 and the horn 1044 are configured to cooperate to guide and push/pull the color-changing fabric 300 and the bus foil 396 from the feed roller 1016 and bus spool at the bus interface 1019, respectively, through the ultrasonic welder 1040 to the intake roller 1026 to provide the color-changing fabric 300 having the bus foil 396 welded thereto (e.g., a continuous weld along the edge of the color-changing fabric 300, etc.).

Further, in various embodiments, the arrangement of the color-changing fibers 10 and/or the color-changing yarns 100 of the color-changing fabric 300 and/or the color-changing product 400 and the arrangement of the welds 390 can facilitate providing much more complex patterns and/or dynamic patterns, as described in more detail herein. By way of example, the color-changing fabric 300 and/or the color-changing product 400 may have (i) the color-changing fibers 10 and/or the color-changing yarns 100 extending in a warp direction and/or a weft direction; (ii) multiple different color-changing fibers 10 and/or color-changing yarns 100 extending in a warp direction and/or a weft direction; (iii) patches that include the color-changing fibers 10 and/or the color-changing yarns 100 extending in a warp direction and/or a weft direction; and/or (iv) embroidered portions that includes the color-changing fibers 10 and/or the color-changing yarns 100. All such configurations can include complex weld patterns to allow for multiple different and/or complex color changing capabilities and patterns.

Figure 28:
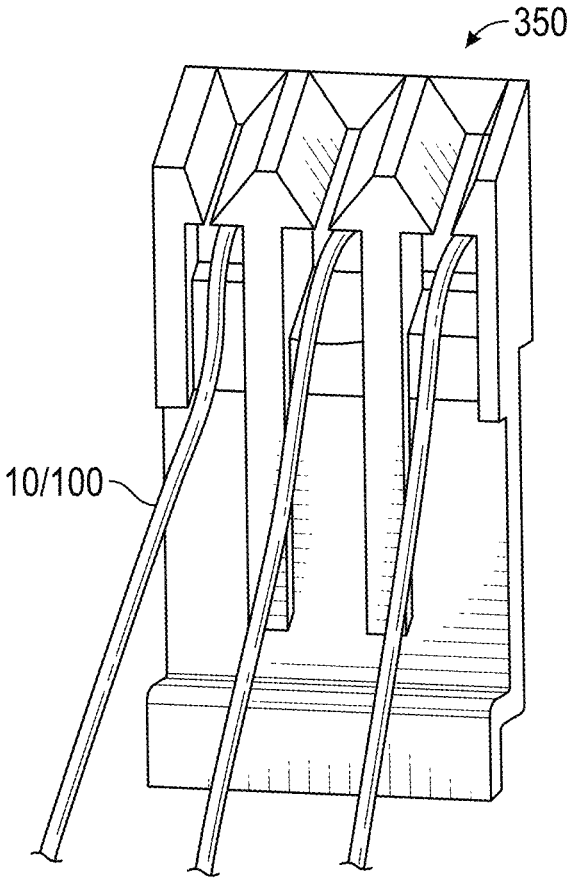
FIG. 28 is a perspective view of a connector, according to an exemplary embodiment.

For larger diameter color-changing fibers 10 and/or color-changing yarns 100 (e.g., which may be used in stationary fixtures, for conductive cores 12 that are between 22 AWG (i.e., 0.644 millimeters) and 36 AWG (i.e., 0.127 millimeters), an insulation displacement connector (IDC) fixture (e.g., a ribbon cable connector, etc.), shown as IDC 350 in FIG. 28, may be used to connect a plurality of the color-changing fibers 10 and/or the color-changing yarns 100 without the need to strip the coating 14 from the ends of the conductive cores 12. According to an exemplary embodiment, the IDC 350 facilitates coupling the color-changing fibers 10 and/or the color-changing yarns 100 to an external circuit (e.g., a power source, a controller, etc.). Care should be taken to connect the individual color-changing fibers 10 and/or color-changing yarns 100 to the IDC 350 in the proper order so that each of the color-changing fibers 10 and/or the color-changing yarns 100 has a known connector position at both the top and bottom of the color-changing fabric 300. If the proper order is maintained, each of the color-changing fibers 10 and/or the color-changing yarns 100 in the color-changing fabric 300 or other application (e.g., the color-changing product 400, etc.) may be individually activated.

Another strategy for connecting fibers to a plug individually is to remove the insulation of the fiber ends simultaneously using a chemical process (e.g., using chloroform, etc.), and then to tin the ends of the wires simultaneously using a solder pot. Next, the individually prepared fiber ends may be soldered to a connector or directly to a printed circuit board. With this method, care must be taken to ensure that the fibers are connected in a sequential order. It may be possible to design a fixture to secure individual fibers in the correct order before soldering them to a connector or a printed circuit board.

Another consideration is the nature of electrical connectivity across the color-changing fabric 300: whether to connect the color-changing fibers 10 and/or the color-changing yarns 100 together in a series pattern, a parallel pattern, or a combination of the two. The availability of metals and wires of varying electrical conductivity can be selected to adjust the resistance of any of these three configurations.

In order to properly drive the fabrics electrically, it is important to connect the conductive core 12 in each color-changing fiber 10 in such a way that the effective resistance is within a certain range that the power source (e.g., a battery pack, etc.) can operate with. For example, if a few hundred milliamps are required to run through each conductive core 12 to activate a color change, then the effective resistance needs to be the correct value so the current drawn based on the battery pack voltage is in the hundreds of milliamps range. If the conductive cores 12 include a higher-resistance material (e.g., nichrome, etc.), then connecting entire portions or "groups" of the color-changing fabric 300 in parallel may work to achieve the desired effective resistance. This is due to the fact that the effective resistance is lowered in an electrically parallel configuration. On the other hand, if the conductive cores 12 include a lower-resistance material (e.g., copper, etc.), a series-parallel configuration may be used to increase the effective resistance of the otherwise lower resistance material.

Figure 79:
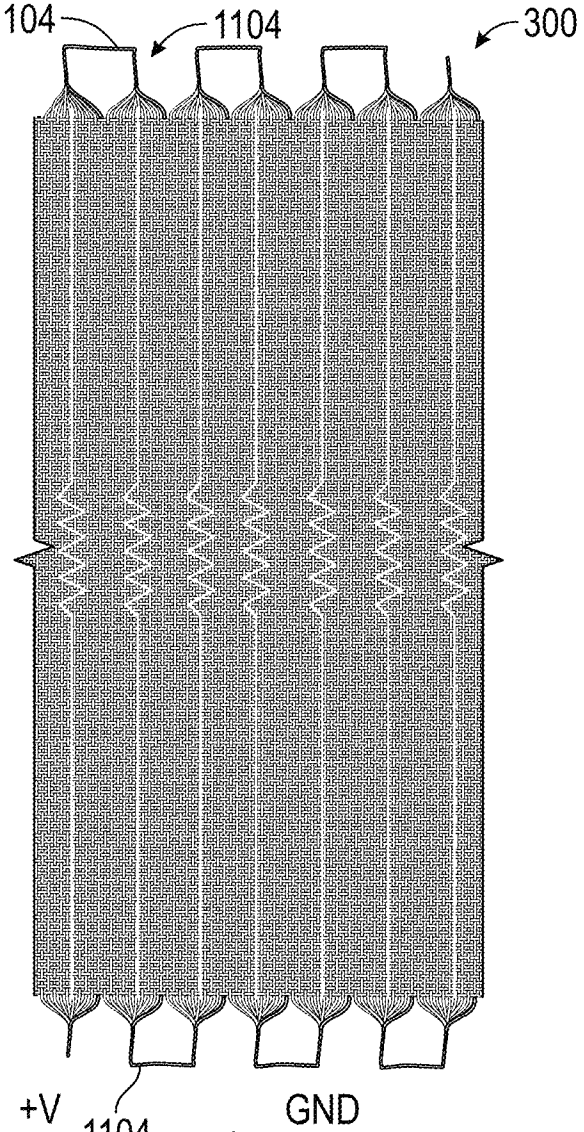
FIGS. 78-82 are various views of wiring arrangements for a color-changing fabric, according to various exemplary embodiments.
Figure 78:
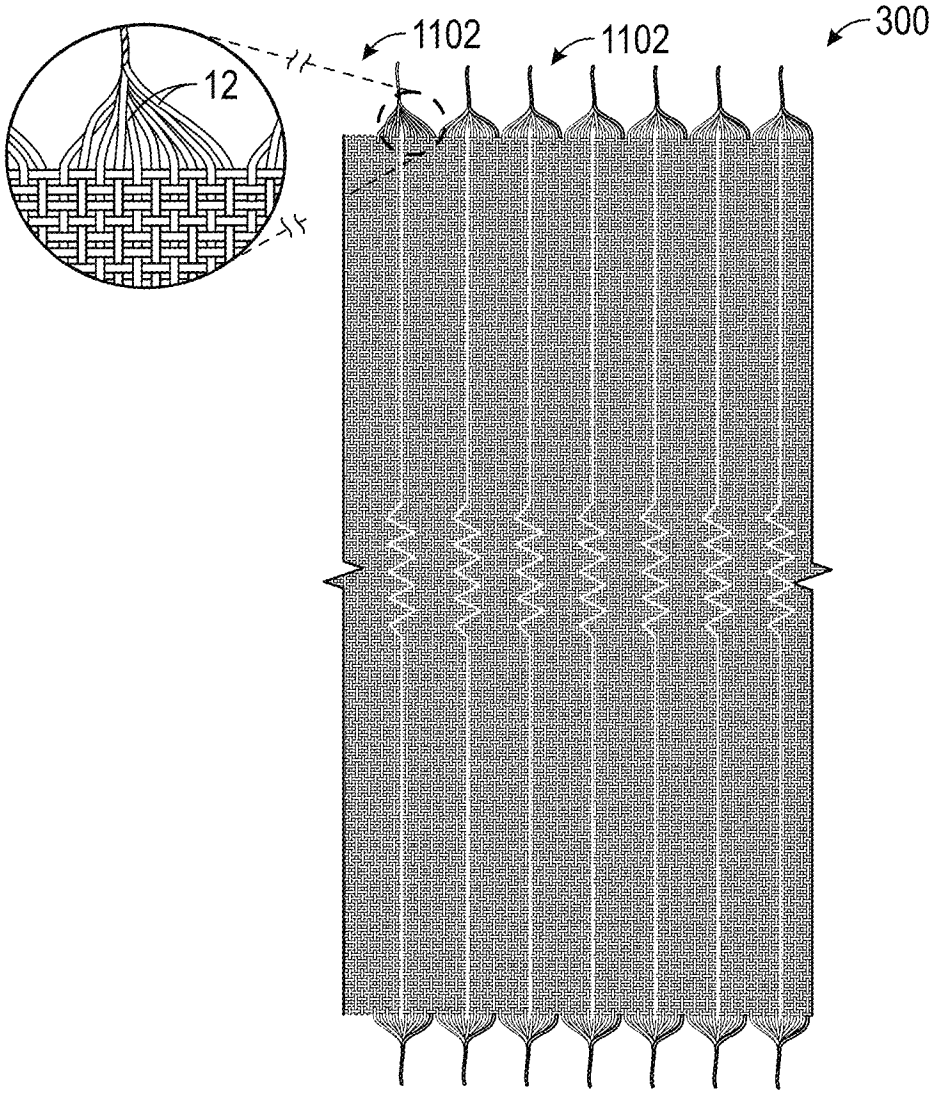
Figure 80:
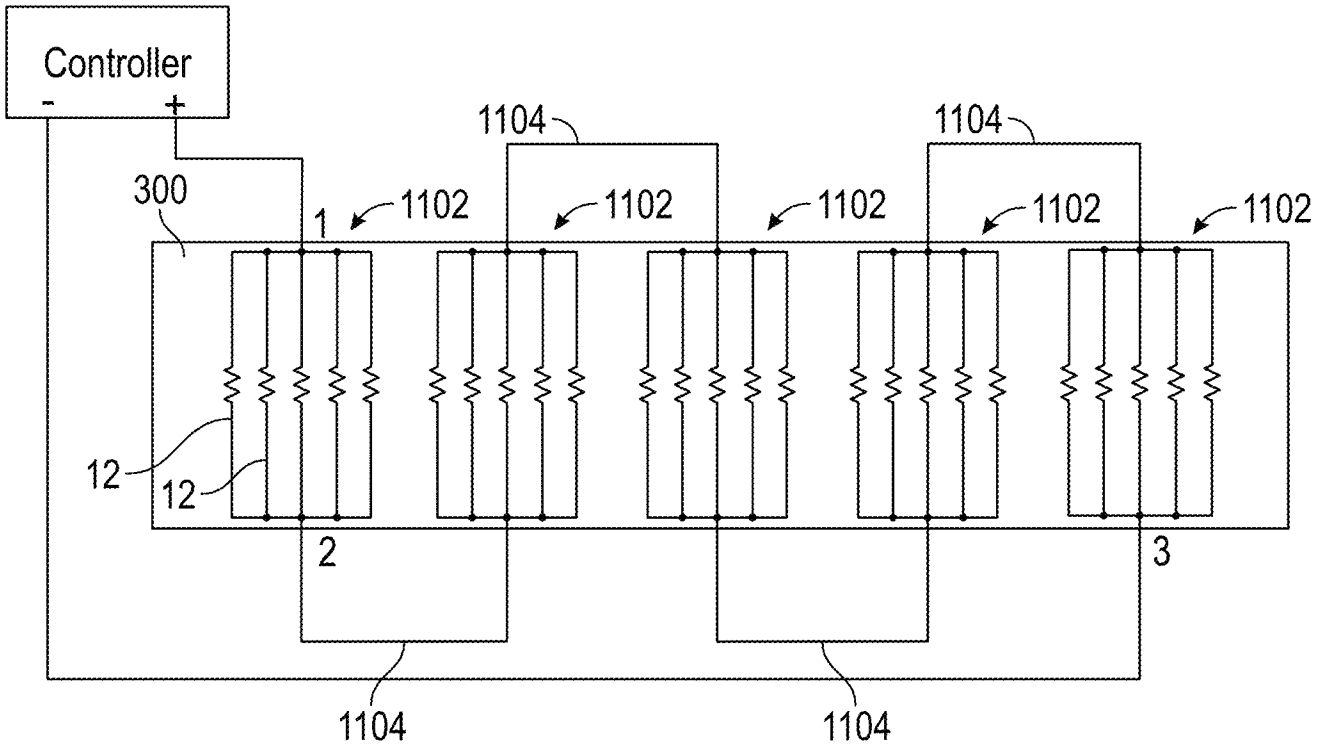

For example, as shown in FIG. 78, a color-changing fabric 300 has a plurality of groups 1102 of conductive cores 12, where the conductive cores 12 in each group 1102 are connected in a parallel configuration and each group 1102 can be individually activated. As another example, as shown in FIG. 79, the color-changing fabric 300 again has the plurality of groups 1102 of conductive cores 12, where the conductive cores 12 in each group 1102 are connected in parallel, however, adjacent groups 1102 are also connected in series in a serpentine fashion using connectors 1104 (e.g., a wire, a metal bus, etc.) to provide a series-parallel configuration. FIG. 80 provides a schematic representation of the color-changing fabric 300 of FIG. 79. A controller (e.g., a circuit board, etc.) is configured to provide current from a power source (e.g., a battery, etc.) to a first group 1102 at point 1, which includes a plurality (e.g., five, etc.) of conductive cores 12 connected in a parallel configuration. The current exits the first group 1102 at point 2, which is connected in series by the connector 1104 to the next group 1102 also including a plurality of conductive cores 12. This continues in a serpentine arrangement to the last group 1102, represented by point 3.

Figure 82:
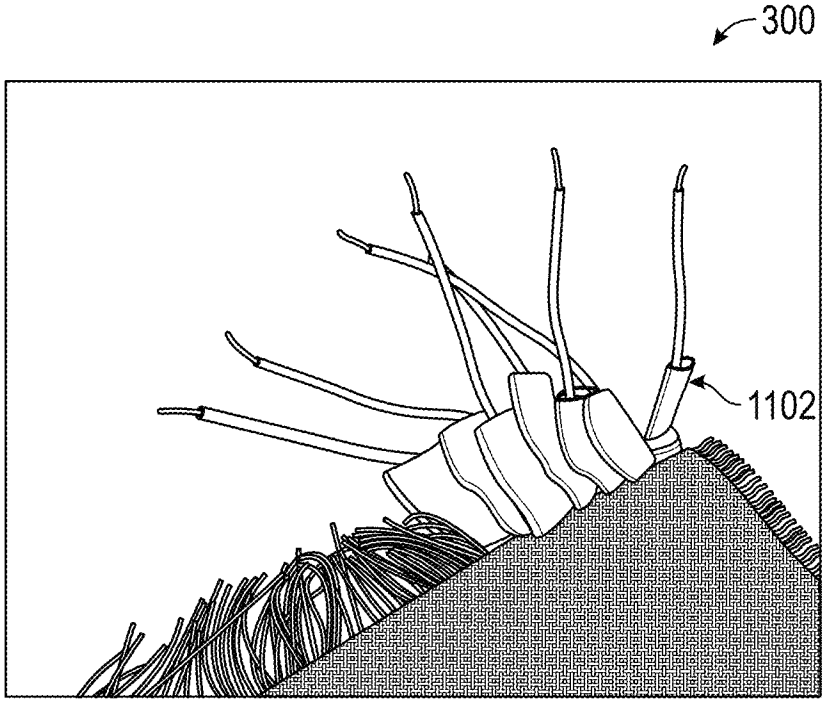
Figure 81:
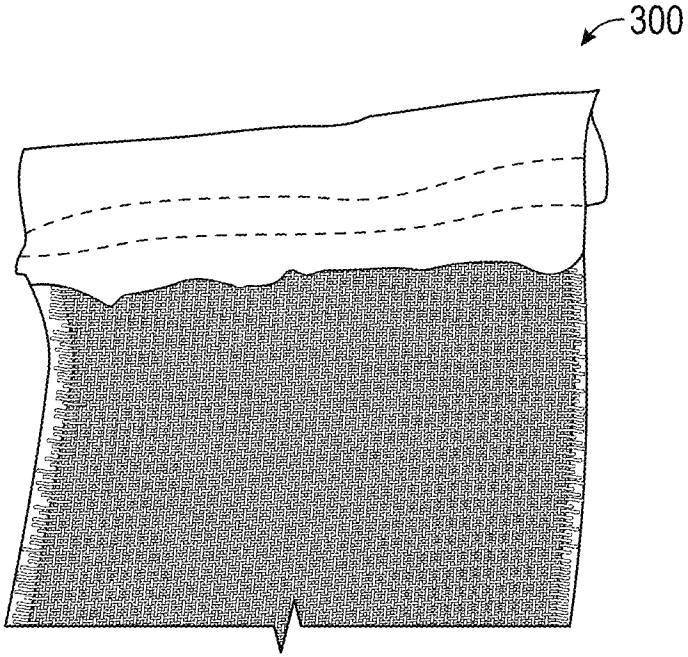

In the case where all the conductive cores 12 are connected in parallel, each conductive core 12 is connected together (e.g., using the bus wires 392, using the bus foil 396, etc.) on each end of the fabric and provides a connection point. The connection point at one end is used as a positive terminal and the connection point at the other end is used as a negative terminal. Such a color-changing fabric 300 is shown in FIG. 81. This color-changing fabric 300 would therefore provide a single color change throughout the entire color-changing fabric 300 when activated. To provide for different patterns within the color-changing fabric 300, the single, parallel connection can be severed and discrete parallel groups 1102 isolated/insulated from each other using a cutting/isolation process. Such a color-changing fabric 300 is shown in FIG. 82. Each of the discrete parallel groups 1102 can therefore be individually activated to provide greater color-changing capabilities. The discrete parallel groups 1102 can also be connected in a serpentine parallel-series configuration as described herein to increase the resistance as necessary.

In some embodiments, the connectorization system 360 includes a cutting/isolation apparatus that works alongside the ultrasonic welder 370. The cutting/isolation apparatus is configured to cut the bus wires 392 and/or the bus foil 396 at programmed intervals following their application to the color-changing fabric 300 by the ultrasonic welder 360 to provide the groups 1102 discussed above. The cutting/isolation apparatus may then apply an insulator (e.g., a cover, a coating, tape, a fabric piece, etc.) to each of the groups 1102 to electrically isolate the groups 1102 from each other.

Applications

According to an exemplary embodiment, the color-changing fibers 10, the color-changing yarns 100, and/or the color-changing fabrics 300 are capable of being incorporated into existing products (e.g., using embroidery, as a patch, etc.) and/or arranged to form new products (e.g., using weaving, knitting, etc.) with color-changing capabilities, i.e., the color-changing products 400. Various examples of the color-changing products 400 are shown in FIGS. 29-38. It should be understood that the color-changing products 400 shown in FIGS. 29-38 are examples of possible implementations of the color-changing fibers 10, the color-changing yarns 100, and/or the color-changing fabrics 300 and should not be considered as an exclusive or exhaustive representation of such implementations. Specifically, the uses of the color-changing fibers 10, the color-changing yarns 100, and/or the color-changing fabrics 300 are expansive and may be used in products such as apparel (e.g., headbands, wristbands, ties, bowties, shirts, jerseys, gloves, scarves, jackets, pants, shorts, dresses, skirts, blouses, footwear/shoes, belts, hats, etc.), accessories (e.g., purses, backpacks, luggage, wallets, jewelry, hair accessories, etc.), fixed installations, home goods, and décor (e.g., table cloths, blankets, bed sheets, pillow cases, curtains, window blinds/shades, rugs, carpet, wallpaper, wall art/paintings, sculptures, decorative elements, furniture and furniture accessories, automotive interiors, etc.), outdoor applications and equipment (e.g., tents, awnings, umbrellas, canopies, signage, etc.), camouflage, toys, games, novelty items, and/or still other suitable applications.

Figures 29, 30:
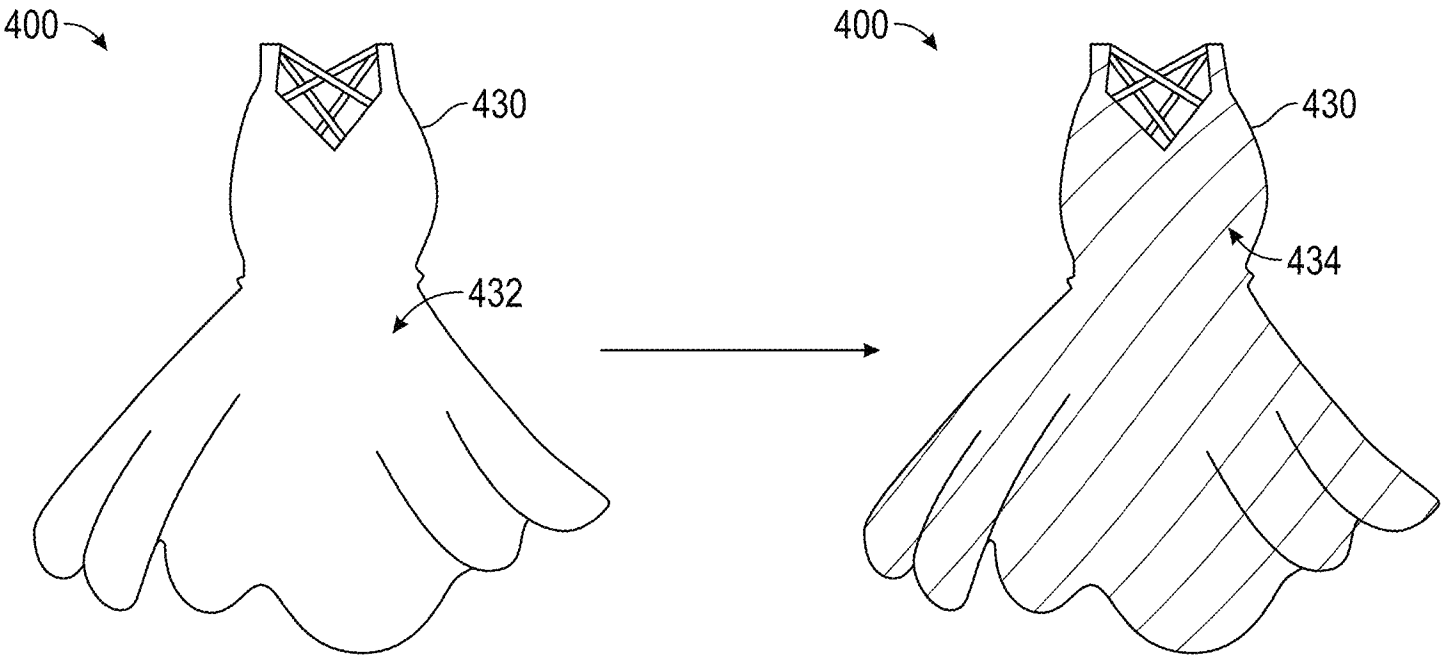
FIGS. 29 and 30 show a first color-changing product in a first state and a second state, according to an exemplary embodiment.

As shown in FIGS. 29 and 30, the color-changing product 400 is configured as a first product, shown as dress 430. As shown in FIG. 29, the dress 430 is in a first state (e.g., a first color, etc.), shown as first color state 432. As shown in FIG. 30, the dress 430 is transitioned into a second state (e.g., a second color, etc.), shown as second color state 434. According to an exemplary embodiment, the dress 430 is arranged entirely from the color-changing fibers 10 and/or the color-changing yarns 100 such that the entire dress 430 is capable of transitioning between the first color state 432 and the second color state 434. In other embodiments, only a portion of the dress 430 is configured to transition between the first color state 432 and the second color state 434 (e.g., at least a portion of the dress 430 includes non-color-changing fibers or yarns, etc.).

Figures 31, 32:
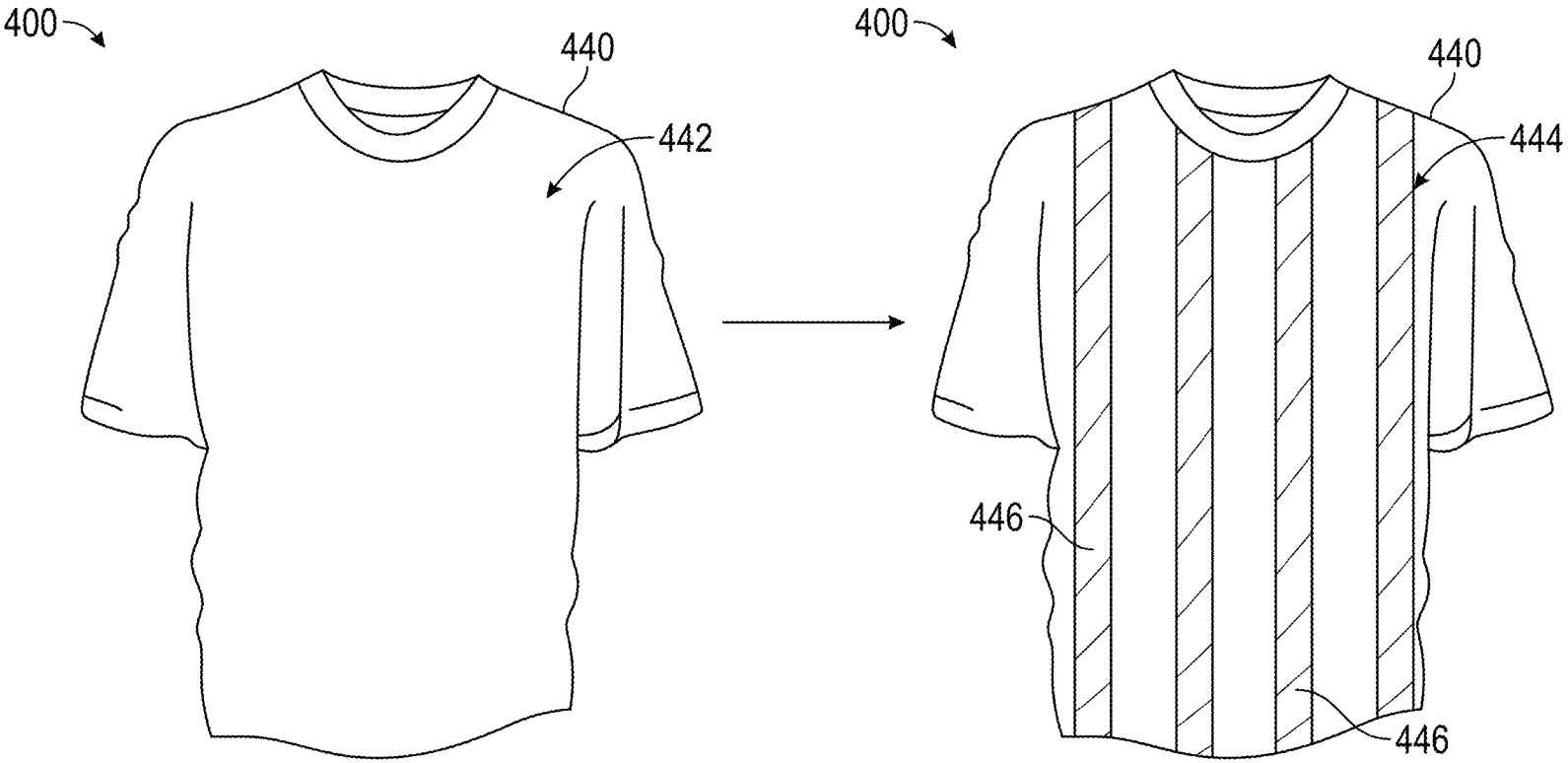
FIGS. 31 and 32 show a second color-changing product in a first state and a second state, according to an exemplary embodiment.

As shown in FIGS. 31 and 32, the color-changing product 400 is configured as a second product, shown as shirt 440. As shown in FIG. 31, the shirt 440 is in a first state, shown as first pattern state 442, where the shirt 440 lacks a pattern or is all the same color (e.g., a solid color, etc.). As shown in FIG. 32, the shirt 440 is transitioned into a second state, shown as second pattern state 444, where various portions or segments of the shirt 440 transition to a second color different than the remaining portions of the shirt 440. According to the embodiment shown in FIG. 32, the second pattern state 444 includes a plurality of vertical stripes 446 generated across the shirt 440. According to an exemplary embodiment, the portions of the shirt 440 that transition to selectively generate the vertical stripes 446 include the color-changing fibers 10 and/or the color-changing yarns 100. In other embodiments, the color-changing fibers 10 and/or the color-changing yarns 100 within the shirt 440 are arranged such that the second pattern state 444 additionally or alternatively provides a horizontal stripe pattern, a checkered pattern, a diagonal stripe pattern, a polka dot pattern, and/or another suitable pattern. In some embodiments, the shirt 440 is capable of selectively transitioning between a plurality of different patterns.

Figures 33, 34:
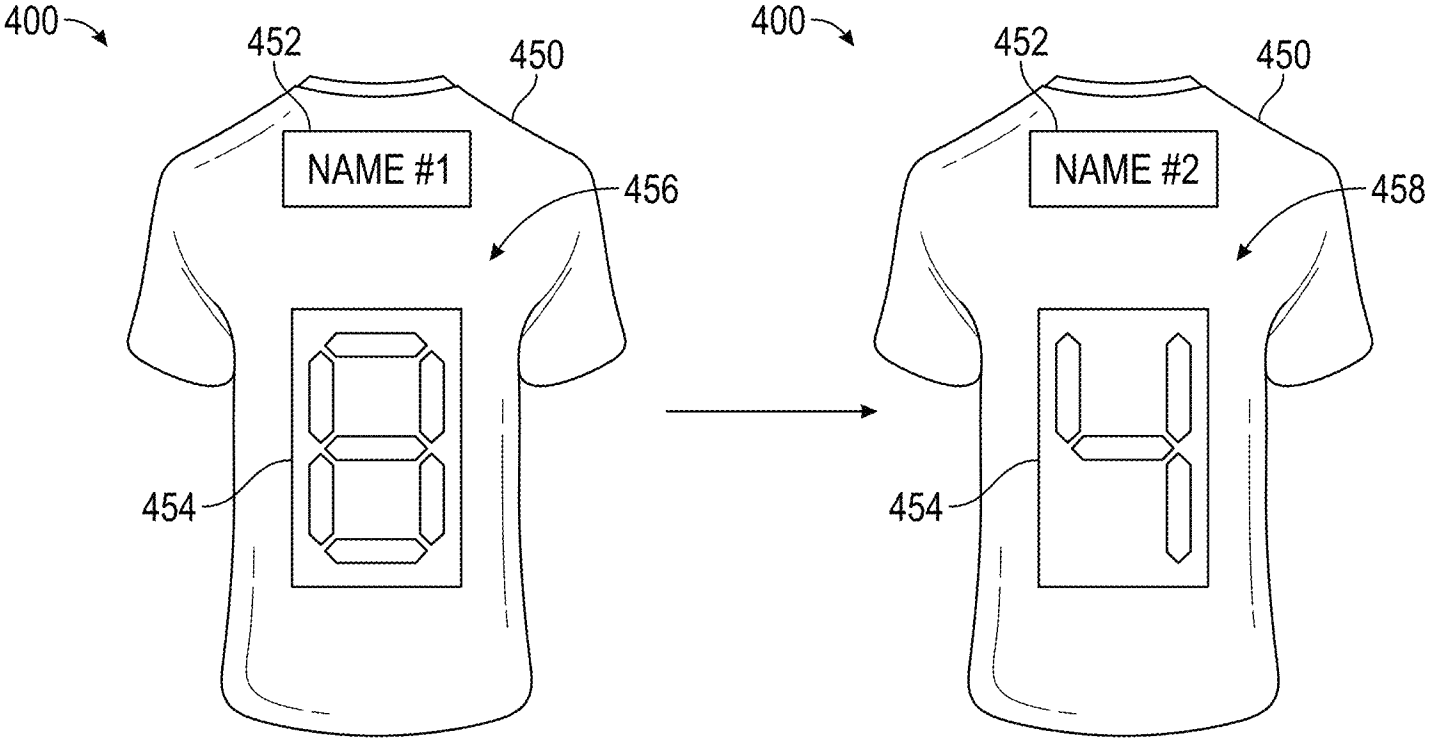
FIGS. 33 and 34 show a third color-changing product having a patch in a first state and a second state, according to an exemplary embodiment.

As shown in FIGS. 33 and 34, the color-changing product 400 is configured as a third product, shown as jersey 450. The jersey 450 includes a first patch, shown as name patch 452, and a second patch, shown as number patch 454, coupled (e.g., stitched, adhesively coupled, sewn, etc.) thereto. According to an exemplary embodiment, the name patch 452 and the number patch 454 include the color-changing fibers 10 and/or the color-changing yarns 100 integrated therein or embroidered thereto. According to an exemplary embodiment, the name patch 452 and the number patch 454 are couplable to the fabric or other material of a preexisting jersey (or other preexisting product) such that name patch 452 and the number patch 454 may therefore provide a "retrofit" solution to produce the color-changing products 400. In some embodiments, the jersey 450 does not include one of the name patch 452 or the number patch 454. In other embodiments, the name patch 452 and/or the number patch 454 are replaced with another type of patch (e.g., a logo patch, a sponsor patch, a team name patch, etc.). As shown in FIG. 33, the name patch 452 and the number patch 454 of the jersey 450 are in a first state, shown as first player state 456, where the color-changing fibers 10 and/or the color-changing yarns 100 thereof are selectively activated to display a first name and a first number associated with a first player in a different color than the remainder of the name patch 452 and the number patch 454. As shown in FIG. 34, the name patch 452 and the number patch 454 of the jersey 450 are transitioned into a second state, shown as second player state 458, where the color-changing fibers 10 and/or the color-changing yarns 100 thereof are selectively activated to display a second name and a second number associated with a second player in a different color than the remainder of the name patch 452 and the number patch 454. It should be understood that name and number are used as an example and should not be interpreted as being limiting. Patches including the color-changing fibers 10 and/or the color-changing yarns 100 may be configured (e.g., designed, arranged, etc.) to facilitate providing virtually any type of pattern, design, wording, numbers, etc. on the patch. In an alternative embodiment, the functionality of the name patch 452 and/or the number patch 454 is directly integrated into the jersey 450 by embroidering the color-changing fibers 10 and/or the color-changing yarns 100 directly into the jersey 450.

In some embodiments, a patch useable with the color-changing products 400 includes the photovoltaic fibers disclosed herein. The patch may exclusively include photovoltaic fibers, be incorporated into yarns that include the color-changing fibers 10, and/or be weaved or embroidered into a patch that also includes the color-changing fibers 10. Such photovoltaic fibers may be used to generate electrical energy from light energy to be stored in a power source and/or provided to the color-changing fiber 10.

Figure 35:
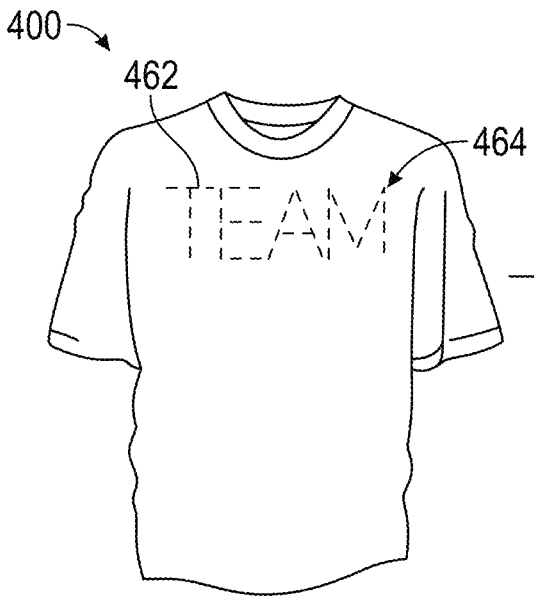
FIGS. 35 and 36 show a fourth color-changing product having an embroidered portion in a first state and a second state, according to an exemplary embodiment.
Figure 36:
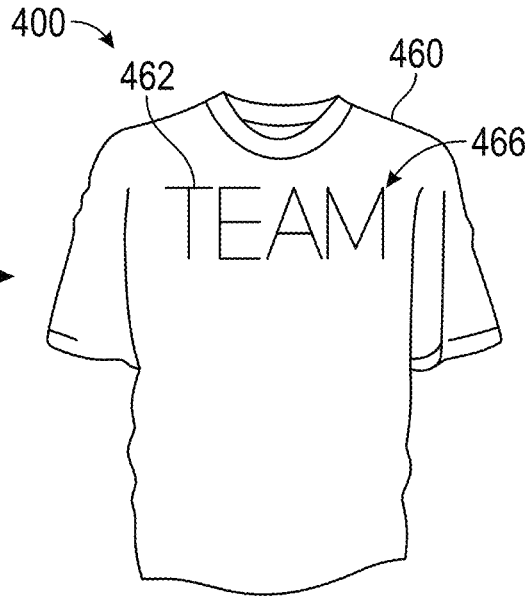

As shown in FIGS. 35 and 36, the color-changing product 400 is configured as a fourth product, shown as shirt 460. The shirt 460 includes an embroidered section, shown as embroidered portion 462. According to an exemplary embodiment, the embroidered portion 462 is formed by directly incorporating the color-changing fibers 10 and/or the color-changing yarns 100 into the fabric or other material of a preexisting shirt (e.g., a newly manufactured shirt, a used shirt, etc.) (or other preexisting product). The color-changing fibers 10 and/or the color-changing yarns 100 may therefore facilitate providing a "retrofit" solution to produce the color-changing products 400. As shown in FIG. 35, the embroidered portion 462 is in a first state, shown as first color state 464, where the color-changing fibers 10 and/or the color-changing yarns 100 thereof are selectively activated or deactivated to be a first color, a first set of colors, or have other first visual characteristics (e.g., a pattern, etc.). As shown in FIG. 36, the embroidered portion 462 is in a second state, shown as second color state 466, where the color-changing fibers 10 and/or the color-changing yarns 100 thereof are selectively activated or deactivated to be a second color, a second set of colors, or have other second visual characteristics different than the first color state 464. The embroidered portion 462 may include patterns, logos, sports team names, sponsor names, player names, player numbers, etc.

Figure 37:
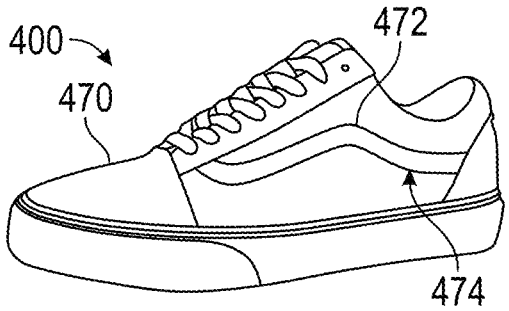
FIGS. 37 and 38 show a fifth color-changing product having an embroidered portion in a first state and a second state, according to an exemplary embodiment.
Figure 38:
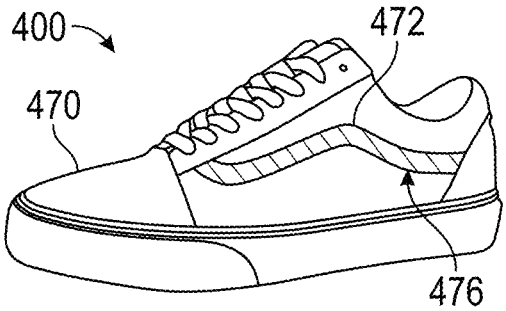
Figure 39:
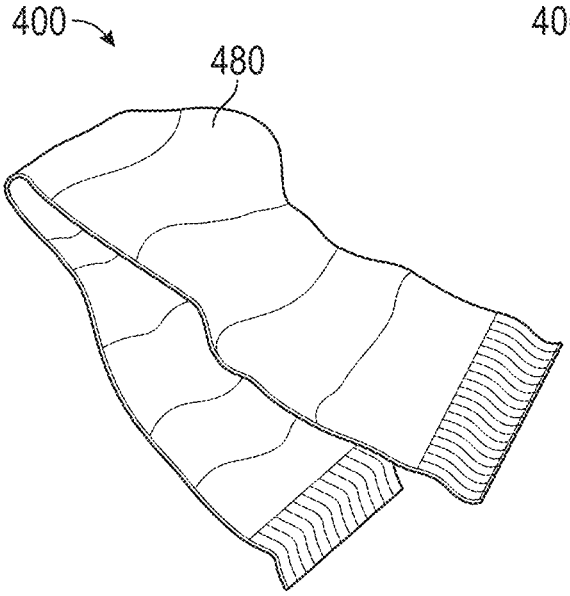
FIGS. 39 and 40 show a sixth color-changing product in a first state and a second state, according to an exemplary embodiment.
Figure 40:
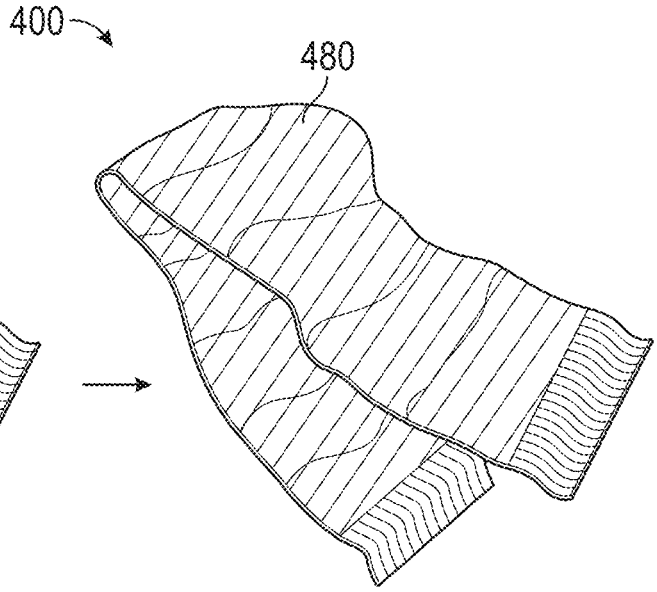
Figure 41:
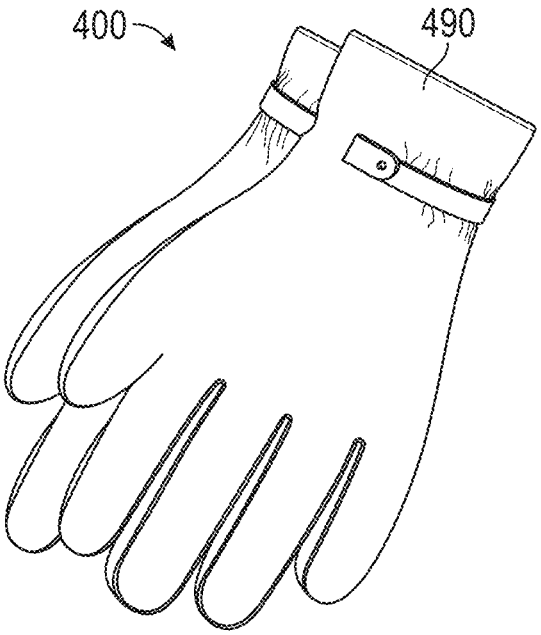
FIGS. 41 and 42 show a seventh color-changing product in a first state and a second state, according to an exemplary embodiment.
Figure 42:
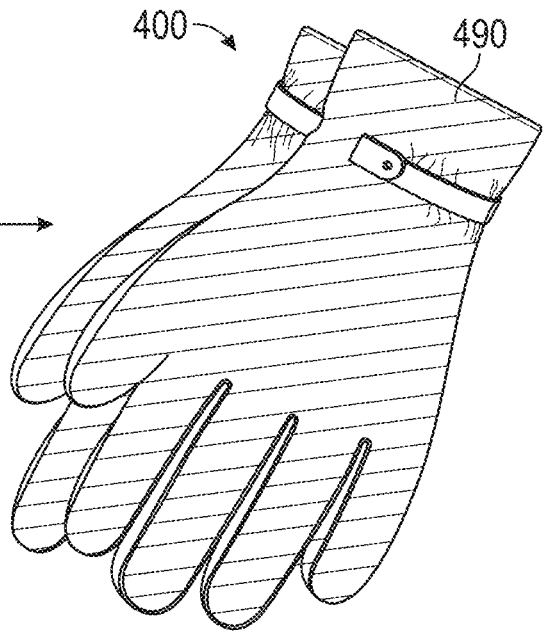
Figure 43:
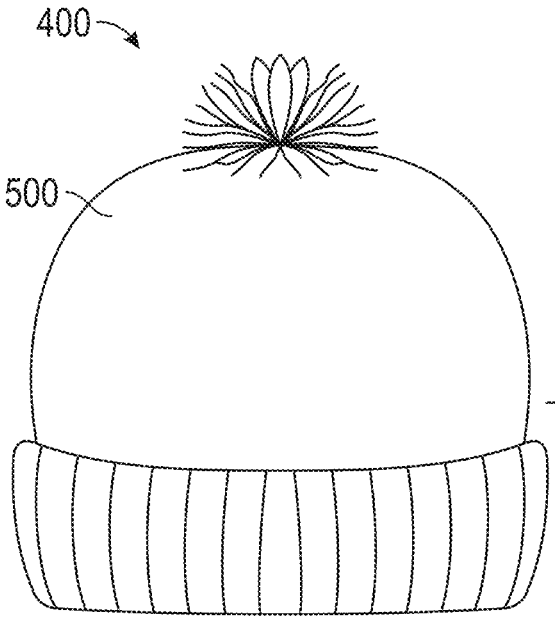
FIGS. 43 and 44 show an eighth color-changing product in a first state and a second state, according to an exemplary embodiment.
Figure 44:
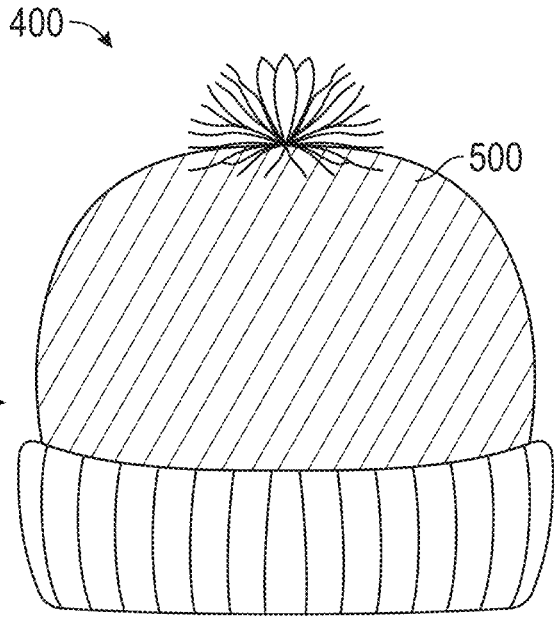
Figure 45:
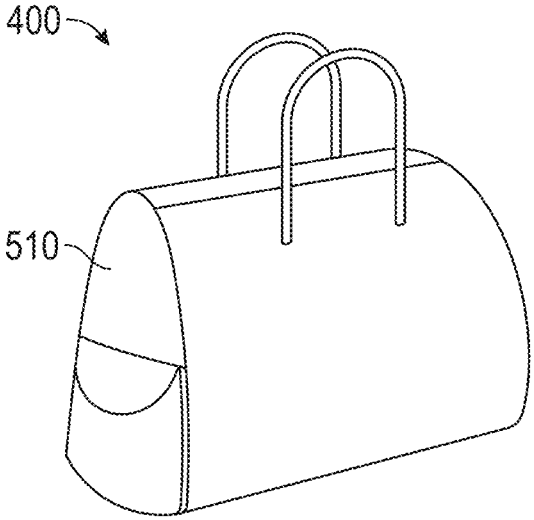
FIGS. 45 and 46 show a ninth color-changing product in a first state and a second state, according to an exemplary embodiment.
Figure 46:
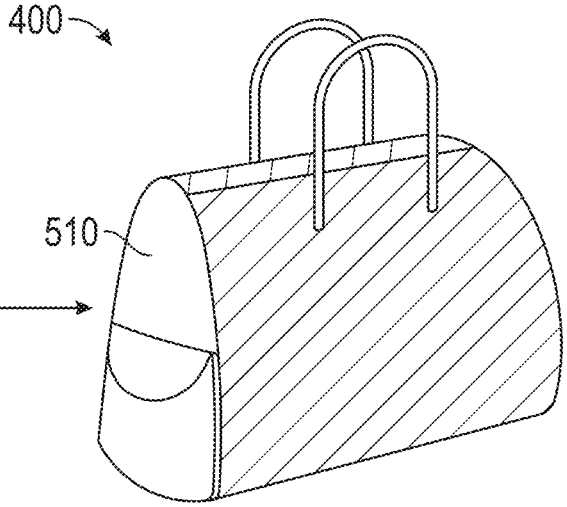
Figure 47:
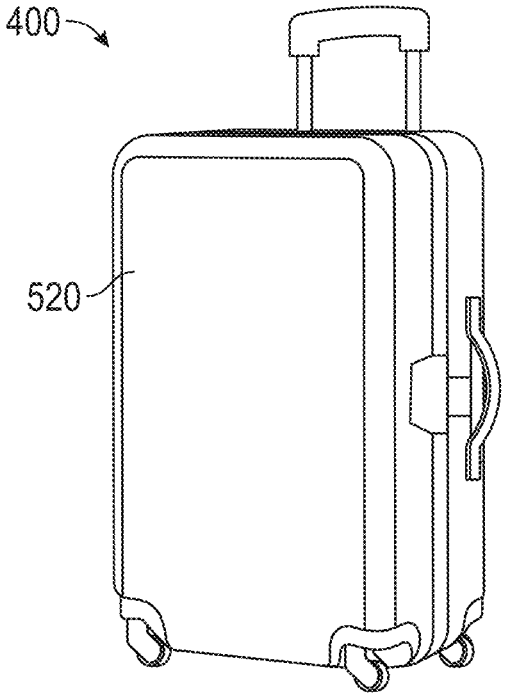
FIGS. 47 and 48 show a tenth color-changing product in a first state and a second state, according to an exemplary embodiment.
Figure 48:
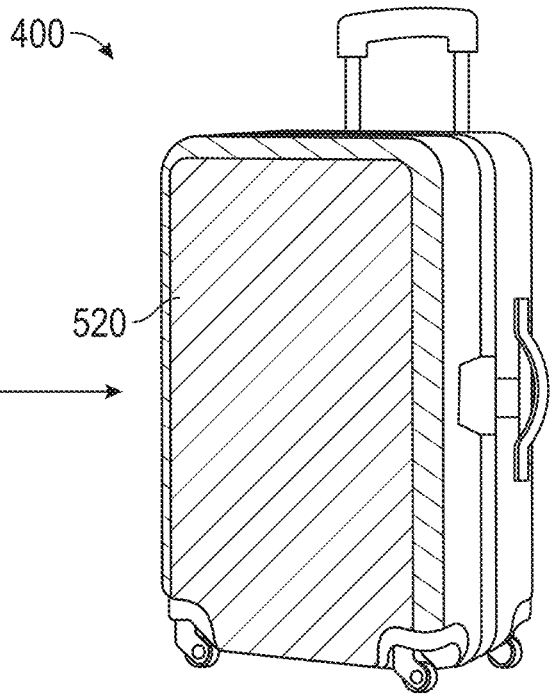
Figure 49:
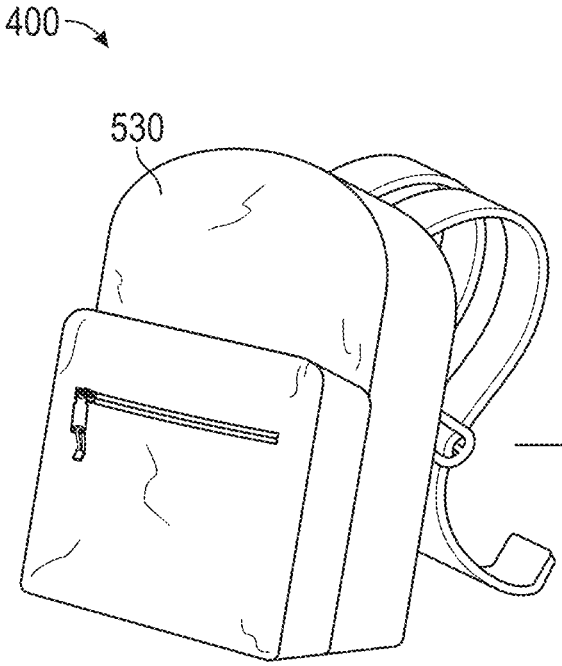
FIGS. 49 and 50 show an eleventh color-changing product in a first state and a second state, according to an exemplary embodiment.
Figure 50:
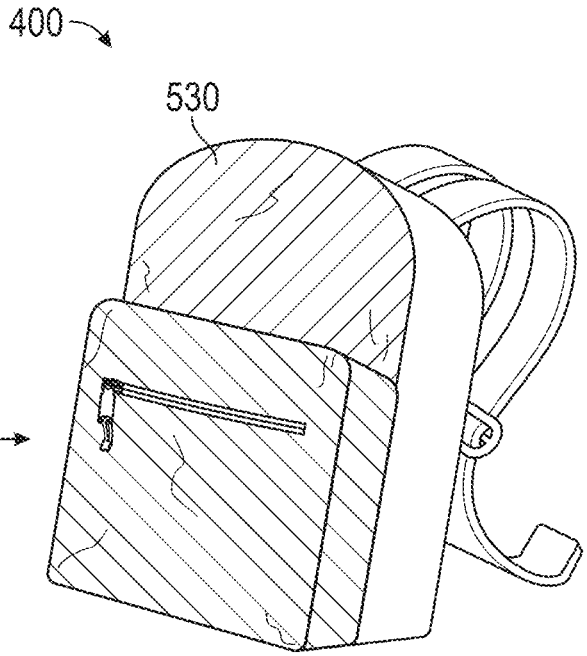

As shown in FIGS. 37 and 38, the color-changing product 400 is configured as a fifth product, shown as shoe 470. The shoe 470 includes an embroidered portion, shown as embroidered portion 472. According to an exemplary embodiment, the embroidered portion 472 is formed by directly incorporating the color-changing fibers 10 and/or the color-changing yarns 100 into the fabric or other material of a preexisting shoe (e.g., a newly manufactured shoe, a used shoe, etc.) (or other preexisting product). As shown in FIG. 37, the embroidered portion 472 is in a first state, shown as first color state 474, where the color-changing fibers 10 and/or the color-changing yarns 100 thereof are selectively activated or deactivated to be a first color, a first set of colors, or have other first visual characteristics. As shown in FIG. 38, the embroidered portion 472 is in a second state, shown as second color state 476, where the color-changing fibers 10 and/or the color-changing yarns 100 thereof are selectively activated or deactivated to be a second color, a second set of colors, or have other second visual characteristics (e.g., a pattern, etc.) different than the first color state 474.

It should be understood that the concepts presented in the first product, the second product, the third product, the fourth product, and the fifth product in FIGS. 29-38 above are not required to be independent of each other, but rather the concepts may be combined in a single product. By way of example, a single color-changing product 400 may include a combination of (i) being formed (e.g., woven, knit, etc.) from the color-changing fibers 10, the color-changing yarns 100, and/or the color-changing fabrics 300, (ii) include one or more patches, and/or (iii) include one or more embroidered portions, which may all be independently controlled and activated.

The color-changing product 400 may also be other types of apparel than shown in FIGS. 29-38. For example, as shown in FIGS. 39-44, the color-changing product 400 may be configured as a sixth product, shown as scarves 480, a seventh product, shown as gloves 490, and an eighth product, shown as hat 500. The scarves 480, the gloves 490, and the hat 500 may include any of the properties described above with respect to FIGS. 29-38 (e.g., being formed from the color-changing fibers 10, the color-changing yarns 100, and/or the color-changing fabrics 300; include one or more patches; include one or more embroidered portions; etc.) such that the scarves 480, the gloves 490, and the hat 500 or one or more portions thereof may be selectively transitionable from a first state to a second state. The color-changing product 400 may still be other types of apparel than shown in FIGS. 29-44 such as pants, shorts, jackets, headbands, wristbands, ties, bowties, skirts, blouses, etc.

Further, while FIGS. 29-44 show various different types of apparel with varying color-changing capabilities, it should be understood that non-apparel applications are also possible as previously described, such as fixed installations, accessories, home goods, décor, automotive, outdoor applications and equipment, and camouflage, to name a few. For example, as shown in FIGS. 45-50, the color-changing product 400 may be configured as one or more accessories such as a ninth product, shown as purse 510, a tenth product, shown as luggage 520, and an eleventh product, shown as backpack 530. The purse 510, the luggage 520, and the backpack 530 may include any of the properties described above with respect to FIGS. 29-38 (e.g., being formed from the color-changing fibers 10, the color-changing yarns 100, and/or the color-changing fabrics 300; include one or more patches; include one or more embroidered portions; etc.) such that the purse 510, the luggage 520, and the backpack 530 or one or more portions thereof may be selectively transitionable from a first state to a second state. The color-changing product 400 may still be other types of accessories than shown in FIGS. 45-50 such as other types of bags (e.g., briefcases, messenger bags, duffel bags, etc.), wallets, jewelry, hair accessories, etc.

Figure 51:
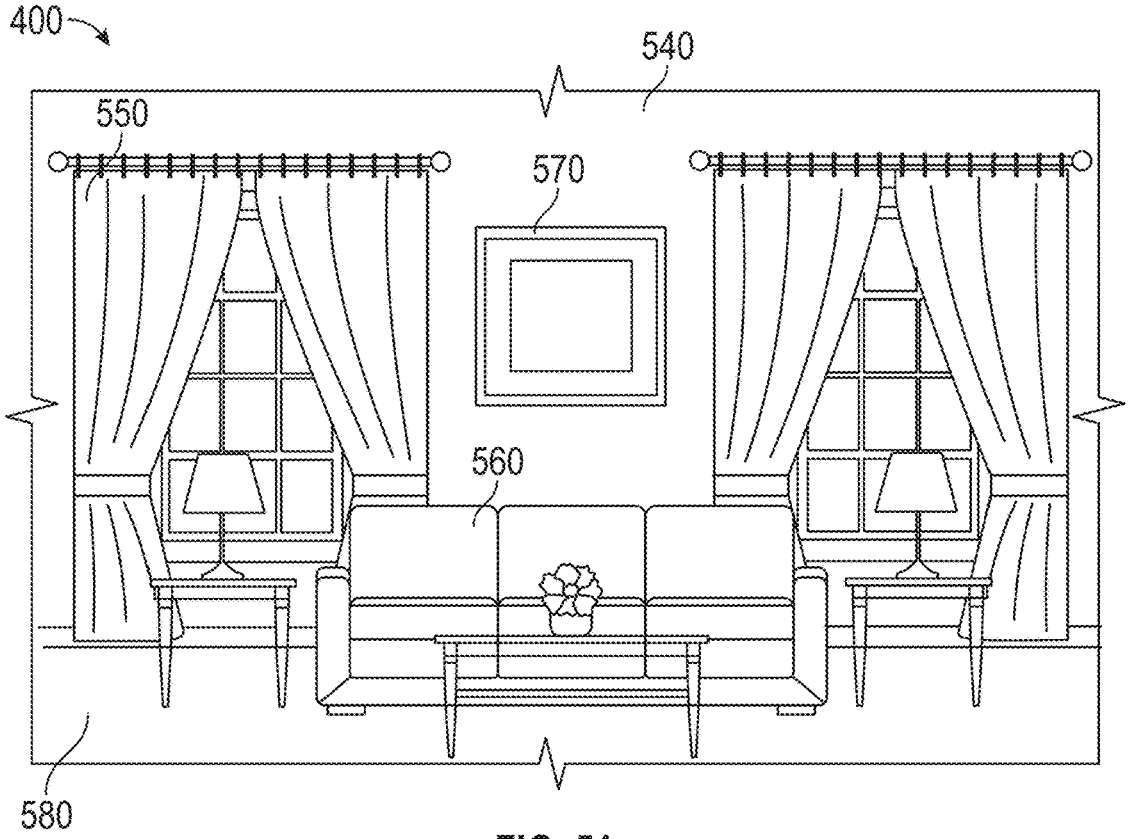
FIGS. 51 and 52 show various fixed installation, home goods, furniture, and décor color-changing products in a first state and a second state, according to an exemplary embodiment.
Figure 52:
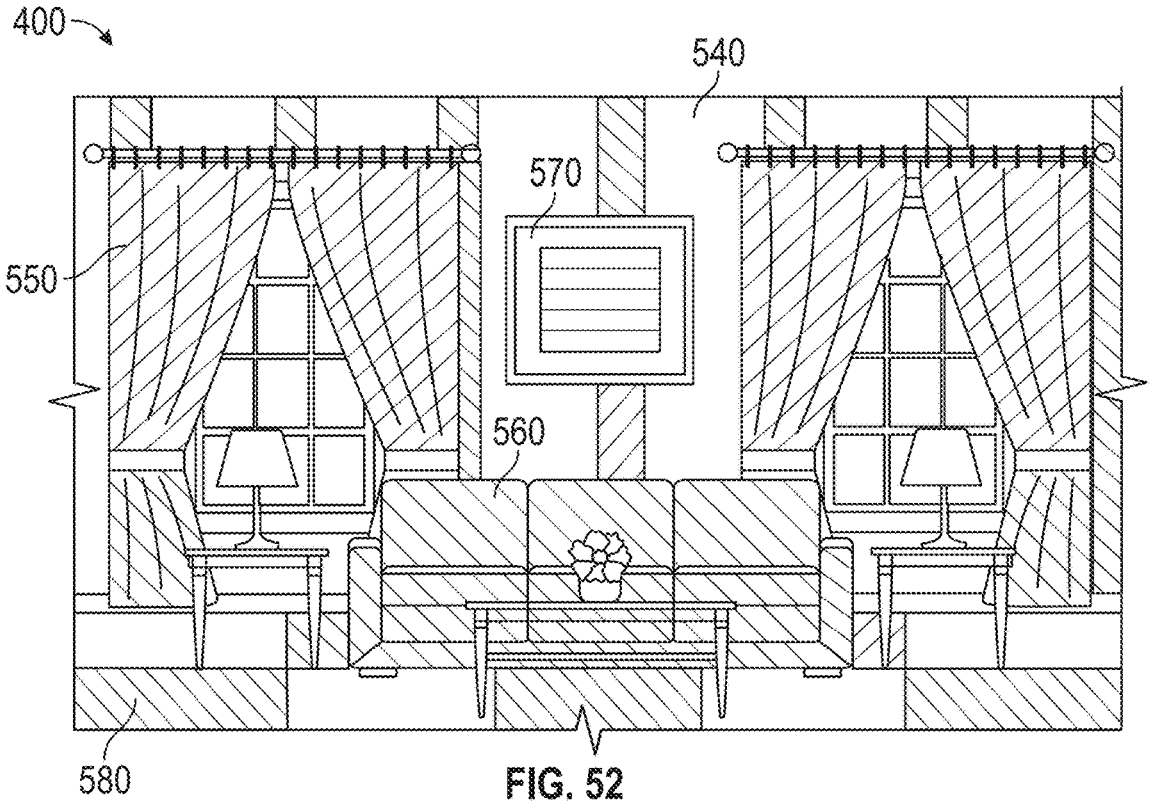

As another example of non-apparel applications, FIGS. 51 and 52 show various color-changing products 400 that are fixed installations, home goods, furniture, and décor. As shown in FIGS. 51 and 52, the color-changing products 400 include a twelfth product, shown as wallpaper 540, a thirteenth product, shown as window coverings 550 (e.g., window curtains, window blinds, window shades, etc.), a fourteenth product, shown as furniture 560 (e.g., a couch, a chair, a sofa, etc.), a fifteenth product, shown as décor 570 (e.g., artwork, etc.), and a sixteenth product, shown as flooring 580 (e.g., carpeting, a rug, etc.). The wallpaper 540, the window coverings 550, the furniture 560, the décor 570, and the flooring 580 may include any of the properties described above with respect to FIGS. 29-38 (e.g., being formed from the color-changing fibers 10, the color-changing yarns 100, and/or the color-changing fabrics 300; include one or more patches; include one or more embroidered portions; etc.) such that the wallpaper 540, the window coverings 550, the furniture 560, the décor 570, and the flooring 580 or one or more portions thereof may be selectively transitionable from a first state to a second state to allow a user to selectively manipulate and customize the appearance of a room. The color-changing product 400 may still be other types of fixed installations, home goods, furniture, and décor than shown in FIGS. 51 and 52 such as table cloths, blankets, bed sheets, pillow cases, etc. Sensors may be employed (e.g., motion sensors, activity sensors, proximity sensors, occupancy sensors, etc.; the sensors 640, the sensors 494, etc.) to change or facilitate detecting when to change the color state of one or more of the items (e.g., when a person enters a room as sensed by a motion sensor, certain items may change color, etc.).

As shown in FIGS. 51 and 52, the wallpaper 540 is coupled (e.g., adhered, etc.) to a wall surface and facilitates variably changing the appearance of the walls of a room in which the wallpaper 540 is installed. As shown in FIGS. 51 and 52, the window coverings 550 are configured to hang in front of a window. The window coverings 550 may transition between a first, more transparent color to a second, more opaque color to facilitate transitioning between standard shades or curtains to blackout shades or curtains such that the window coverings 550 facilitate selectively allowing a variable amount of light through the window into an associated room. The window coverings 550 may also selectively transition from a first decorative color or pattern to a second decorative color or pattern. As shown in FIGS. 51 and 52, the furniture 560 is selectively positionable about a room and may selectively transition from a first color or pattern to a second color or pattern. As shown in FIGS. 51 and 52, the décor 570 is configured to hang on a wall. In some embodiments, the décor 570 is additionally or alternatively configured to rest on a surface (e.g., a table, a ground surface, etc.). The décor 570 may selectively transition from a first color or pattern to a second color or pattern. As shown in FIGS. 51 and 52, the flooring 580 is disposed (e.g., adhered, nailed, stapled, laid on top of, etc.) a floor surface and facilitates variably changing the appearance of the floor of a room in which the flooring 580 is installed or located.

Figure 53:
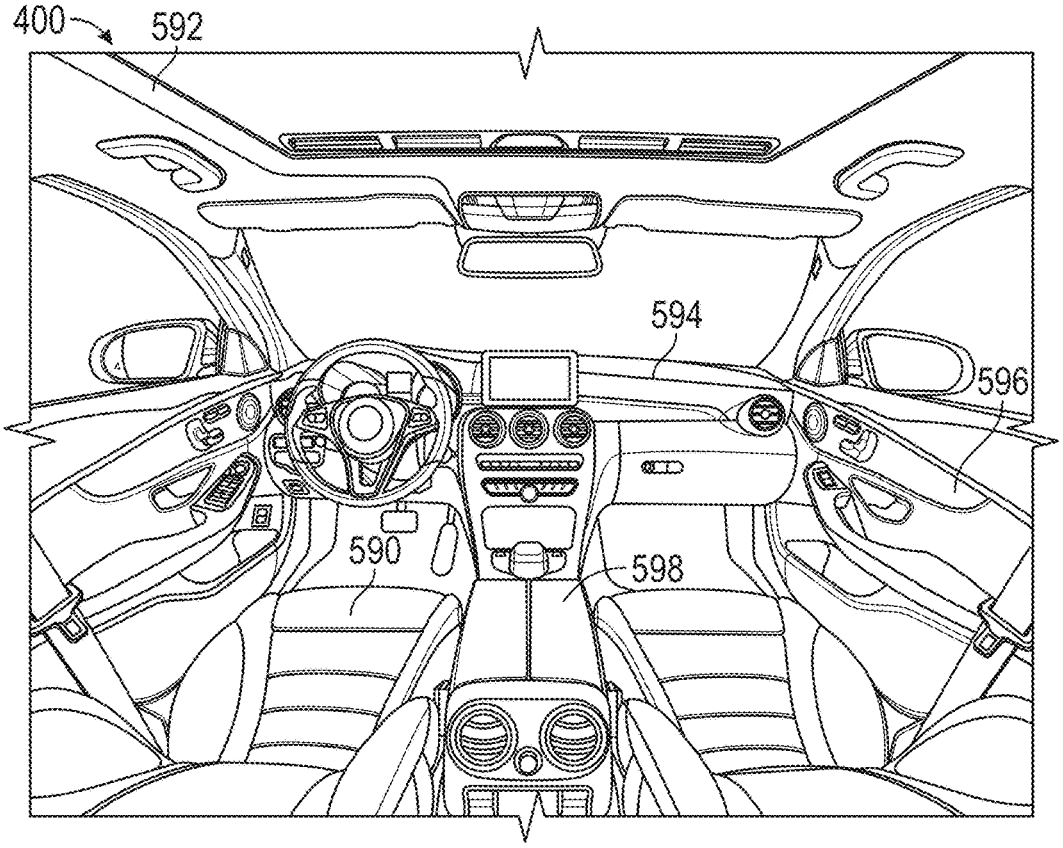
FIGS. 53 and 54 show various interior automotive color-changing products in a first state and a second state, according to an exemplary embodiment.
Figure 54:
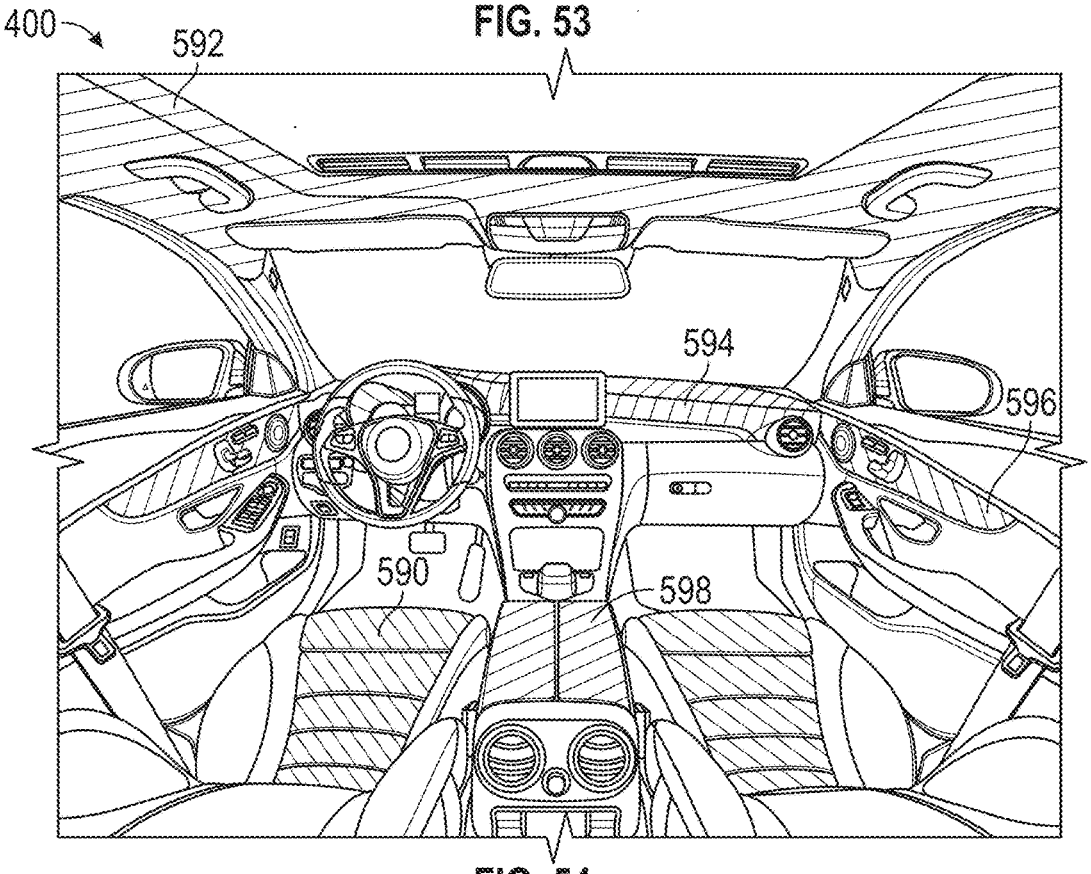

As another example of non-apparel applications, FIGS. 53 and 54 show various interior automotive color-changing products 400 including seats 590, a headliner 592, a dash 594, side panels 596, and an armrest 598. The seats 590, the headliner 592, the dash 594, the side panels 596, and the armrest 598 may include any of the properties described above with respect to FIGS. 23-32 (e.g., being formed from the color-changing fibers 10, the color-changing yarns 100, and/or the color-changing fabrics 300; include one or more patches; include one or more embroidered portions; etc.) such that the seats 590, the headliner 592, the dash 594, the side panels 596, and the armrest 598 or one or more portions thereof (e.g., a center portion of the seats 590; stitching on the seats 590, the armrest 598, etc.; etc.) may be selectively transitionable from a first state to a second state to allow a user to selectively manipulate and customize the interior appearance of their automobile or other type vehicle (e.g., boat, plane, etc.).

Figures 55A, 55B, 55C:
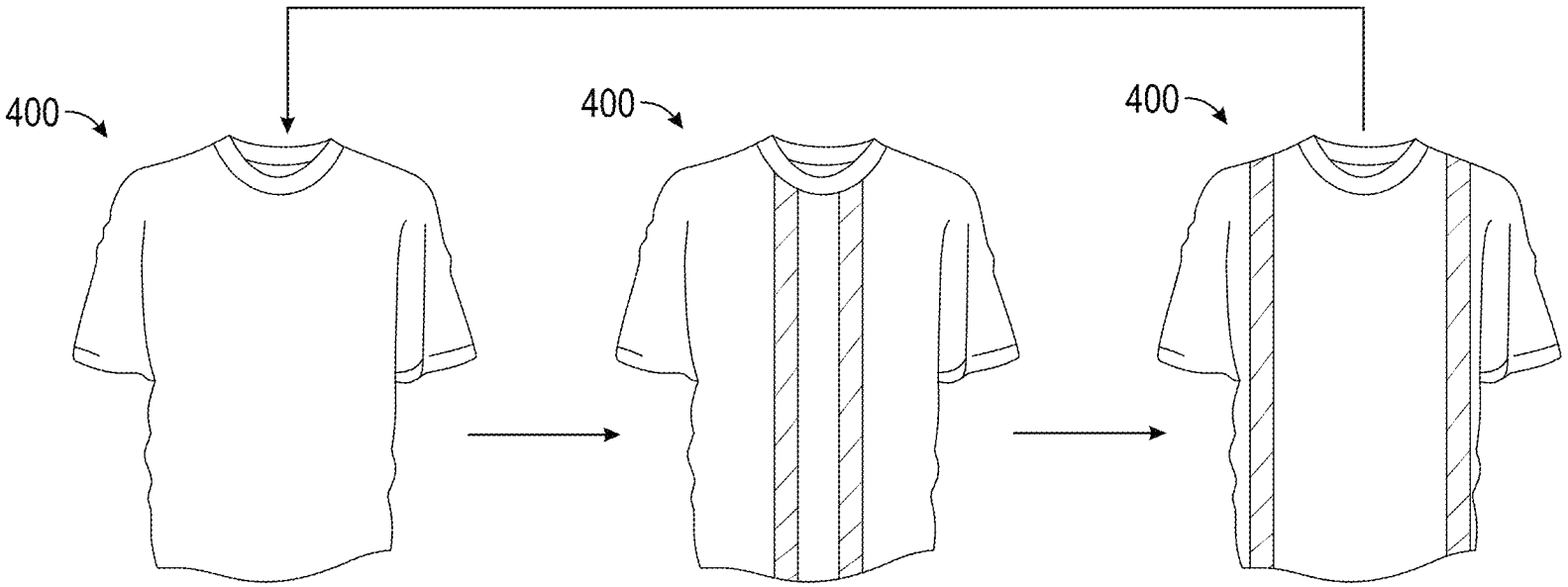
FIGS. 55A-55C show a color-changing product having a dynamic pattern, according to an exemplary embodiment.

While the color and/or pattern changes of the color-changing products 400 disclosed herein have mainly been described as a discrete transition from a first color to a second color and/or from a first pattern to a second pattern, it should be understood that the color-changing products 400 may facilitate dynamic transitions. For example, as shown in FIGS. 55A-55C, the color-changing product 400 is configured to provide a dynamic pattern that changes with respect to time. Specifically, (i) the color-changing product 400 has no pattern at time A in FIG. 55A, (ii) then the color-changing product 400 has a pair of vertical stripes positioned proximate the center of the color-changing product 400 at time B in FIG. 55B, and (iii) then the pair of vertical stripes are positioned further outward, proximate the edges of the color-changing product 400 at time C in FIG. 55C. The transition shown in FIGS. 55A-55C may be continuous until a wearer provides a stop command and/or for a specified period of time such that the pattern appears to be moving (i.e., dynamic).

Further, while the dynamic pattern in FIGS. 55A-55C is shown as dynamic vertical stripes that move from the center of the color-changing product 400 to the outer edges of the color-changing product 400, it should be understood that various other types of dynamic patterns are possible. By way of example, the dynamic vertical stripes may move from left to right, move from right to left, increase in number over time from the center to the outer edges (i.e., add vertical stripes over time), decrease in number over time from the outer edges to the center (i.e., remove vertical stripes over time), etc. By way of another example, the dynamic pattern may additionally or alternatively include dynamic horizontal stripes that move from the center toward the top and bottom edges, move from top to bottom, move from bottom to top, increase in number over time from the center to the top and bottom edges (i.e., add horizontal stripes over time), decrease in number over time from the top and bottom edges to the center (i.e., remove horizontal stripes over time), etc. By way of still another example, the dynamic pattern may additionally or alternatively include a dynamic diagonal stripe pattern, a dynamic concentric circle pattern, a dynamic checkered pattern, a dynamic polka dot pattern, etc. Further, the dynamic pattern may be predefined, random, and/or user definable/selectable. Additionally or alternatively, the dynamic pattern, rather than or in addition to appearing to move, may flash or blink at a predefined rate or a user specified rate.

Product Control System

Any of a variety of systems and methods may be used to control the color-changing fibers 10, the color-changing yarns 100, the color-changing fabrics 300, and/or the color-changing products 400 disclosed herein. According to the exemplary embodiment shown in FIG. 56, a control system, shown as control system 600, is coupled (e.g., electrically coupled, communicatively coupled, mechanical coupled, etc.) to the color-changing product 400 and includes a control device (e.g., similar to controller 310, etc.), shown as controller 610, a power source (e.g., similar to power supply 320, etc.), shown as power supply 620, and a user input, shown as input device 630. The controller 610 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the exemplary embodiment shown in FIG. 56, the controller 610 includes a processing circuit having a processor 612 and a memory 614. The processing circuit may include an ASIC, one or more FPGAs, a DSP, circuits containing one or more processing components, circuitry for supporting a microprocessor, a group of processing components, or other suitable electronic processing components. In some embodiments, the processor 612 is configured to execute computer code stored in the memory 614 to facilitate the activities described herein. The memory 614 may be any volatile or non-volatile computer-readable storage medium capable of storing data or computer code relating to the activities described herein. According to an exemplary embodiment, the memory 614 includes computer code modules (e.g., executable code, object code, source code, script code, machine code, etc.) configured for execution by the processor 612.

Figure 56:
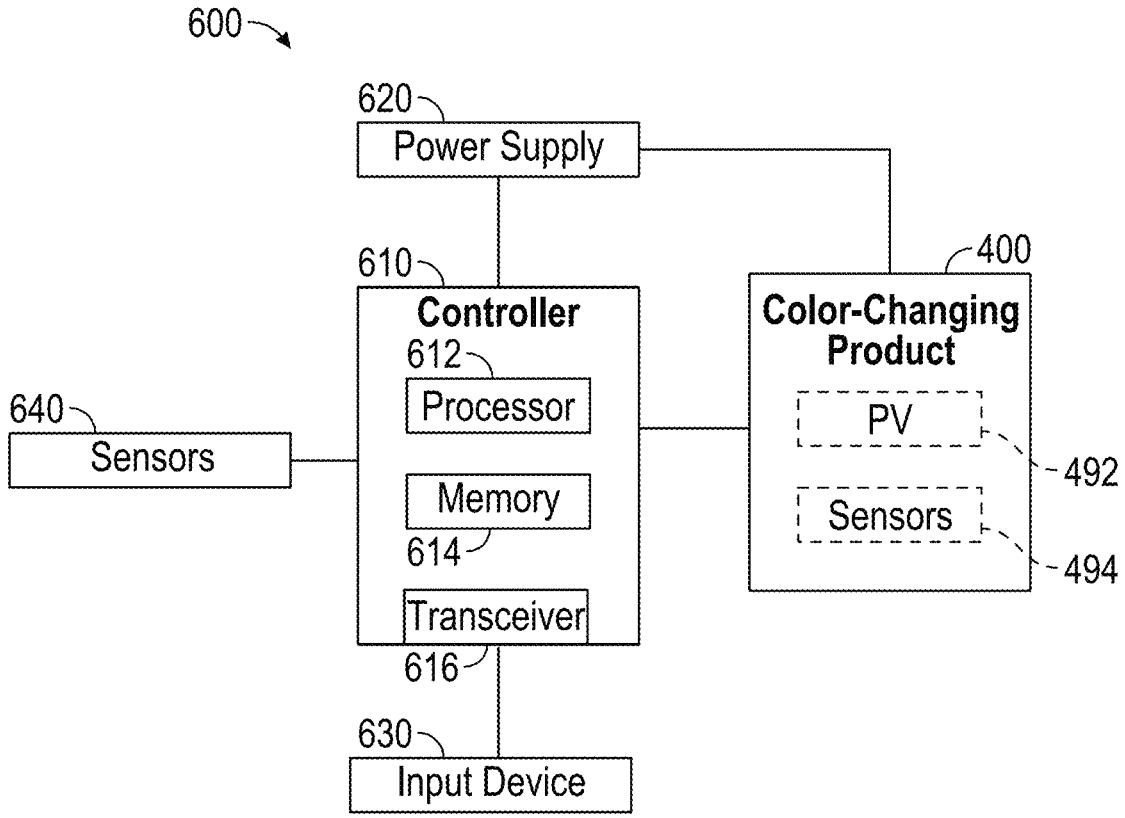
FIG. 56 is a schematic diagram of an individual control system for the color-changing products of FIGS. 29-55C, according to an exemplary embodiment.

As shown in FIG. 56, the controller 610 includes a communications interface, shown as transceiver 616. The transceiver 616 is configured to send and receive signals between the controller 610, the power supply 620, the input device 630, the color-changing product 400 (e.g., sensors thereof, etc.), and/or sensors, shown as sensors 640. The transceiver 616 may facilitate wired and/or wireless (e.g., Bluetooth, NFC, Zigbee, radio, cellular, Wi-Fi, short-range, long-range, etc.) communication. By way of example, the transceiver 616 may include one or more ports to facilitate making a wired connection. By way of another example, the transceiver 616 may include wireless components (e.g., Bluetooth components, Wi-Fi components, a cellular chip, etc.) to facilitate wireless communication.

According to an exemplary embodiment, the power supply 620 is configured to facilitate selectively providing an electrical current to the color-changing fibers 10 and/or the color-changing yarns 100 of the color-changing product 400 (e.g., based on commands provided by the controller 610, etc.) to activate the thermochromic pigments in the coatings 14. The power supply 620 may be a rechargeable battery pack, a replaceable battery pack, and/or another suitable power supply. The power supply 620 may be chargeable using a direct connection to an external power source (e.g., a mains power line, etc.), wirelessly using wireless charging technology, and/or require that batteries therein be replaced on occasion. In some embodiments, as shown in FIG. 56, the color-changing product 400 includes a photovoltaic source, shown as PV source 492. The PV source 492 may be or include photovoltaic fibers incorporated into the color-changing yarns 100, an independent photovoltaic patch, etc. The PV source 492 may charge the power supply 620, supplement the power supply 620 in providing current to the color-changing fibers 10, and/or, in some embodiments, obviate the need for the power supply 620 altogether.

Figure 57:
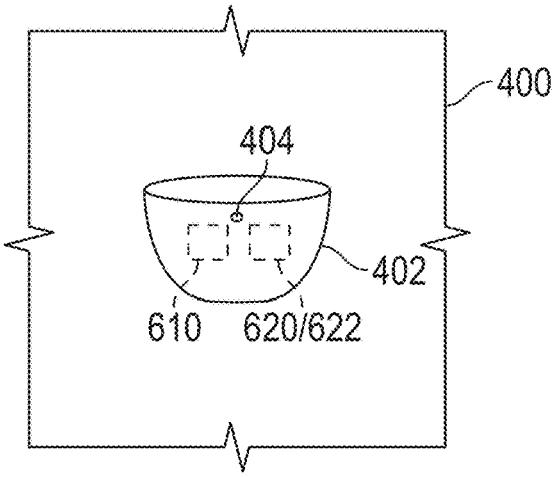
FIG. 57 is a detailed view of a controller and power supply stored within a color-changing product, according to an exemplary embodiment.

As shown in FIG. 57, the color-changing product 400 includes a compartment, shown as pocket 402. In one embodiment, the pocket 402 is positioned along an interior of the color-changing product 400 (e.g., along an inner lining of a jacket, along the back of a shirt, etc.) such that the pocket 402 is accessible from the interior of the color-changing product 400. In another embodiment, the pocket 402 is positioned along an exterior of the color-changing product 400 (e.g., along a sleeve, a back, a side, etc.) such that the pocket 402 is accessible from the exterior of the color-changing product 400. As shown in FIG. 57, the pocket 402 is configured to receive and store the controller 610 and/or the power supply 620. The power supply 620 may therefore be a removable power source, shown as battery pack 622, that is selectively removable, replaceable, and/or rechargeable. The battery pack 622 may be charged via a direct charging connection (e.g., inserted into a charging apparatus, connected to a charging cable, etc.) or wirelessly (e.g., using wireless charging technology, etc.). As shown in FIG. 57, the pocket 402 includes a securing element, shown as button 404, positioned to selectively enclose and secure the controller 610 and/or the battery pack 622 within the pocket 402. In other embodiments, the securing element additionally or alternatively is or includes a clip, a zipper, Velcro, and/or another suitable securing element that facilitates selectively closing the pocket 402.

In some embodiments, the color-changing product 400 does not include the pocket 402. In such embodiments, the controller 610 and/or the power supply 620 may be integrated into the color-changing product 400. By way of example, the controller 610 and/or the power supply 620 may be directly coupled to the color-changing product 400 (e.g., with clips, Velcro, sewn thereto, etc.). By way of another example, the controller 610 and/or the power supply 620 may be disposed within a liner of the color-changing product 400 (e.g., with the insulation of a liner within a jacket, etc.). In such an embodiment, the color-changing product 400 may include a charging port that facilitates charging the internally disposed power supply 620. By way of another example, the power supply 620 may be a "free-floating" power supply that is carried by the wearer or within a compartment of the color-changing product 400 (e.g., a pursue compartment, a bag compartment, a jacket pocket, etc.) and may be selectively connectable to the controller 610 and/or the other components of the color-changing product 400 (e.g., directly, using a connection port within the compartment, etc.).

Figure 58:
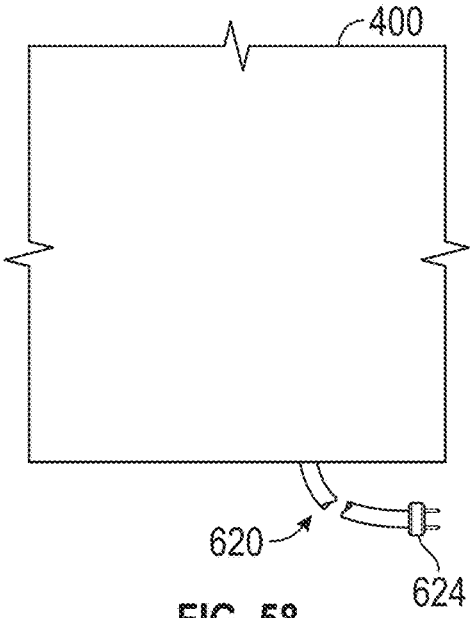
FIG. 58 is a detailed view of a wired power supply for a color-changing product, according to an exemplary embodiment.

As shown in FIG. 58, the power supply 620 of the color-changing product 400 additionally or alternatively includes a cord, shown as power cord 624. According to an exemplary embodiment, the power cord 624 is configured to interface with a wall socket, generator, or other external power source to power the color-changing product 400. In some embodiments, the power cord 624 is integrated directly into a power grid of a building or vehicle. Such a power supply 620 may be more suitable for color-changing products 400 that are not frequently moving (e.g., fixed applications, furniture, décor, tents, etc.) and, therefore, may not require a portable power supply.

Figure 59:
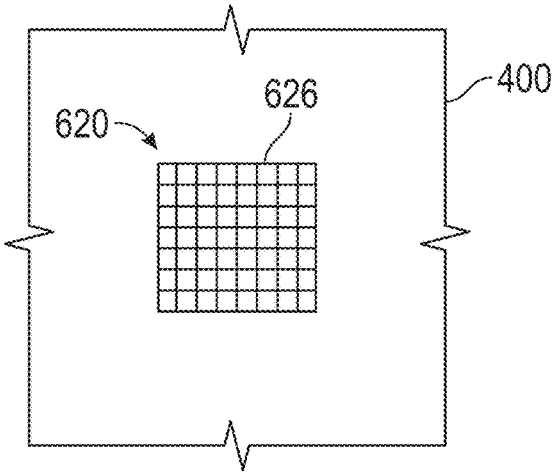
FIG. 59 is a detailed view of a solar panel/patch power supply for a color-changing product, according to an exemplary embodiment.

As shown in FIG. 59, the power supply 620 of the color-changing product 400 additionally or alternatively includes a solar cell array, shown as solar panel 626. According to an exemplary embodiment, the solar panel 626 includes a plurality of photovoltaic cells configured to generate electrical energy from light energy. The solar panel 626 may be removably coupled to or integrated into the color-changing product 400 or positioned remotely from the color-changing product 400 and connected therewith via a wired connection.

According to an exemplary embodiment, the input device 630 is configured to facilitate a user or operator of the color-changing product 400 with selectively controlling the visual appearance (e.g., color, pattern, etc.) of the color-changing product 400 (e.g., may be used to remotely control the color and/or pattern of a fabric or of an individual fiber, etc.). The input device 630 may be configured to communicate with the controller 610 via any suitable wireless communication protocol (e.g., Bluetooth, NFC, Zigbee, radio, cellular, Wi-Fi, etc.) and/or wired communication protocol. The input device 630 may be a cellular phone, a "smart" phone, a remote control, a computing device such as a laptop computer, a switch device, a button device, a touch-sensitive feature, a "smart home" controller device or hub (e.g., Amazon Alexa, Google Home, Z-wave controller, etc.), a remote control system (see, e.g., FIG. 64), etc.

Figure 60:
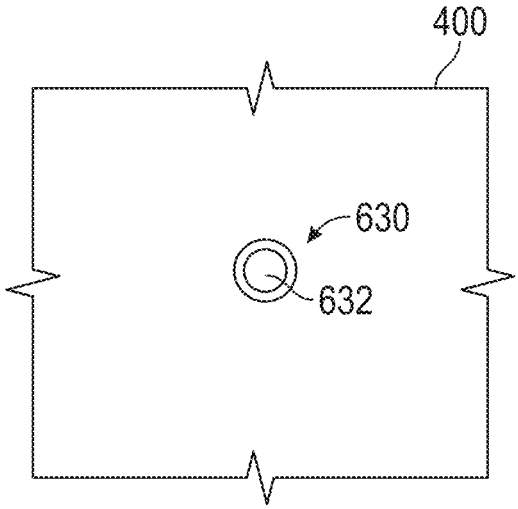
FIG. 60 is a detailed view of a button input device of a color-changing product, according to an exemplary embodiment.

As shown in FIG. 60, the input device 630 is configured as a button or switch device, shown as button 632. The button 632 may be secured to or positioned within the fabric of the color-changing product 400. By way of example, the button 632 may be disposed within or along a sleeve of a garment, along an interior breast portion of a garment, at an edge of a garment/product (e.g., the bottom edge of a shirt, etc.), and/or still otherwise positioned. The button 632 may allow a user to selectively activate and deactivate predefined or preset color-changing and/or pattern-changing features of the color-changing product 400 at the activation of the button 632.

Figure 61:
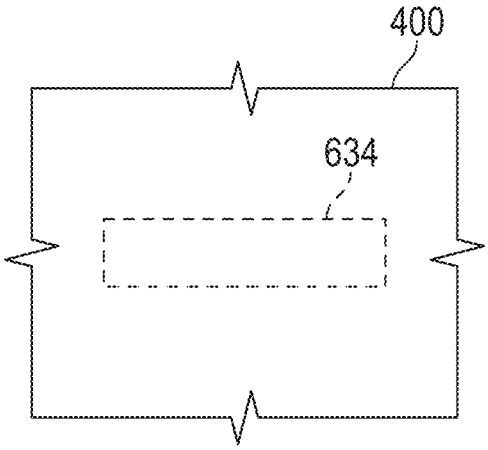
FIG. 61 is a detailed view of a touch-sensitive input device of a color-changing product, according to an exemplary embodiment.

As shown in FIG. 61, the input device 630 is configured as a touch-sensitive feature, shown as touch-sensitive portion 634. The touch-sensitive portion 634 may be secured to or integrated with the fabric of the color-changing product 400. By way of example, the touch-sensitive portion 634 may be disposed within or along a sleeve of a garment, along an edge of a product, along an interior of a product, and/or still otherwise positioned. The touch-sensitive portion 634 may allow a user to selectively activate and deactivate predefined or preset color-changing and/or pattern-changing features of the color-changing product 400 in response to receiving touch gestures. By way of example, the touch-sensitive portion 634 may be configured to identify one or more touch gestures such as a tap motion, a swipe motion, a pinch motion, etc. and provide a corresponding signal to the controller 610 to take an appropriate action based on the identified touch gesture.

Figure 62:
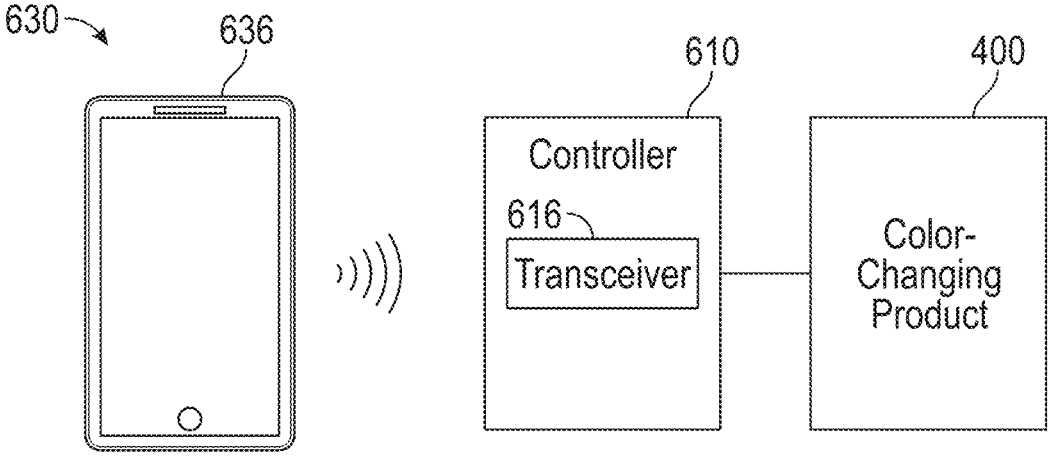
FIG. 62 is a detailed view of a portable input device useable with a color-changing product, according to an exemplary embodiment.

As shown in FIG. 62, the input device 630 is a portable device, shown as smartphone 636. In other embodiments, the portable device is another device such as a tablet, a smartwatch, a laptop, a smart hub, etc. The smartphone 636 may include or run an application ("app") that allows a user to select from one or more predefined colors, predefined patterns, predefined dynamic patterns, etc. for a fiber or fabric. In another example, the app on the smartphone 636 may allow the user to design a custom pattern and/or custom dynamic patterns. The smartphone 636 may then communicate with the controller 610 responsible for controlling the fiber/fabric, such as by wirelessly transmitting a signal to the transceiver 616 associated with the controller 610, after which electrical current may be provided to one or more fibers to effect the color change and/or pattern change of the color-changing product 400 as discussed in more detail herein.

As an example, an article of clothing or another product incorporating color-changing fibers may normally exhibit a first color (e.g., purple, green, etc.) or first pattern in a first state, and a user may select a second, different color (e.g., red, yellow, etc.) or pattern using the input device 630 (e.g., by pressing the button 632, swiping across the touch-sensitive portion 634, selecting an appropriate command on the smartphone 636, etc.), which in turn sends a signal to the controller 610 to turn the fabric from the first color/pattern to the second color/pattern such that the fabric is in a second state that differs from the first state (see, e.g., FIGS. 29, 30, and 39-54). As another example, the user may select a pattern such as "stripe" in the smartphone app (e.g., by selecting a "stripe" button, etc.), and various portions of the fabric may change from the first color to a striped pattern (e.g., blue stripes in the purple fabric, by selectively changing the temperature of certain fibers in the fabric to effect the striped pattern, etc.) (see, e.g., FIGS. 31 and 32). The input device 630 may therefore allow the user to determine when a color change occurs and/or what pattern appears on the color-changing product 400.

As shown in FIG. 56, in some embodiments, the color-changing product 400 and/or the control system 600 include one or more sensors (e.g., sensors to measure temperature, force, pressure, acceleration, moisture, motion, activity, occupancy, proximity, health characteristics, gas, liquid, chemicals, light, etc.), shown as sensors 494 and/or sensors 640. The sensors 494 and/or the sensors 640 may be configured to (i) monitor various characteristics and/or parameters and (ii) send signals to the controller 610 regarding the characteristics and/or parameters to facilitate determining if and/or when the color-changing product 400 should be activated (e.g., automatically based on the characteristics and/or parameters, etc.). The sensors 494 may be integrated into the color-changing fibers 10 and/or otherwise integrated into the color-changing product 400 (e.g., during manufacture of the color-changing product 400, etc.). The sensors 640 may be integrated into the controller 610 and/or electrically coupled thereto, and coupled to a portion of the color-changing product 400 post-manufacture.

In some embodiments, the sensors 494 and/or the sensors 640 include a piezoelectric sensor that is configured to sense a depressive force or pressure on the fabric that the color-changing fibers 10 and/or the color-changing yarns 100 are included with (e.g., similar to the touch-sensitive portion 634 in FIG. 61, etc.). The piezoelectric sensor may be incorporated directly into the fabric of the color-changing product 400 and/or in a patch coupled to the fabric of the color-changing product 400. The piezoelectric sensor may send an electrical signal to the controller 610 in response to detecting a depressive force and the controller 610 may take an appropriate action in response to the signal (e.g., command the power supply 620 to provide electrical current to the color-changing fibers 10 to activate the thermochromic pigment to transition the color, pattern, etc.).

In some embodiments, the sensors 494 and/or the sensors 640 include a hazard sensor configured to facilitate detecting a hazardous substance such as one or more specific gasses, liquids, and/or chemicals. By way of example, in a personal protective equipment embodiment (e.g., a lab coat, a hazmat suit, medical scrubs, gloves, etc.), the color-changing product 400 may include such a hazard sensor that is configured to detect harmful gasses in the ambient air around the color-changing product 400, harmful liquids that come into contact with the color-changing product 400, and/or harmful chemicals that come into contact with the color-changing product 400. In such embodiments, the controller 610 may (i) receive a signal from the hazard sensor when it detects a harmful substance and (ii) activate the color-changing product 400 to notify the wearer of the color-changing product 400 and/or people nearby. Such activation may include changing the color of the entire color-changing product 400, changing the color of the portion of the color-changing product 400 where the harmful substance was detected on the color-changing product 400, changing a pattern on the color-changing product 400 to a predefined warning pattern, dynamically changing the pattern, flashing the pattern, and/or still otherwise change the appearance of the color-changing product 400 to provide a warning notification.

In some embodiments, the sensors 494 and/or the sensors 640 include a light sensor configured to facilitate detecting a level of ambient light around the color-changing product 400. In such embodiments, the controller 610 may (i) receive a signal from the light sensor regarding light intensity and (ii) activate the color-changing product 400 in response to the light intensity falling below a threshold light intensity (e.g., when it gets relatively dark outside, a low light condition, etc.). Such activation may include (i) changing the color of at least a portion of the color-changing product 400 to a higher visibility color (e.g., a brighter color, a neon color, expose a brighter/neon color underneath, etc.) and/or (ii) changing a characteristic of at least a portion of the color-changing product 400 to have a reflective capability (e.g., by changing the color of the coating, by exposing a reflective layer underneath, etc.) to increase the visibility of the color-changing product 400 in low light conditions. In embodiments where the color-changing fibers 10 include phosphor, such activation may include activating the phosphor within the color-changing fibers 10 such that at least a portion of the color-changing product 400 "glows" to increase the visibility of the color-changing product 400 in low light conditions. Such activation may additionally or alternatively include dynamically changing the glowing, reflective, and/or color pattern; flashing the glowing, reflective, and/or color pattern; etc.

In some embodiments, the sensors 494 and/or the sensors 640 include an activity or health sensor configured to facilitate monitoring physiological characteristics of the wearer of the color-changing product 400. By way of example, the physiological characteristics may include a heart rate, breathing patterns, temperature, sleeplessness/alertness, time of activity, $SpO_2$ levels, glucose levels, salt levels, hydration levels, and/or other physiological characteristics that may be affected by physical exertion. Such an activity or health sensor may be or include a heart rate sensor, a temperature sensor, a sweat sensor, a timer, a respiratory or breathing sensor, and/or still other sensors, to acquire the physiological characteristics regarding conditions of the wearer of the color-changing product 400. In such embodiments, the controller 610 may (i) receive a signal from the activity or health sensor regarding one or more physiological characteristics of the wearer of the color-changing product 400 and (ii) activate the color-changing product 400 in response to a physiological characteristic of the wearer not satisfying a corresponding physiological threshold (e.g., exceeding a threshold; falling below a threshold; a maximum heart rate, a minimum heart rate, a maximum time of activity, an irregular heartbeat, an irregular breathing pattern, a maximum temperature, a minimum temperature, a minimum glucose level, a maximum glucose level, a minimum salt level, a maximum salt level, etc.) to notify the wearer of the color-changing product 400 and/or people nearby. Such activation may include changing the color of the entire color-changing product 400, changing the color of a portion of the color-changing product 400, changing a pattern on the color-changing product 400 to a predefined warning pattern, dynamically changing the pattern, flashing the pattern, and/or still otherwise change the appearance of the color-changing product 400 to provide a warning notification.

In some embodiments, the sensors 494 and/or the sensors 640 include an audio sensor (e.g., a microphone, a micro-electro-mechanical systems ("MEMS") microphone, etc.) configured to facilitate detecting sound waves. In some embodiments, the audio sensor is integrated into the input device 630. By way of example, the color-changing product 400 (or the input device 630) may include an audio sensor that is configured to detect voice commands. In such embodiments, the controller 610 may (i) receive a signal from the audio sensor when the audio sensor detects a voice command and (ii) activate the color-changing product 400 based on the voice command. Such activation may be specific to the voice command. For example, a first voice command (e.g., "active mode 1," etc.) may activate a first color, activate a first pattern, activate a first dynamic pattern, cause the pattern to flash/blink at a first rate, activate a first portion, etc.; while a second voice command (e.g., "active mode 2," etc.) may activate a second color, activate a second pattern, activate a second dynamic pattern, cause the pattern to flash/blink at a second rate, activate a second portion, etc. By way of another example, the color-changing product 400 (or the input device 630) may include an audio sensor that is configured to detect characteristics of music (e.g., beat, bass, intensity, etc.). In such embodiments, the controller 610 may (i) receive a signal from the audio sensor when the audio sensor detects music and (ii) activate the color-changing product 400 based on the music. For example, first music characteristics (e.g., fast beat music, high bass music, high intensity music, etc.) may activate a first color, activate a first pattern, activate a first dynamic pattern, cause the pattern to flash/blink at a first rate, activate a first portion, etc.; while second music characteristics (e.g., slow beat music, low bass music, low intensity music, etc.) may activate a second color, activate a second pattern, activate a second dynamic pattern, cause the pattern to flash/blink at a second rate, activate a second portion, etc.

In some embodiments, the sensors 494 and/or the sensors 640 include an activity sensor (e.g., a motion sensor, a proximity sensor, an occupancy sensor, etc.) configured to facilitate detecting a person and/or movement around the color-changing product 400. In some embodiments, the activity sensor is integrated into the color-changing product 400. In some embodiments, the activity sensor is an external sensor that is electrically connected to the color-changing product 400. The controller 610 may (i) receive a signal from the activity sensor when the activity sensor detects a person and/or movement and (ii) activate the color-changing product 400 based on the detection. By way of example, the controller 610 may be configured to activate the color-changing product 400 when a person enters a room and deactivate the color-changing product 400 when the person exits the room.

In some embodiments, the controller 610 is configured to provide notifications to the wearer of the color-changing product 400 based on certain programmed activation settings. By way of example, the controller 610 may be wirelessly connected (e.g., via Bluetooth, etc.) to the wearer's personal device (e.g., smartphone, smartwatch, etc.). The controller 610 may be configured to activate the color-changing product 400 in response to the wearer's personal device generating a notification (e.g., a phone call notification, a text notification, an email notification, a social media notification, an alarm notification, a calendar notification, etc.). Such activation may include changing the color of the entire color-changing product 400, changing the color of a portion of the color-changing product 400, changing a pattern on the color-changing product 400 to a predefined notification pattern, dynamically changing the pattern to a predefined dynamic notification pattern, flashing the pattern at a predefined frequency, and/or still otherwise change the appearance of the color-changing product 400 to provide a notification. The activation color, pattern, dynamic transition time, flashing frequency, and/or location for a first type of notification (e.g., a text message, etc.) may be different than the activation color, pattern, dynamic transition time, flashing frequency, and/or location for a second, different type of notification (e.g., an email, etc.).

The controller 610 may additionally or alternatively be configured to activate the color-changing product 400 based on data available on the wearer's personal device. The wearer's personal device may run or operate numerous applications such as a weather application, a maps application, etc. By way of example, the controller 610 may be configured to activate the color-changing product 400 or a portion thereof based on the data in the weather application indicating characteristics regarding the current weather (e.g., sunny, rain, snow, fog, hot, cold, etc.). For example, the controller 610 may be configured to activate a first color, activate a first pattern, activate a first dynamic pattern, cause the pattern to flash/blink at a first rate, activate a first portion, etc. based on a first weather characteristic; while the controller 610 may be configured to activate a second color, activate a second pattern, activate a second dynamic pattern, cause the pattern to flash/blink at a second rate, activate a second portion, etc. based on a second weather characteristic.

By way of another example, the controller 610 may be configured to activate the color-changing product 400 or a portion thereof based on the data in the maps application indicating directions to a destination during a GPS session (e.g., turn left, turn right, continue straight, arrived, etc.). For example, the controller 610 may be configured to activate a first color, a first pattern, a first dynamic pattern, cause the pattern to flash/blink at a first rate, activate a first portion (e.g., a right sleeve, etc.), etc. based on a first direction characteristic (e.g., turn right, etc.); while the controller 610 may be configured to activate a second color, activate a second pattern, activate a second dynamic pattern, cause the pattern to flash/blink at a second rate, activate a second portion (e.g., a left sleeve, etc.), etc. based on a second direction characteristics (e.g., turn left, etc.).

Figure 63:
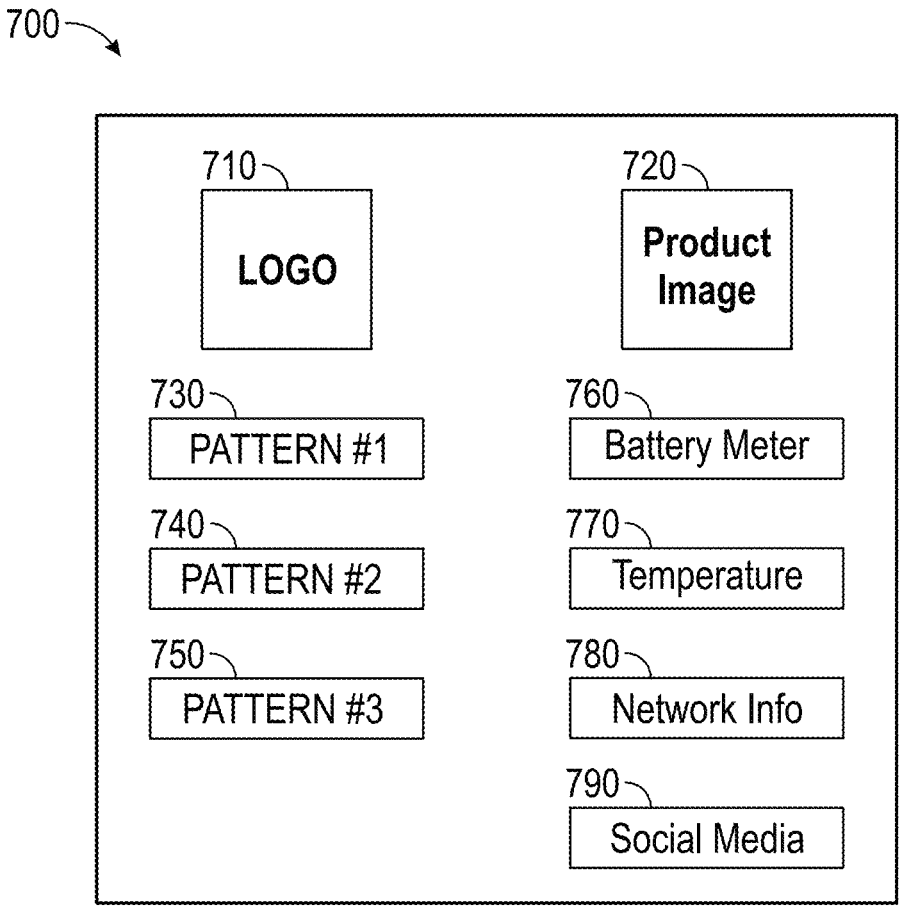
FIG. 63 is a schematic diagram of a graphical user interface of an application provided by an input device, according to an exemplary embodiment.

According to the exemplary embodiment shown in FIG. 63, a graphical user interface, shown as GUI 700, is provided to a user via the input device 630 (e.g., on a display thereof, etc.) through an app stored thereon or a program accessed thereby. As shown in FIG. 63, the GUI 700 has a logo button 710, a product image section 720, a first pattern button 730, a second pattern button 740, a third pattern button 750, a battery meter button 760, a temperature button 770, a network information button 780, and a social media button 790. In other embodiments, the GUI 700 provides more, fewer, or different buttons or sections. The logo button 710 may facilitate selectively manipulating the visual appearance (e.g., color, pattern, etc.) of a logo or embroidered portion (e.g., the embroidered portion 462, the embroidered portion 472, etc.) of the color-changing product 400. The product image section 720 may visually depict how the color-changing product 400 currently looks or provide a visual rendering of what the color-changing product 400 may look like following confirmation of a command to change a color and/or a pattern of the color-changing product 400 (e.g., via the logo button 710, the first pattern button 730, the second pattern button 740, the third pattern button 750, etc.).

The first pattern button 730, the second pattern button 740, and/or the third pattern button 750 may facilitate selectively manipulating the color and/or pattern of the color-changing product 400. By way of example, the first pattern button 730 may be associated with a first predefined pattern (e.g., a striped pattern, a checkered pattern, etc.), the second pattern button 740 may be associated with a second predefined pattern (e.g., a gradient color pattern, etc.), and the third pattern button 750 may be associated with a third predefined pattern (e.g., a solid color pattern, etc.). In some embodiments, the patterns associated with the first pattern button 730, the second pattern button 740, and/or the third pattern button 750 are selectively set by the user (e.g., downloadable, chosen from a larger list, etc.) and/or selectively customizable. In some embodiments, the GUI 700 provides fewer or more than three pattern options (e.g., two, four, five, etc. selectable patterns).

In some embodiments, the GUI 700 additionally or alternatively provides a notification button that facilitates defining which types of notifications cause activation of the color-changing product 400 and/or selecting what color, pattern, dynamic pattern, flash/blink rate, portion of the color-changing product 400, etc. is activated based on a respective type of notification. In some embodiments, the GUI 700 additionally or alternatively provides a dynamic button that facilitates starting, stopping, setting a timer for, setting a transition time for, setting a flash rate/frequency for, and/or identifying which events cause the dynamic pattern.

The battery meter button 760 may facilitate selectively presenting a battery status or power level of the power supply 620 or the PV source 492 to the user of the input device 630 (e.g., upon selection by the user, etc.). The temperature button 770 may facilitate selectively presenting a temperature setting and/or a current temperature of the color-changing product 400 or various individual portions thereof to the user of the input device 630 (e.g., upon selection by the user, etc.). The network information button 780 may facilitate (i) selectively connecting the input device 630 to a respective color-changing product 400 (i.e., the controller 610 thereof) and/or (ii) selectively presenting network connection information to the user of the input device 630 (e.g., upon selection by the user, etc.) regarding communication between (a) the input device 630 and (b) the controller 610 (e.g., communication protocol type, connection strength, an identifier of the color-changing product 400 connected to the input device 630, etc.) and/or an external network (e.g., communication protocol type, connection strength, etc.). The social media button 790 may facilitate linking the app on the input device 630 to the user's social media account(s) (e.g., Facebook, Instagram, Snapchat, Twitter, etc.). Such linking may allow the user to share the patterns they have generated with their peers and/or facilitate downloading patterns generated by others via their social media account.

These examples are not intended as limiting but are provided merely to provide certain non-exclusive examples of how fabrics incorporating the color-changing fibers 10 disclosed herein may be controlled by a user. It should be noted that although the aforementioned examples contemplate the use of a wireless electronic device such as a smartphone to communicate with and change the color and/or pattern of a fabric and/or an individual fiber, any of a variety of other types of controllers may be used to control the color and/or pattern of a fabric, and may employ wired or wireless communications connections, and may use any useful wired or wireless communications protocols that are now known or that may be hereafter developed. The color and/or pattern changes may be manually activated at a desired time by a user or may be programmed to occur (or not occur) at defined times and/or intervals in the future. In some embodiments, the controller 610 is configured to activate at least a portion of the color-changing fibers 10 in response to the smartphone receiving a notification (e.g., a text message, an email, a call, etc.). The type of activation (e.g., color, pattern, etc.) or portion of the color-changing product 400 that is activated may correspond with the type of notification or the cause of such notification (e.g., the person texting, emailing, calling, etc.). The controller 610 may allow for programming of such timer settings and/or notifications using any of a variety of possible programming methods, all of which are intended to fall within the scope of the present disclosure.

Figure 64:
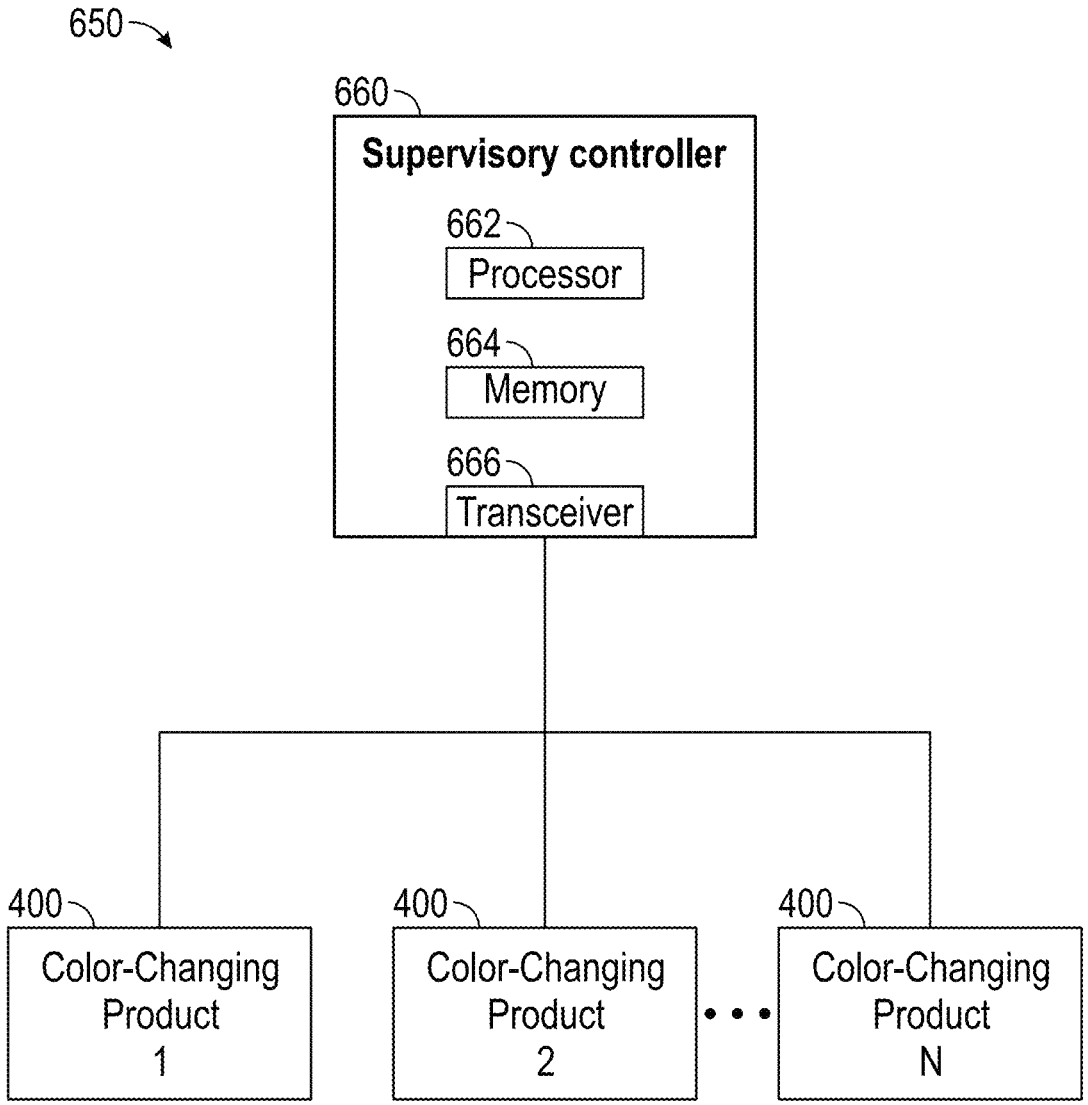
FIG. 64 is a schematic diagram of a supervisory control system for the color-changing products of FIGS. 29-55C, according to an exemplary embodiment.

According to the exemplary embodiment shown in FIG. 64, a second, supervisory control system, shown as remote control system 650, includes a controller, shown as supervisory controller 660, that is configured to communicate with and a provide commands to a plurality of the color-changing products 400. The supervisory controller 660 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the exemplary embodiment shown in FIG. 64, the supervisory controller 660 includes a processing circuit having a processor 662 and a memory 664. The processing circuit may include an ASIC, one or more FPGAs, a DSP, circuits containing one or more processing components, circuitry for supporting a microprocessor, a group of processing components, or other suitable electronic processing components. In some embodiments, the processor 662 is configured to execute computer code stored in the memory 664 to facilitate the activities described herein. The memory 664 may be any volatile or non-volatile computer-readable storage medium capable of storing data or computer code relating to the activities described herein. According to an exemplary embodiment, the memory 664 includes computer code modules (e.g., executable code, object code, source code, script code, machine code, etc.) configured for execution by the processor 662.

As shown in FIG. 64, the supervisory controller 660 includes a communications interface, shown as transceiver 666. The transceiver 666 is configured to send and receive signals between the supervisory controller 660 and one or more of the color-changing products 400 (e.g., the transceivers 616 thereof, etc.). The transceiver 666 may facilitate wired and/or wireless (e.g., Bluetooth, NFC, Zigbee, radio, cellular, Wi-Fi, short-range, long-range, etc.) communication. By way of example, the transceiver 666 may include one or more ports to facilitate making a wired connection. By way of another example, the transceiver 666 may include wireless components (e.g., Bluetooth components, Wi-Fi components, a cellular chip, etc.) to facilitate wireless communication.

One example implementation of the remote control system 650 may be to facilitate control of a plurality of color-changing products 400 of a single user with a single control system. By way of example, the remote control system 650 may be a hub installable within a home, office, or other building (e.g., a wall mounted hub, a standalone hub, etc.) and communicate via a wired and/or wireless connection with the plurality of color-changing products 400 (e.g., within the user's home, etc.). A user may interact with the hub to control the various color-changing products 400 connected thereto.

Another example implementation of the remote control system 650 may be to facilitate control of a plurality of color-changing products 400 of multiple, different users with a single control system. By way of example, the remote control system 650 may be a hub installable or usable within a public space or arena (e.g., a sport arena, etc.). The hub may communicate wirelessly with the plurality of color-changing products 400 within communication range of the hub. Such a remote control system 650 may be configured to synchronize control of the plurality of color-changing products 400 within the range thereof. As an example, spectators at a sports arena may all be wearing sports apparel having the color-changing capabilities described herein. The hub may then, based on the respective location of each of the spectators wearing the sports apparel, control the sports apparel to manipulate a color scheme, make a static design, make a dynamic design, etc. throughout the stands. As another example, a group of children on a field trip may all be wearing clothing and/or have accessories (e.g., a shirt, a hat, a backpack, etc.) having the color-changing capabilities. A chaperone may control the clothing and/or accessories using the hub (e.g., a smartphone or other portable device connectable to the clothing and/or accessories) such that the group of children have visual characteristics that distinguish them from others.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X; Y; Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the fibers, yarns, fabrics, and end products as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

The invention claimed is:

1. A method comprising:

providing a fabric to an electrical connectorization system including an ultrasonic welder, the fabric including a plurality of color-changing fibers;

providing a connection bus to the electrical connectorization system, the connection bus separate from the fabric and the plurality of color-changing fibers; and operating the electrical connectorization system to move the fabric and the connection bus into engagement with the ultrasonic welder to generate one or more welds between the connection bus and at least a subset of the plurality of color-changing fibers as the fabric and the connection bus pass the ultrasonic welder.

2. A method comprising:

providing a fabric to an electrical connectorization system including an ultrasonic welder, the fabric including a plurality of color-changing fibers;

providing a connection bus to the electrical connectorization system, wherein the connection bus includes a metallic foil material; and operating the electrical connectorization system to move the fabric and the connection bus into engagement with the ultrasonic welder to generate one or more welds between the connection bus and at least a subset of the plurality of color-changing fibers as the fabric and the connection bus pass the ultrasonic welder.

3. The method of claim 2, wherein the connection bus has a multi-layer structure including a first layer and a second layer, wherein the first layer includes the metallic foil material and the second layer does not include the metallic foil material.

4. The method of claim 3, wherein the second layer is positioned beneath the first layer.

5. The method of claim 4, wherein the second layer at least partially isolates the one or more welds from a surrounding environment.

6. The method of claim 4, wherein the second layer softens in response to interaction with the ultrasonic welder to promote adhesion of the second layer to the fabric.

7. The method of claim 3, wherein the second layer is positioned on top of the first layer.

8. The method of claim 7, wherein the second layer increases friction between the ultrasonic welder and the connection bus.

9. The method of claim 1, wherein the connection bus is a first connection bus, the method further comprising:

providing a second connection bus to the electrical connectorization system; and ultrasonically welding the second connection bus to a different portion of the fabric.

10. The method of claim 1, wherein providing the fabric to the electrical connectorization system includes securing a roll of the fabric to a feed roller of the electrical connectorization system, the method further comprising:

connecting a free end of the fabric to an intake roller; and driving at least one of the feed roller or the intake roller to move the fabric from the feed roller, past the ultrasonic welder, and onto the intake roller.

11. The method of claim 1, wherein providing the connection bus to the electrical connectorization system includes securing a spool of the connection bus to a bus interface of the electrical connectorization system.

12. The method of claim 11, wherein the electrical connectorization system includes a bus guide positioned to receive and direct the connection bus from the bus interface and along an edge of the fabric to be welded thereto by the ultrasonic welder.

13. The method of claim 1, wherein each of the plurality of color-changing fibers includes a conductive core and a polymeric coating including a color-changing pigment.

14. The method of claim 13, wherein the ultrasonic welder generates the one or more welds through the polymeric coating and between the connection bus and the conductive core.

15. The method of claim 1, further comprising:

forming a plurality of color-changing products using the fabric with the connection bus welded thereto;

determining, by one or more processing circuits, that two or more of the plurality of color-changing products are within a certain range; and transmitting, by the one or more processing circuits, wireless signals to the two or more of the plurality of color-changing products within the certain range to coordinate a color-change operation between the two or more of the plurality of color-changing products.

16. The method of claim 15, wherein the certain range is based on a range of Bluetooth.

17. A method comprising:

providing a fabric to an electrical connectorization system including an ultrasonic welder, the fabric including color-changing fibers having a conductive core and a polymeric coating including a color-changing pigment;

providing a connection bus to the electrical connectorization system; and operating the ultrasonic welder to generate one or more welds (a) through the polymeric coating of at least a subset of the color-changing fibers and (b) between the connection bus and at least the subset of the color-changing fibers.

18. The method of claim 17, wherein the connection bus includes a metallic foil material.

19. The method of claim 17, wherein the connection bus has a multi-layer structure including a first layer and a second layer, wherein the first layer includes a first material and the second layer includes a second material different from the first material.

20. The method of claim 19, wherein the first material is metallic foil.

* * * * *